US011931801B2

(12) United States Patent
Thompson et al.

(10) Patent No.: US 11,931,801 B2
(45) Date of Patent: Mar. 19, 2024

(54) MULTI-GRAIN SELECTOR DEVICES, METHODS FOR MANUFACTURING COLUMNAR GRAINED ARTICLES USING THE SELECTOR DEVICES, AND COLUMNAR GRAINED ARTICLES MANUFACTURED USING THE SELECTOR DEVICES

(71) Applicant: General Electric Company, Schenectady, NY (US)

(72) Inventors: Anthony Mark Thompson, Niskayuna, NY (US); Andrew Fox Thompson, Niskayuna, NY (US); Judson Sloan Marte, Troy, NY (US)

(73) Assignee: GE INFRASTRUCTURE TECHNOLOGY LLC, Greenville, SC (US)

( * ) Notice: Subject to any disclaimer, the term of this patent is extended or adjusted under 35 U.S.C. 154(b) by 2 days.

(21) Appl. No.: 17/289,274

(22) PCT Filed: Nov. 27, 2018

(86) PCT No.: PCT/US2018/062601

§ 371 (c)(1),
(2) Date: Apr. 28, 2021

(87) PCT Pub. No.: WO2020/112087

PCT Pub. Date: Jun. 4, 2020

(65) Prior Publication Data

US 2021/0394261 A1 Dec. 23, 2021

(51) Int. Cl.
*B22D 27/04* (2006.01)

(52) U.S. Cl.
CPC ..... *B22D 27/045* (2013.01)

(58) Field of Classification Search
CPC ..... B22D 27/04; B22D 27/045
(Continued)

(56) References Cited

U.S. PATENT DOCUMENTS

2009/0078390 A1* 3/2009 Tamaddoni-Jahromi ..... C30B 29/52 164/122.2
2012/0251330 A1 10/2012 Suzuki et al.

FOREIGN PATENT DOCUMENTS

EP 0087379 A1 * 8/1983 ..... B22D 27/045
EP 0126550 A1 * 11/1984 ..... B22D 27/045
(Continued)

OTHER PUBLICATIONS

Office Action dated Nov. 16, 2022 for corresponding JP Patent Application No. 2021-525283. English machine translation provided. (7 pages).

(Continued)

*Primary Examiner* — Kevin E Yoon
(74) *Attorney, Agent, or Firm* — The Small Patent Law Group LLC; William Breeze

(57) ABSTRACT

A multi-grain selector device includes an outer body having exterior surfaces. The outer body includes a cooling side configured to face a cooling plate of a casting furnace and an opposite mold side configured to face into a mold. The outer body includes an array of multiple grain selector columns each formed from two or more transversely oriented, elongated channels that are fluidly coupled with each other in an end-to-end arrangement oriented along a growth direction that extends from the cooling side of the outer body toward the mold side of the outer body. The selector columns extend to growth openings on the mold side of the outer body. Each of the selector columns is configured to form a single grain column out of the corresponding growth opening that is part (Continued)

of a columnar grained article to be formed in the mold that grows along the growth direction.

12 Claims, 28 Drawing Sheets

(58) Field of Classification Search
USPC ..... 164/122–122.2
See application file for complete search history.

(56) References Cited

FOREIGN PATENT DOCUMENTS

| | | | |
|---|---|---|---|
| EP | 0126550 | A1 | 11/1984 |
| EP | 2165787 | A1 | 3/2010 |
| EP | 2378078 | A1 | 10/2011 |
| JP | 2003311392 | A | 11/2003 |
| JP | 2005-271083 | A | 10/2005 |
| JP | 2013-533937 | A | 8/2013 |

OTHER PUBLICATIONS

International Preliminary Report on Patentability dated Jun. 10, 2021 for corresponding application No. PCT/ JS2018/062601 (7 pages).

* cited by examiner

MULTI-GRAIN SELECTOR DEVICES, METHODS FOR MANUFACTURING COLUMNAR GRAINED ARTICLES USING THE SELECTOR DEVICES, AND COLUMNAR GRAINED ARTICLES MANUFACTURED USING THE SELECTOR DEVICES

FIELD

The subject matter described herein relates to manufacture of directionally solidified metal components.

BACKGROUND

Many components can be formed using directional solidification techniques. Directional solidification (DS) techniques enable the solidification of materials with grains aligned in a specific direction. Directional and single crystal structures can be created to improve the mechanical and metallurgical properties of the cast materials. These structures can be produced by casting a melt of an alloy. Heat transfer conditions during solidification of the casting are controlled so that a solidification front advances along a growth direction to generate primary columnar crystals or grains and to avoid or reduce nucleation of secondary grains from the melt.

Directional solidification is not, however, without drawbacks. Hot tearing can occur during casting when the metal is cooling between the liquidus and solidus temperatures of the alloy, typically as the solids content exceeds 90% of the volume fraction. On the casting surface, the hot tear is often tortuous with numerous metal bridges. The fracture surface typically reveals a dendritic structure with some transgranular fracture. Hot tears are usually observed to have propagated along grain boundaries of equiaxed or columnar dendritic grains. They typically do not propagate along the inter-dendritic regions of single crystals or along low angle boundaries.

One attempted solution to reducing the frequency at which hot tearing occurs is to slow down the withdrawal rate of the directional solidification casting. But, this attempt can significantly reduce the throughput of the casting furnace and add to the cost of the casted component. Additionally, the reduced withdrawal rate increases the grain size and can increase the susceptibility to hot tearing, since the strain is concentrated in few grain boundaries. The reduced withdrawal rate also can increase the inter-dendritic arm spacing and require longer times to solution heat treat. This can also reduce the throughput in the factory and add to the cost of the component. Slower withdrawal rates can also lead to other casting defects such as freckles.

Another problem with directional solidification is that grain size can be difficult to control. Designers of components such as airfoils consider the stiffness of the metal alloy when calculating the stiffness and vibration frequencies of the component. For components with fine-grained equiaxed microstructures, the stiffness can be assumed to be isotropic and uniform in each direction. For single crystal components, the stiffness of each crystallographic direction can be considered as well when designing the components. For directional solidification components, the stiffness in the axial (e.g., columnar) direction is assumed to be that of the crystallographic aligned direction, while the in-plane stiffness is assumed to be an average of the in-plane crystallographic stiffness, since the columnar grains are randomly aligned relative to each other. This assumption becomes invalid as the grains become large and span the airfoil section.

Additionally, the strain response and vibration frequency of the airfoil is a function of the crystallographic orientation. While single crystals have excellent creep resistance, the extremely curved shape of the advanced airfoils can mean that a portion of the airfoil is oriented with the major (e.g., flow path) load acting normally to a low stiffness direction. This can lead to excessive strains and potentially change the harmonics of the blade. To adjust the harmonics of the blade, internal stiffening ribs can be added, or the external profile of the airfoil can be changed (e.g. adding midspan shrouds). But, these solutions can add weight and complicate the manner in which the blade is cast.

BRIEF DESCRIPTION

In one embodiment, a multi-grain selector device includes an outer body defining exterior surfaces of the selector device. The outer body includes a cooling side configured to face a cooling plate of a casting furnace and an opposite mold side configured to face into a mold. The outer body includes an array of multiple grain selector columns each formed from two or more transversely oriented, elongated channels that are fluidly coupled with each other in an end-to-end arrangement oriented along a growth direction that extends from the cooling side of the outer body toward the mold side of the outer body. The selector columns extend to growth openings on the mold side of the outer body. Each of the selector columns is configured to form a single grain column out of the corresponding growth opening that is part of a columnar grained article to be formed in the mold that grows along the growth direction.

In one embodiment, a multi-grain selector device includes an outer body defining exterior surfaces of the selector device. The outer body includes a cooling side configured to face a cooling plate of a casting furnace and an opposite mold side configured to face into a mold. The outer body includes an array of multiple grain selector columns each formed from a helical channel that helically extends around a direction that is along or parallel to a growth direction oriented from the cooling side of the outer body toward the mold side of the outer body. Each of the selector columns is configured to form a single grain column of a columnar grained article to be formed in the mold that grows along the growth direction. The growth openings of the selector columns in the array are arranged in a regular, repeating pattern along the mold side.

In one embodiment, a method includes placing a multi-grain selector device into a mold for a columnar grained article. The selector device extends from a cooling side to an opposite mold side and including an array of multiple grain selector columns each configured to form a single grain column of the columnar grained article along a growth direction. The method also includes at least partially filling the selector device with fluid metal and growing a single metal grain from the fluid metal in each of the selector columns in the selector device. The single metal grains grow along the selector columns. The method also includes forming the columnar grained article with growth of the single metal grains out of the mold side of the selector device.

DETAILED DESCRIPTION

Figure 2:
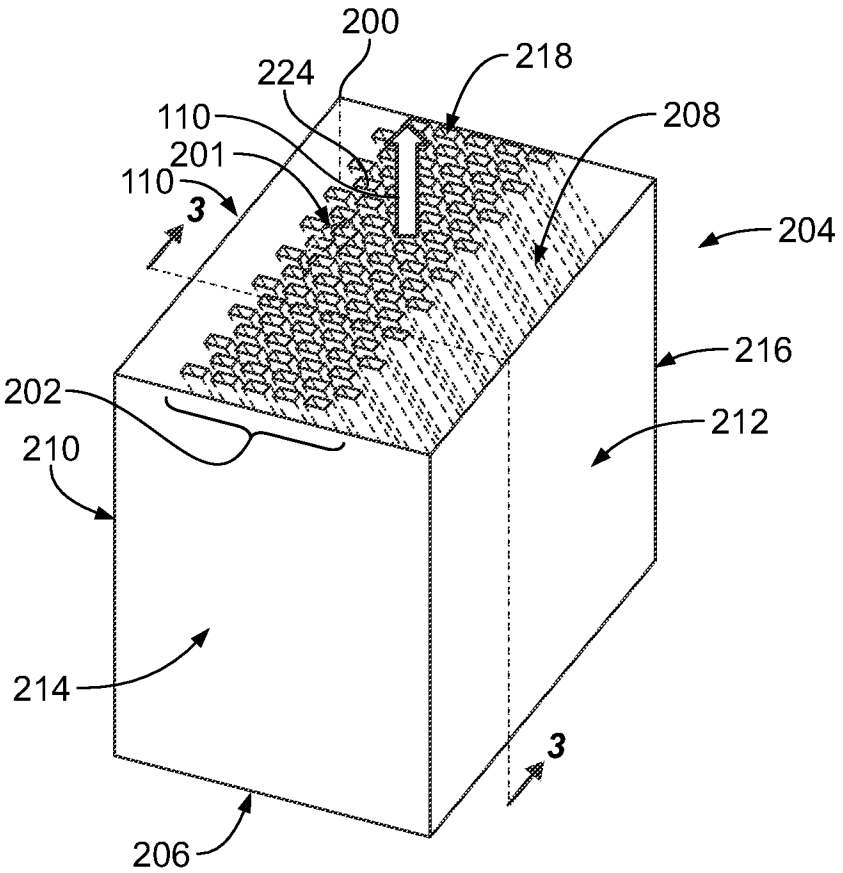
FIG. 2 illustrates a perspective view of one embodiment of a grain selector device.

The inventive subject matter described herein relates to multi-grain selector devices that can be used to form and orient columns of single grain metal or metal alloy components formed using directional solidification. The inventive subject matter also relates to a directional solidification casting process using such multi-grain selector devices, as well as columnar grained articles or objects formed using the multi-grain selector devices and/or the casting process described herein.

The multi-grain selector devices can be used to form multi-grain columnar structures or articles in which metal (or metal alloy) grains are oriented at low angles to neighboring (e.g., adjacent) grains. For example, neighboring or adjacent grains of the structures may be elongated along different directions that are nearly parallel to each other. The difference in orientations of these grains may be less than fifteen degrees, less than ten degrees, or less than five degrees in different embodiments. The columnar articles also can have low angles between grain boundaries disposed between the grains forming the articles. The low angles between the grain boundaries can help reduce grain coarsening in the article in that the lower energy in grain boundaries at low angles (e.g., less than fifteen degrees, less than ten degrees, or less than five degrees) relative to larger angles can reduce how large grains grow during directional solidification of the articles.

The multi-grain selector devices described herein can be formed using additive manufacturing. Alternatively, the selector devices can be formed in another manner, such as casting. A multi-grain selector device can be a structure having an array of multiple grain selectors. Each selector can be a restricted channel or volume in which one or more single crystal seed nucleate, with only a single crystal grain growing out of the growth opening of the selector. The selectors in a selector device are oriented to create a multi-grain, directionally solidified article in which the grains are oriented at low angles to neighboring grains. This can cause the multi-grain or multi-crystal article to have mechanical properties similar to that of a single crystal article, but with the faster speed and robust processing benefits of a directionally solidified structure. Since the grains are only slightly misoriented, the grain boundaries may be more likely to be lower energy boundaries (relative to larger angles between the grain orientations), and thus be more resistant to grain coarsening throughout the length of the article (relative to larger angles between the grain orientations).

One example of an article or structure that can be formed using the multi-grain selector devices described herein is a turbine blade or airfoil. Alternatively, one or more other components can be formed.

In one embodiment, the multi-grain selector device is shaped to create curvature in the orientation of the grains relative to a surface. For example, for curved components such as an airfoil, the number and misorientation of the columnar grains created by the selector device can be oriented such that a stiff direction of the article is normal to the external surface of the direction of load (e.g., from the flow path in an airfoil). In another embodiment, the orientations of the seeds could be used to dampen, or otherwise tune a blade for improved aeromechanics, such as natural frequencies or to promote aerodynamic damping.

Figure 1:
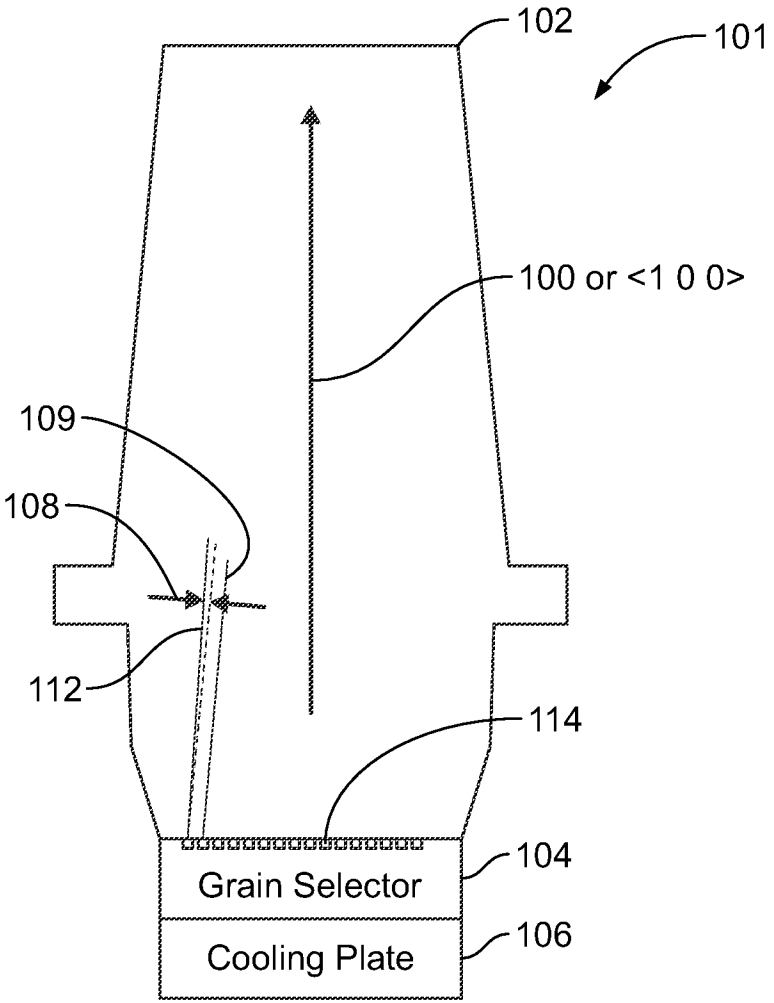
FIG. 1 schematically illustrates one example of a directional solidification casting system.

FIG. 1 schematically illustrates one example of a directional solidification casting system 101. The system 101 can be used to create multi-grain columnar articles, such as airfoils. The system 101 includes a mold 102 that defines an interior volume into which a liquid (e.g., molten) metal or metal alloy is filled. A grain selector device 104 ("Grain Selector" in FIG. 1) is fluidly coupled with the interior of the mold 102 so that at least some of the liquid metal or metal alloy flows into the grain selectors in the selector device 104. The selector device 104 can be placed into contact with a cooling plate 106 that reduces the temperature of the metal or metal alloy that is near the cooling plate 106. In another embodiment, the selector device 104 can be positioned with a chamber between the grain selector 104 and cooling plate. This chamber is filled with molten metal prior to the metal entering the selector device 104. The chamber provides a thermally conductive path between the grain selector 104 and the cooling plate and allows metal grains to develop a desired or designated orientation (e.g., a <100> vertical orientation) prior to the grains entering the selector device 104. As used herein, the brackets [and] or <and > with a three-digit number enclosed by the brackets indicate the direction in which a crystal grain is oriented. Other reference numbers that are not enclosed in these brackets do not indicate a crystal grain orientation. For example, reference number 101 in FIG. 1 represents the casting system, while the number [101] or <101> represents a crystalline direction.

The selector device 104 includes several grain selectors 114 formed from small channels or openings that cause preferential growth of crystal grains in the metal or metal alloy that are oriented with the <010> direction in the plane of the zig-zag shaped selectors 114 (described below). A single crystal grain 108, 109 may begin forming and growing primarily along a growth direction <100> out of each of the grain selectors 114. Only two grains 108, 109 are schematically shown in FIG. 1 to more clearly illustrate the small difference in orientations of the grains 108, 109, as described below. The single crystal grains 108, 109 may rotate or otherwise grow in secondary directions, but primarily grow along the growth direction <100>. That is, the grains 108, 109 may grow in directions that are close to the growth direction <100> (e.g., within fifteen degrees or less of the grown direction <100>). The single crystal grains 108, 109 may not all be entirely directed along the growth direction <100> but may be slightly misaligned with the growth direction <100>. For example, the grains 108, 109 may grow along slightly different directions.

Neighboring grains 108, 109 may grow along directions that are oriented at a deviation angle 112 with respect to each other. This deviation angle 112 may be small, such as less than fifteen degrees, less than ten degrees, or less than five degrees from the direction in which a neighboring grain 108, 109 grows. The deviation angle 112 is shown in FIG. 1 as the angle between a first direction in which a first grain grows 108 and a second direction in which a neighboring second grain 109 grows. The dashed line in FIG. 1 is parallel to the second direction in which the grain 109 grows. The grains 108, 109 grow along directions that are very close to each other, which can reduce the energy of boundaries between the grains 108, 109 and reduce the coarsening of the grains 108, 109. The grains 108, 109 continue to grow primarily along the growth direction <100> to form a columnar grained article in the shape of the interior of the mold 102.

Figure 3:
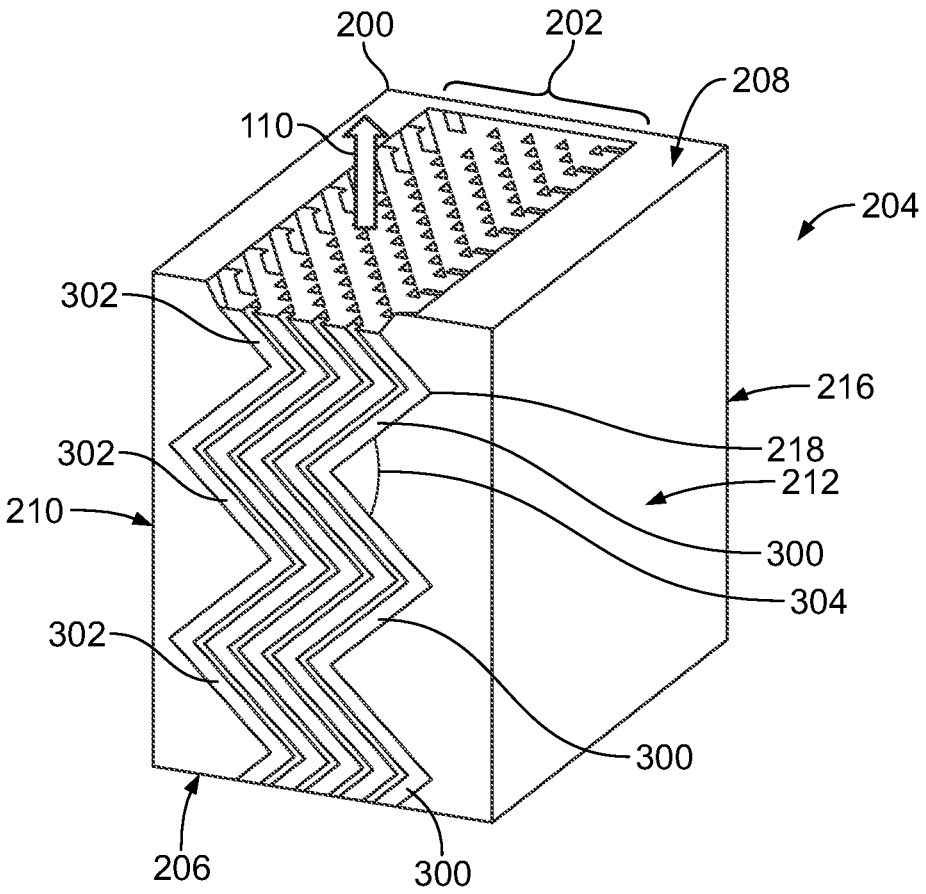
FIG. 3 illustrates a cross-sectional view of the grain selector device along line 3-3 shown in FIG. 2.

FIG. 2 illustrates a perspective view of one embodiment of a grain selector device 204. FIG. 3 illustrates a cross-sectional view of the grain selector device 204 along line 3-3 shown in FIG. 2. The selector device 204 can represent the selector device 104 shown in FIG. 1. The selector device 204 includes an outer body 200 that defines exterior surfaces 206, 208, 210, 212, 214, 216 of the selector device 204. The exterior surface 206 can be referred to as a cooling side that faces or engages the cooling plate 106 shown in FIG. 1 during operation of the selector device 204. The opposite surface 208 can be referred to as a mold side or a growth side as the surface 208 is the side that faces the interior of the mold 102 and from which the single grains 108, 109 grow. The opposite surfaces 210, 212 and the opposite surfaces 214, 216 form sidewalls of the selector device 204, and extend from the cooling side 206 to the mold side 208. In the illustrated embodiment, the surfaces 206, 208 are parallel to each other, the surfaces 210, 212 are parallel to each other, and the surfaces 214, 216 are parallel to each other.

The body 200 includes an array 202 of grain selector columns 218. The columns 218 are passageways or channels that extend into the body 200 from the mold side 208. For example, the columns 218 may be channels having open ends or growth openings 224 on the surface 208. The grains 108, 109 formed by the selector device 204 grow out of the growth openings 224. For example, the fluid metal or metal alloy extends to the bottom of the columns 218 to or near the cooling plate 106. The cooling plate 106 cools the metal or metal alloy, and grains begin to grow upward through the columns 218. The columns 218 are narrow such that the grains are constrained to grow as single crystal grains upward through the columns 218. For example, in the illustrated embodiment, each column 218 is an elongated column in that the channel defined by the column 218 is longer than the column 218 is wide. The column 218 may extend farther into the body 200 from the mold side 208 than the column 218 extends in any direction in a two-dimensional plane that is parallel to the mold side 208. Alternatively, the column 218 may be wider and/or shorter.

Each of the columns 218 is formed from transversely oriented, elongated channels 300, 302 (shown in FIG. 3).

The channels 300, 302 forming a column 218 are fluidly coupled with each other in an end-to-end arrangement. For example, each channel 300 or 302 can be an elongated linear conduit with one end extending into the end of another channel 302 or 300 (or, with respect to the channel 300, 302 that extends to the mold side 208, extending out of the body 200). The channels 300, 302 are elongated along different directions that are angled with respect to each other. For example, the channels 300, 302 can be oriented at an angle 304 (shown in FIG. 3) of ninety degrees with respect to each other. Alternatively, the channels 300, 302 can be oriented at smaller angles with respect to each other. The channels 300, 302 can be oriented at angles of forty-five degrees or less, thirty degrees or less, fifteen degrees or less, ten degrees or less, or five degrees or less.

The columns 218 formed by the channels 300, 302 are elongated in directions parallel to the growth direction <100>. For example, each column 218 begins near or at the cooling side 206 and extends to the mold side 208 in a direction that is along or parallel to the growth direction <100>.

As shown, the channels 300, 302 form a zig-zag shape in each of the columns 218. The zig-zag shape is created by neighboring channels 300, 302 in each column 218 being oriented at different angles. For example, the channels 300, 302 that are directly contacted with each other in a column 218 and that are not separated from each other by any other intervening channels can be elongated in different directions. One channel 300 or 302 can be oriented at a first angle away (or toward) the growth direction <100>, while the neighboring channel 302 or 300 can be oriented at a second angle toward (or away) from the growth direction <100>, with the second angle having the same magnitude but opposite sign as the first angle. For example, if the first angle at which the channel 300 is oriented relative to the growth direction <100> is thirty degrees, then the second angle at which the neighboring channel 302 is oriented relative to the growth direction <100> is negative thirty degrees. The alternating, back-and-forth orientations of the neighboring channels 300, 302 in the same column 218 create a zig-zag shape, as shown in FIG. 3. The zig-zag shapes of the columns 218 can be parallel to each other. For example, each channel 300 in the columns 218 is parallel to the channels 300 in the other columns 218 and each of the channels 302 in the columns 218 is parallel to the channels 302 in the other columns 218, in the illustrated embodiment. Alternatively, one or more of the channels 300 or 302 and/or the columns 218 may not be parallel to the corresponding channels 300 or 302 in the other columns 218 and two or more of the columns 218 are not parallel to each other.

Each of the columns 218 is shaped to form a column of a single crystal metal or metal alloy grain that grows along the growth direction <100>. The array 202 of columns 218 forms an array of these single grain columns. The single grain columns in the array grow side-by-side to each other along directions are small angles from each other, as described above. The combination of the single grain columns forms the columnar grained article in the shape of the mold 102.

The zig-zag shapes formed by the columns 218 can be oriented in or along the same direction such that each column 218 would grow grains of the same orientation. For example, in a directionally solidified casting of a nickel-based super alloy such as Rene 108, the primary orientation of the single crystal grains growing out of each column 218 can be (100) in the growth or withdrawal direction <100> (e.g., the direction of temperature gradient). The secondary orientation of the single crystal grains can be (010) in the planes that contain each zig-zag column 218. With each zig-zag column 218 being oriented the same direction, the resultant microstructure of the columnar grained article will include or be formed from grains that are oriented with similar primary and secondary orientations.

As shown, the growth openings 224 of the columns 218 in the array 202 are arranged in a regular, repeating pattern on the mold side 208 of the body 200. For example, the growth openings 224 can be spaced apart and positioned relative to each other such that the arrangement of the growth openings 224 form hexagonal shapes 201 (referred to as a hexagonal pattern). For example, lines connecting the centers of the openings 224 can form the hexagonal shapes 201, as shown in FIG. 2. As another example, the growth openings 224 can be spaced apart and positioned relative to each other such that the arrangement of the growth openings 224 form square shapes (referred to as a square pattern). As another example, the growth openings 224 can be spaced apart and positioned relative to each other such that the arrangement of the growth openings 224 form rectangular shapes (referred to as a square pattern). Optionally, the growth openings 224 can be positioned in another arrangement.

In the illustrated embodiment, the body 200 is formed from orthogonal surfaces or sides 206, 208, 210, 212, 214, 216 that form a box or enclosure having three sets of parallel or opposite surfaces 206, 208; 210, 212; and 214, 216. Each of the surfaces or sides 206, 208, 210, 212, 214, 216 may be predominantly planar or flat. For example, the surface 206 may be planar in locations that are bounded by interfaces between the surface 206 and each of the surfaces 210, 212, 214, 216; the surface 210 may be planar in locations that are bounded by interfaces between the surface 210 and each of the surfaces 206, 208, 214, 216; and so on. Alternatively, one or more of these surfaces 206, 208, 210, 212, 214, and/or 216 may not be orthogonal to the other surfaces 206, 208, 210, 212, 214, 216. For example, one or more of the surfaces 206, 208, 210, 212, 214, 216 may not be parallel to another surface 206, 208, 210, 212, 214, 216 and/or may not be perpendicular to the other surfaces 206, 208, 210, 212, 214, 216. Optionally, one or more of the surfaces 206, 208, 210, 212, 214, 216 may be a curved surface or other non-planar surface.

FIGS. 4 through 10, 12 through 25, and 33 through 43 illustrate additional embodiments of the multi-grain selector device 104 shown in FIG. 1. These additional embodiments of the selector device 104 can include interlocking features in the bodies of the selector devices 104. The interlocking features engage corresponding, complementary, and/or mating interlocking features on other selector devices 104. The engagement between two or more selector devices 104 forms a multi-grain selector assembly formed from the two or more selector devices 104. The selector assembly can provide a larger array of the grain selectors 114 than a single grain selector provides.

Figure 4:
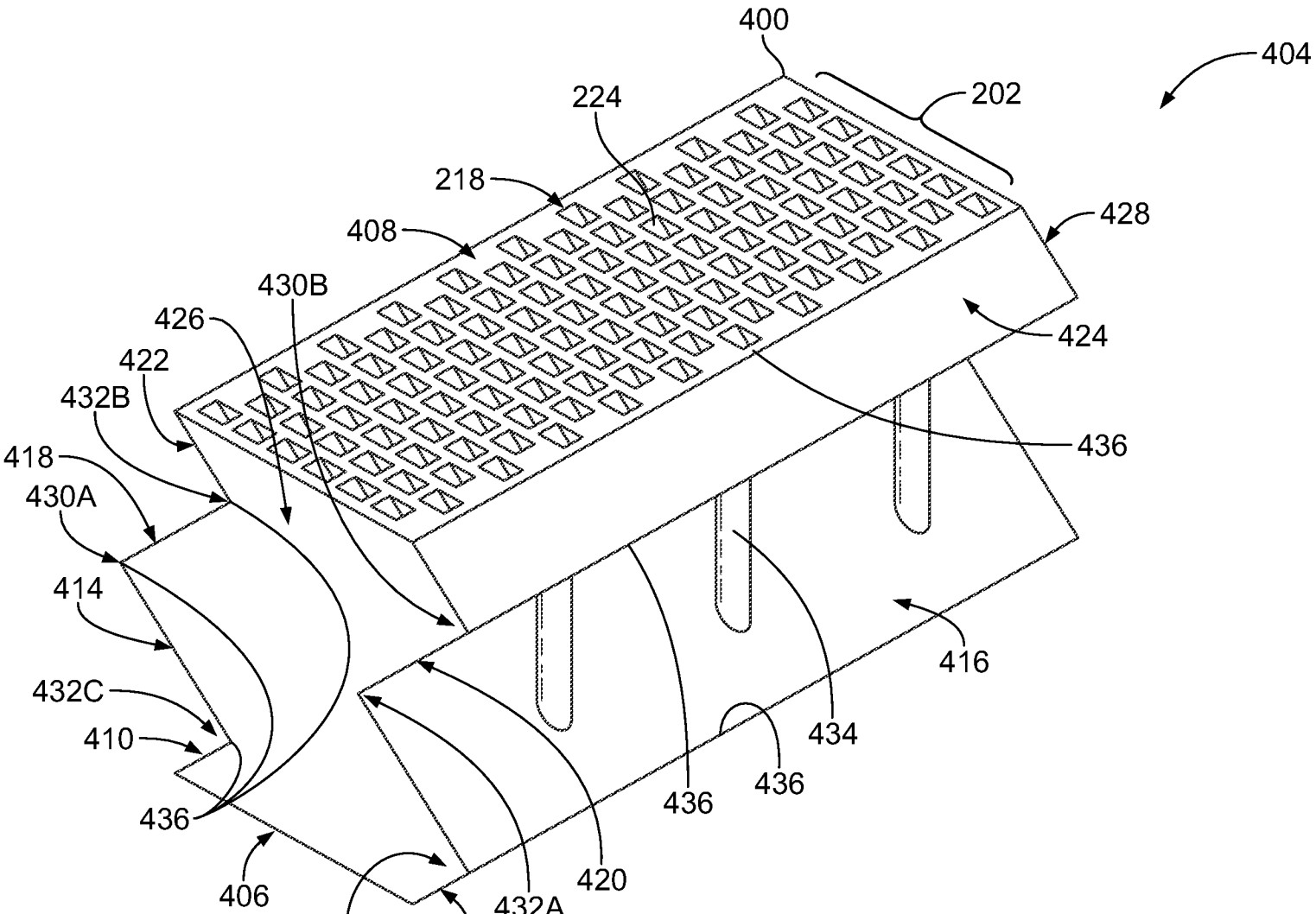
FIG. 4 illustrates a perspective view of a multi-grain selector device.
Figure 5:
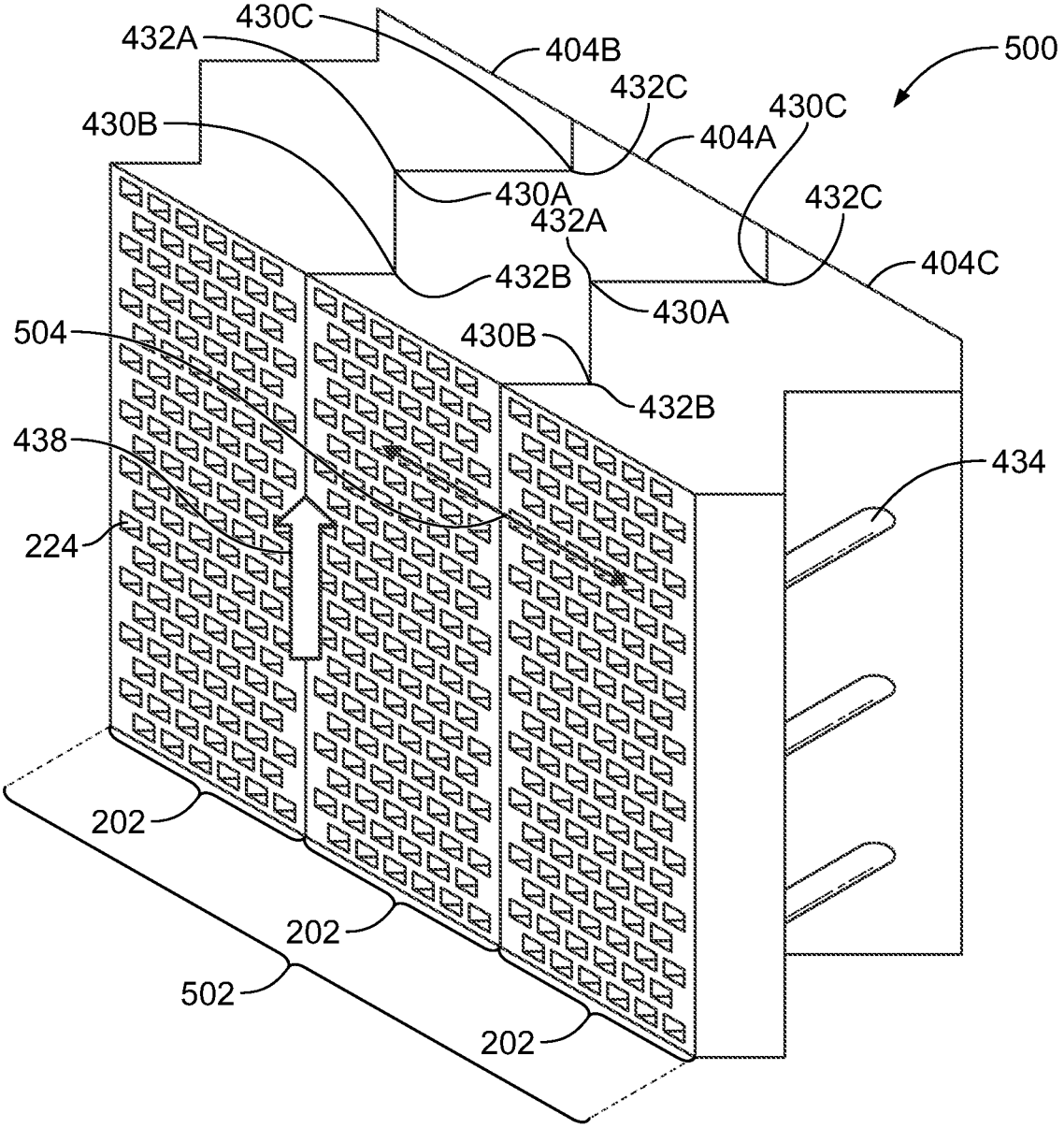
FIG. 5 illustrates a perspective view of a multi-grain selector assembly that is formed from multiple selector devices shown in FIG. 4.

FIG. 4 illustrates a perspective view of a multi-grain selector device 404. FIG. 5 illustrates a perspective view of a multi-grain selector assembly 500 that is formed from multiple selector devices 404 shown in FIG. 4 after the support columns 434 are removed. For example, the support columns 434 can be cut or otherwise removed from the selector devices 404 after formation of the selector devices 404 is complete. The selector device 404 can represent the selector device 104 shown in FIG. 1. A single selector device 404 can be used with the mold 102 to form a multi-grain columnar article or structure, or the selector assembly 500 can be used with the mold 102 to form a larger multi-grain columnar article or structure. For example, the larger selector assembly 500 that is formed from multiple selector devices 404 can be used in place of the selector device 104 that is shown in FIG. 1.

The selector device 404 includes an outer body 400 that defines exterior surfaces 406, 408, 410, 412, 414, 416, 418, 420, 422, 424, 426, 428 of the selector device 404. The exterior surface 406 can be the cooling side described above, and the opposite surface 408 can be the mold or growth side described above. The surfaces 426, 428 can be opposite end surfaces of the body 400 and can be oriented parallel to each other. The remaining surfaces 410, 412, 414, 416, 418, 420, 422, 424 are located between and interconnect the surfaces 406, 408 with each other and are located between and interconnect the surfaces 426, 428 with each other. In the illustrated embodiment, each of the surfaces 410, 412, 414, 416, 418, 420, 422, 424 continuously extends as a flat plane or surface from the end surface 426 to the opposite end surface 428. Optionally, a greater or lesser number of surfaces 408, 410, 412, 414, 416, 418, 420, 422, 424 may be located between the surfaces 406, 408 and/or between the surfaces 426, 428.

In the illustrated embodiment, the surfaces 406, 408 are parallel to each other and the surfaces 426, 428 are parallel to each other. The surfaces 416, 424 can be parallel to each other, the surfaces 412, 420 can be parallel to each other, the surfaces 414, 422 can be parallel to each other, and/or the surfaces 410, 418 can be parallel to each other. Optionally, one or more of these surfaces may not be parallel to the other surface described above.

The surfaces 410, 412, 414, 416, 418, 420, 422, 424 are transversely oriented at various angles to the surfaces 406, 408, to the surfaces 426, 428, and/or to each other. For example, the surfaces 410, 412 may be oriented to the surface 406 at acute or obtuse angles and/or the surfaces 422, 424 can be oriented to the surface 408 at the same or different acute or obtuse angles. The surface 414 may be oriented at a ninety-degree angle (or another angle) with respect to the surface 410 and the surface 416 may be oriented to a ninety-degree angle (or other angle) with respect to the surface 412. The surfaces 418, 420 can be oriented at ninety-degree angles (or other angles) with respect to the corresponding surfaces 414, 416, as shown in FIG. 4. The surfaces 422, 424 can be oriented at ninety-degree angles (or other angles) with respect to the corresponding surfaces 418, 420 and can be oriented at acute or obtuse angles with respect to the surface 408, as shown in FIG. 4. The arrangement of the surfaces 410, 412, 414, 416, 418, 420, 422, 424 forms a zig-zag shape on either of opposite sides of the body 400.

The body 400 includes the array 202 of grain selector columns 218 (shown in FIG. 2) described above. The grains 108, 109 (shown in FIG. 1) formed by the selector device 404 grow out of the growth openings 224 of the selector columns 218. The channels 300, 302 of the columns 218 can form zig-zag shapes, also as described above. Alternatively, the columns 218 can have fewer channels 300, 302 and/or can have a different shape (e.g., can be linear or angled in a single direction).

The surfaces 410, 412, 414, 416, 418, 420, 422, 424 are disposed between the surfaces 406, 408 along a first direction (e.g., the growth direction <100>) and are disposed between the surfaces 426, 428 along a perpendicular, second direction (e.g., a lateral direction to the growth direction <100>). In the illustrated embodiment, the selector devices 404 include support columns 434 extending between and coupled with the surfaces 416, 420. The support columns 434 provide mechanical support to prevent the surfaces 416, 420 from moving closer together or otherwise deforming. For example, the support columns 434 may be elongated bodies, members, or extensions of the surfaces 416, 420 that are elongated in directions that are perpendicular to the planes defined by the surfaces 406 and/or 408. Alternatively, the selector device(s) 404 may not include the support columns 434.

These surfaces 410, 412, 414, 416, 418, 420, 422, 424 can be referred to as engaging or interlocking surfaces because these surfaces 410, 412, 414, 416, 418, 420, 422, 424 mate with and lock the selector device 404 with other selector devices 404. As shown in FIG. 5, the surfaces 410, 412, 414, 416, 418, 420, 422, 424 can be shaped and/or sized to interlock with corresponding surfaces 410, 412, 414, 416, 418, 420, 422, 424 of another selector device 404 to form the selector assembly 500.

Intersections of the surfaces 412, 416 and intersections of the surfaces 414, 418 form protruding elbows 430 (e.g., elbows 430A-C) of the selector devices 404. Conversely, intersections of the surfaces 410, 414 and intersections of the surfaces 416, 420 form recessed valleys 432 (e.g., valleys 432A-C) of the selector devices 404. In the illustrated embodiment, the left-most side of the selector device 404 in the perspective of FIG. 4 includes a single elbow 430A and two valleys 432B, 432C and the right-most side of the selector device 404 includes two elbows 430B, 430C and a single valley 432A. Alternatively, one or more of these sides of the selector device 404 can include fewer or more elbows 430 and/or valleys 432.

The elbows 430 and valleys 432 of the selector devices 404 mate with each other to secure the selector devices 404 together. The elbows 430 of one selector device 404 are shaped to fit and be received in the valleys 432 of other selector devices 404 on opposite sides of the selector device 404, as shown in FIG. 5. For example, the elbow 430A of a first selector device 404A is shaped and positioned to fit into and mate with the valley 432A of a second selector device 404B, the elbow 430B of the first selector device 404A is shaped and positioned to fit into and mate with the valley 432B of a third selector device 404C, and the elbow 430C of the first selector device 404A is shaped and positioned to fit into and mate with the valley 432C of the third selector device 404C. Similarly, the valley 432A of the first selector device 404A is shaped and positioned to receive and mate with the elbow 430A of the third selector device 404C, the valley 432B of the first selector device 404A is shaped and positioned to receive and mate with the elbow 430B of the second selector device 404B, and the valley 432C of the first selector device 404A is shaped and positioned to receive and mate with the elbow 430C of the second selector device 404B. Alternatively, the selector devices 404 may have other interlocking features, such as pins and holes, tabs and slots, or the like.

The mating of the elbows 430 with the valleys 432 interlocks the selector devices 404 into the larger selector assembly 500 and can help prevent the selector devices 404 from being separated from each other. This also can help keep the arrays of growth openings in different selector devices 404 to remain aligned with each other. For example, a line, row, or column of growth openings 224 in one array 202 in one selector device 404 in the assembly 500 is linearly aligned with a line, row, or column of growth openings 224 in another array 202 of another selector device 404 in the same assembly 500.

The assembly 500 provides for a larger total array of growth openings 224 than a single selector device 404 and/or than a group of fewer selector devices 404 than are present in the assembly 500. The assembly 500 can be increased in size by adding more selector devices 404 or can be reduced in size by removing one or more selector devices 404. The selector devices 404 can be additively manufactured via three-dimensional printing. But, the time needed to additively manufacture a selector device 404 and/or the size in which the selector device 404 can be additively manufactured can be limited. For example, additively manufacturing larger selector devices 404 can take too long and/or the printing system used to additively manufacture selector devices 404 may be restricted in how large of a selector device 404 can be printed. Therefore, the size of the array 202 of growth openings 224 may be limited to smaller sizes than are needed to create a columnar grained structure (e.g., a turbine blade or airfoil). The interlocking features of the selector devices 404 allows for the selector devices 404 to be combined into the larger assembly 500, which can provide a larger array 502 of growth openings 224. The larger array 502 can be used to create larger columnar grained structures than an individual, smaller array 202 of a single selector device 404.

As shown in FIGS. 4 and 5, the selector devices 404 include straight or linear edges 436 that extend from one surface 426 to the opposite surface 428. These edges 436 are located at the outermost intersection of the elbows 430 and at the innermost intersection of the valleys 432. While the mating of the elbows 430 and the valleys 432 between two or more selector devices 404 can prevent one selector device 404 from moving in the growth direction <100> or opposite of the growth direction <100> relative to another selector device 404, the mating of the elbows 430 and valleys 432 may not prevent the selector devices 404 from moving relative to each other in a perpendicular direction. For example, one selector device 404 may be able to move in a transverse direction 438 that is oriented from one surface 426 to the opposite surface 428 relative to another selector device 404. Optionally, the selector devices 404 may not include the linear edges 436 to help prevent this type of movement between the selector devices 404.

Figure 6:
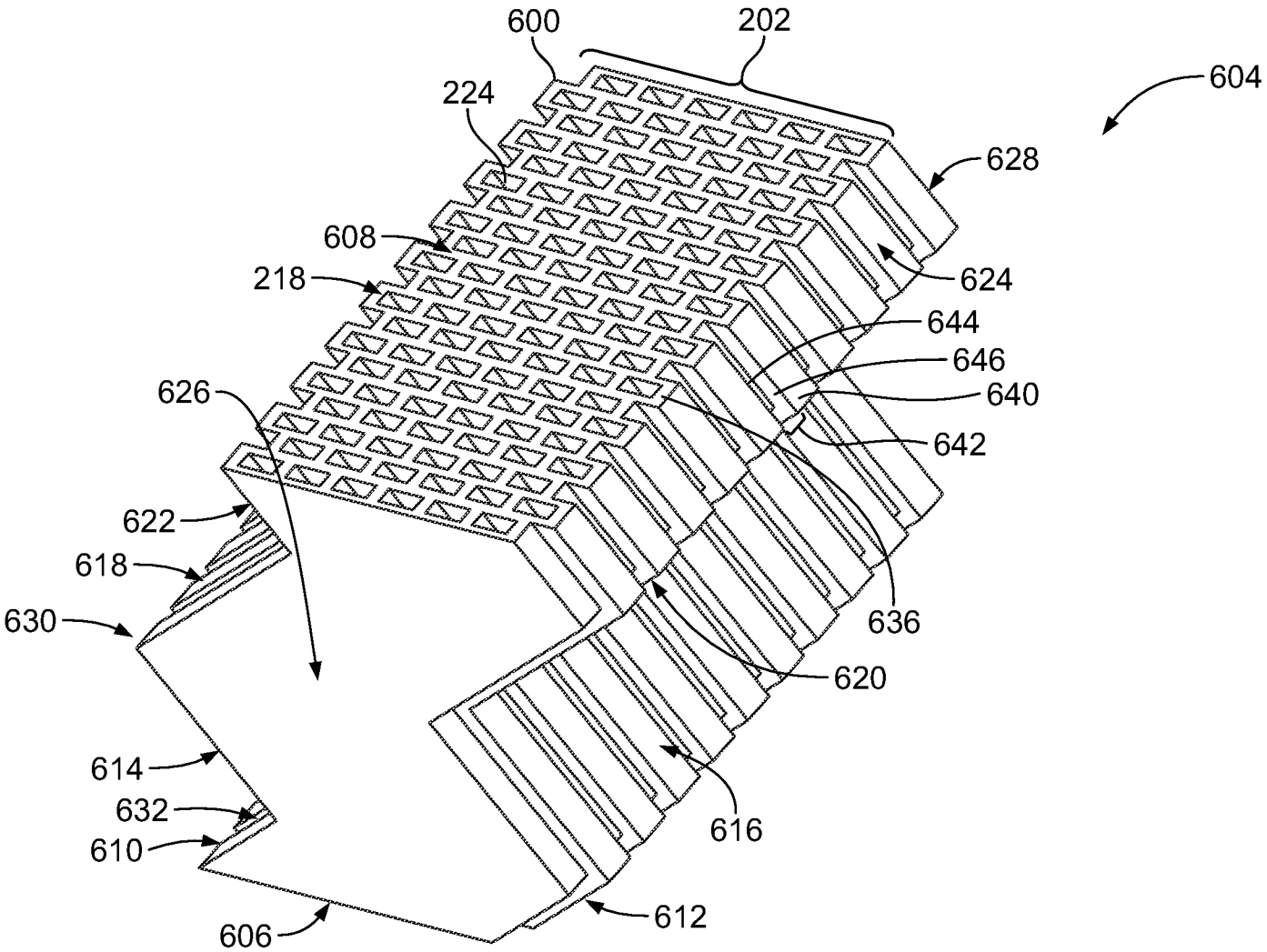
FIG. 6 illustrates a perspective view of another embodiment of a multi-grain selector device.
Figure 7:
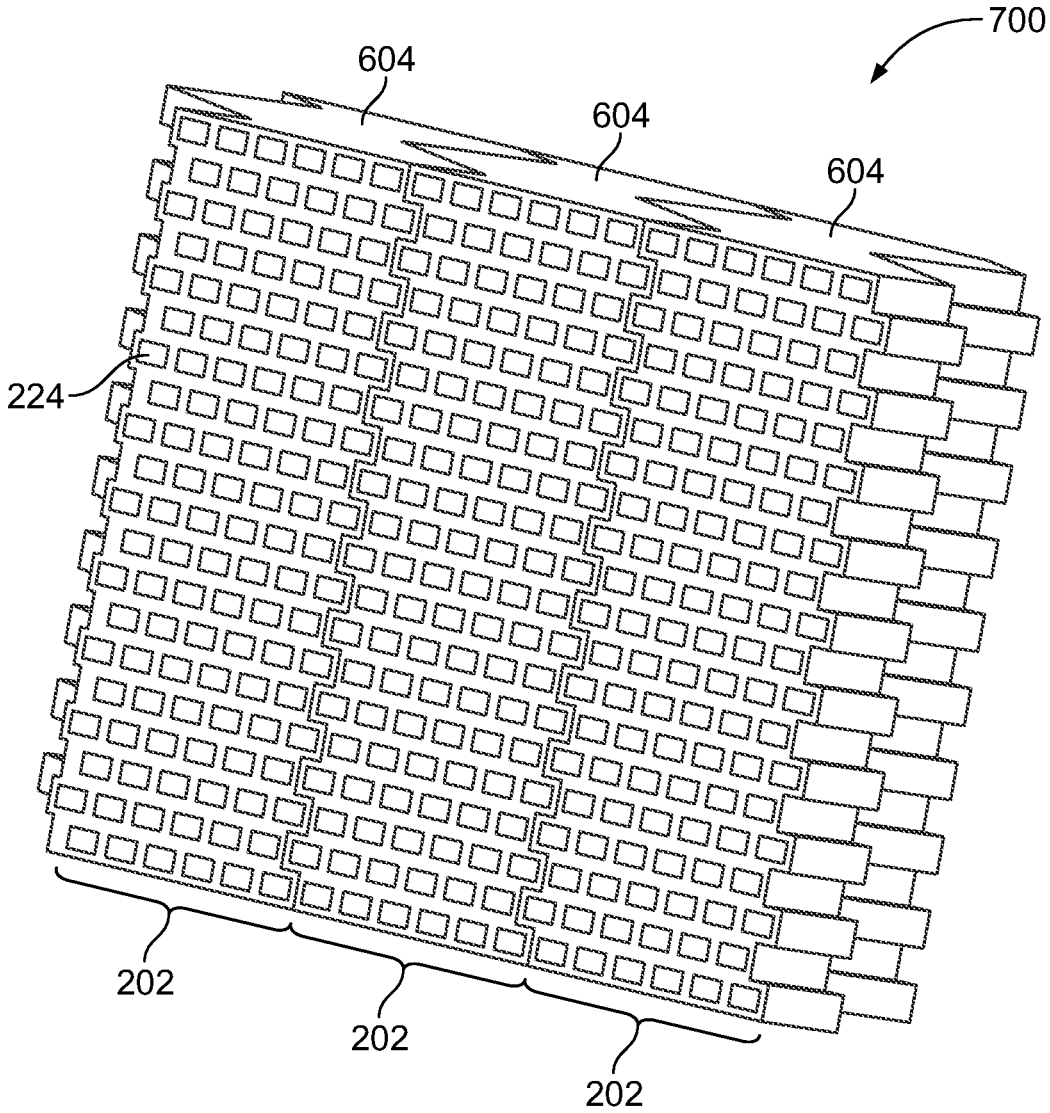
FIG. 7 illustrates a perspective view of a multi-grain selector assembly that is formed from multiple selector devices shown in FIG. 6.

FIG. 6 illustrates a perspective view of another embodiment of a multi-grain selector device 604. FIG. 7 illustrates a perspective view of a multi-grain selector assembly 700 that is formed from multiple selector devices 604 shown in FIG. 6. The selector devices 604 shown in FIGS. 6 and 7 can be referred to as zero dead space selector devices due to the reduced spatial gap between the arrays 202 of growth openings 224 between the different selector devices 604 relative to the selector devices 404 in the assembly 500 shown in FIG. 5.

The selector device 604 can represent the selector device 104 shown in FIG. 1. A single selector device 604 can be used with the mold 102 to form a multi-grain columnar article or structure, or the selector assembly 700 can be used with the mold 102 to form a larger multi-grain columnar article or structure. For example, the larger selector assembly 700 that is formed from multiple selector devices 604 can be used in place of the selector device 104 that is shown in FIG. 1.

The selector device 604 is similar to the selector device 404 in that the selector device 604 includes an outer body 600 having a cooling side 606 and an opposite mold side 608, similar to the sides or surfaces 406, 408. The outer body 600 also includes an end surface 626 and an opposite end surface 628, similar to the surfaces 426, 428. The selector device 604 also includes sides 610, 612, 614, 616, 618, 620, 622, 624 that correspond to and are similar to the surfaces 410, 412, 414, 416, 418, 420, 422, 424 of the selector device 404. The selector device 604 also includes elbows 630 similar to the elbows 430 and mating valleys 632 that are similar to the valleys 432.

One difference between the selector devices 404, 604 is the absence of the surfaces that extend from one surface 626 to the opposite surface 628, and that are flat or planar surfaces from the surface 626 to the surface 628. As shown in FIG. 6, the sides 610, 612, 614, 616, 618, 620, 622, 624 are formed from surfaces such that each side 610, 612, 614, 616, 618, 620, 622, 624 is not a single, continuously planar surface from the surface 626 to the surface 628. Instead, each side 610, 612, 614, 616, 618, 620, 622, 624 is formed from surfaces 640 that are spaced apart from each other by gaps 642. The surfaces 640 are connected with recessed surfaces 644 by outwardly oriented surfaces 646. The surfaces 640, 644 can be parallel to each other, while the surfaces 640, 644 can be perpendicular to the surfaces 646. Alternatively, two or more of the surfaces 640, 644, 646 can be oriented at other angles to each other.

The surfaces 640, 644, 646 form jagged or stepped sides 610, 612, 614, 616, 618, 620, 622, 624 that can engage or mate with jagged or stepped sides 610, 612, 614, 616, 618, 620, 622, 624 of another selector device 604. These surfaces 640, 644, 646 form elongated, protruding rectangular bars and elongated rectangular recesses. The protruding bars of one selector device 604 can be received into the corresponding elongated recesses of another selector device 604, as shown in FIG. 7. For example, the protruding bars and the recesses formed by the surfaces 640, 644, 646 can have complementary shapes such that the bars of one selector device 604 are received into the recesses of another selector device 604 with little to no spatial gap between the selector devices 604. The jagged or stepped sides 610, 612, 614, 616, 618, 620, 622, 624 create broken or non-continuous edges 636. For example, while portions of the edges 636 may be linear (e.g., the portions extending between the surfaces 646 of one step), the entire edge 636 from one surface 626 to the opposite surface 628 is not continuous from one surface 626 to the opposite surface 628 but is interrupted or broken up by the gaps 642.

This can significantly reduce the amount of dead space between the growth openings 218 in the different selector devices 604. For example, as shown in FIG. 5, the selector devices 404 have flat or planar surfaces 410, 412, 414, 416, 418, 420, 422, 424 on the interfacing or mating sides of the selector devices 404. The planar surfaces 410, 412, 414, 416, 418, 420, 422, 424 can interrupt a regular or repeated lateral spacing between the growth openings 224. The growth openings 224 within the array 202 of a single selector device 404 can be laterally spaced apart from each other along transverse directions 504 by the same distance. But, the distance along the transverse directions 504 from the growth openings 224 along one side of the array 202 in one selector device 404 to the closest growth openings 224 along one side of the array 202 in a mating selector device 404 is longer than the distance along the transverse directions 504 from the growth openings 224 along one side of the array 202 in one selector device 604 to the closest growth openings 224 along one side of the array 202 in a mating selector device 604. This can eliminate or reduce the dead space where no growth openings 224 are located between mating selector devices 604. This also enables the spacing along the transverse directions 504 between the growth openings 224 in the mating selector devices 604 to remain constant, while the spacing along the transverse directions 504 between the growth openings 224 in the mating selector devices 404 is not constant, as shown in a comparison of FIGS. 5 and 7.

Additionally, as shown in FIG. 7, the elbows 630 and valleys 632 of the selector devices 604 can mate with each other to form the larger assembly 700, similar to as described above in connection with the selector devices 404 and the assembly 500. The selector device 604 optionally can include support columns similar to the columns 434 shown in FIG. 4.

Figure 8:
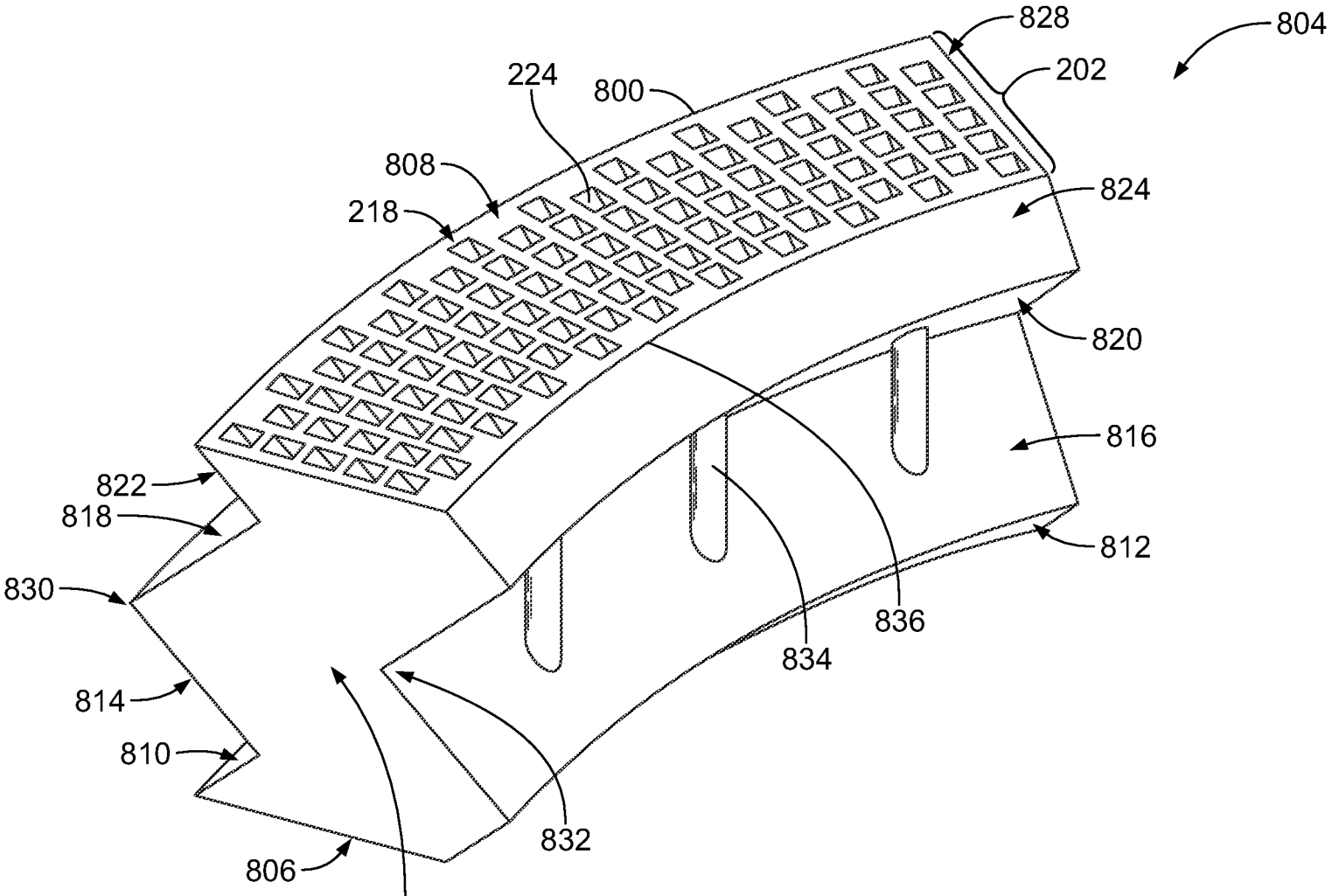
FIG. 8 illustrates a perspective view of another embodiment of a multi-grain selector device.
Figure 9:
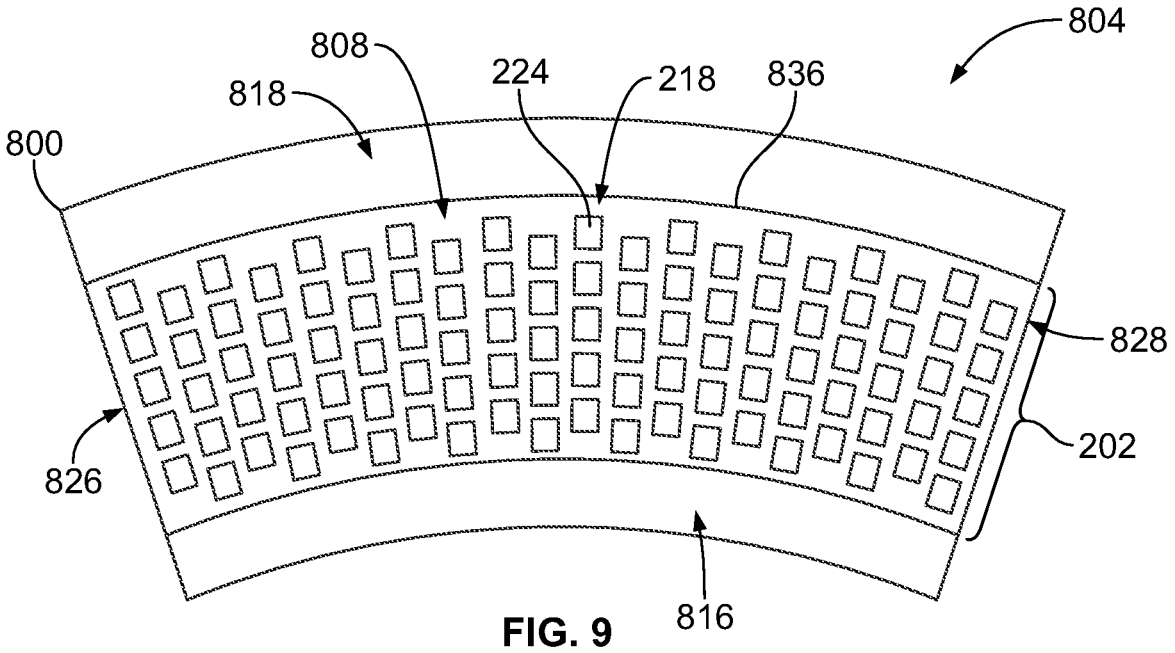
FIG. 9 illustrates a top view of the selector device shown in FIG. 8.

FIG. 8 illustrates a perspective view of another embodiment of a multi-grain selector device 804. FIG. 9 illustrates a top view of the selector device 804 shown in FIG. 8. The selector device 804 can be referred to as a curved selector device 804 due to the curved shape of the selector device 804 relative to the selector devices 404, 604 shown in FIGS. 4 and 6.

The selector device 804 is similar to the selector device 404 in that the selector device 804 includes an outer body 800 having a cooling side 806 and an opposite mold side 808, similar to the sides or surfaces 406, 408. The outer body 800 also includes the end surfaces 426, 428 described above. The selector device 804 includes curved surfaces 810, 812, 814, 816, 818, 820, 822, 824 that correspond to and are similar to the surfaces 410, 412, 414, 416, 418, 420, 422, 424 of the selector device 404. The selector device 804 also includes elbows 830 similar to the elbows 430 and mating valleys 832 that are similar to the valleys 432. The selector device 804 optionally can include support columns 834, similar to the columns 434.

One difference between the selector devices 404, 804 is the curved shape of the surfaces 806, 808, 810, 812, 814, 816, 818, 820, 822, 824. While the surfaces 406, 408, 410, 412, 414, 416, 418, 420, 422, 424 of the selector device 404 are planar (or flat) and not curved, the surfaces 806, 808, 810, 812, 814, 816, 818, 820, 822, 824 have one or more radii of curvature. The surfaces 806, 808, 810, 812, 814, 816, 818, 820, 822, 824 that intersect each other form non-linear (e.g., curved) edges 836 on opposite sides of the array 202 of growth openings 224 in the body 800, as shown in FIG. 8.

The elbows 830 and valleys 832 of multiple selector devices 804 can mate with each other to form a larger curved multi-grain selector assembly, similar to as described above in connection with the selector devices 404, 604 and the assemblies 500, 700. The curved selector device 804 and/or curved assembly can be used to form multi-grain columnar articles having a curved shape. For example, the selector devices 804 can orient the grains that are grown in the channels 218 of the selector devices 804 into at least part of a curved airfoil shape. This can provide an advantage of aligning the stiffness of the formed grains with the geometry of the turbine blade.

Figure 10:
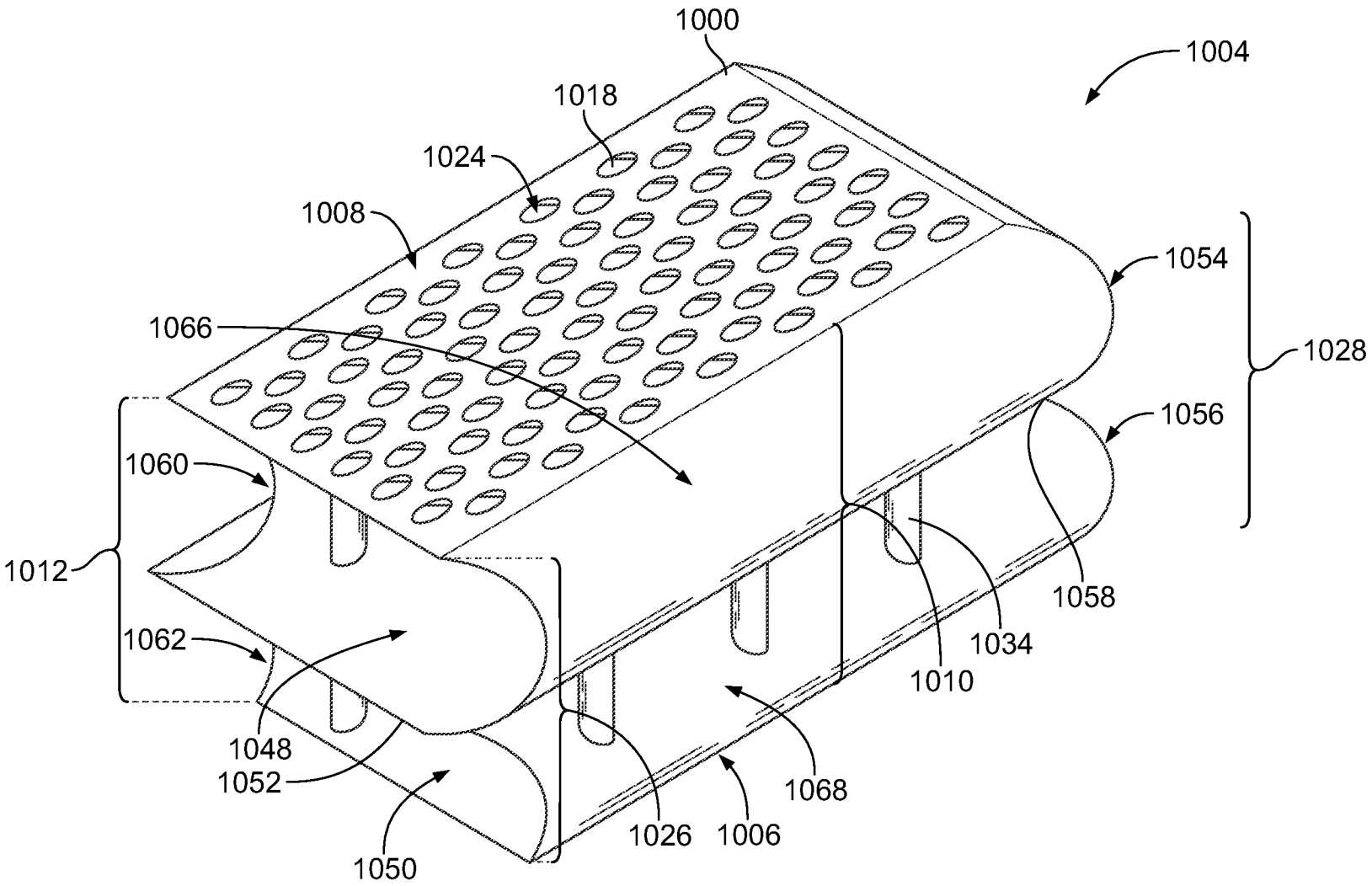
FIG. 10 illustrates a perspective view of another embodiment of a multi-grain selector device.
Figure 11:
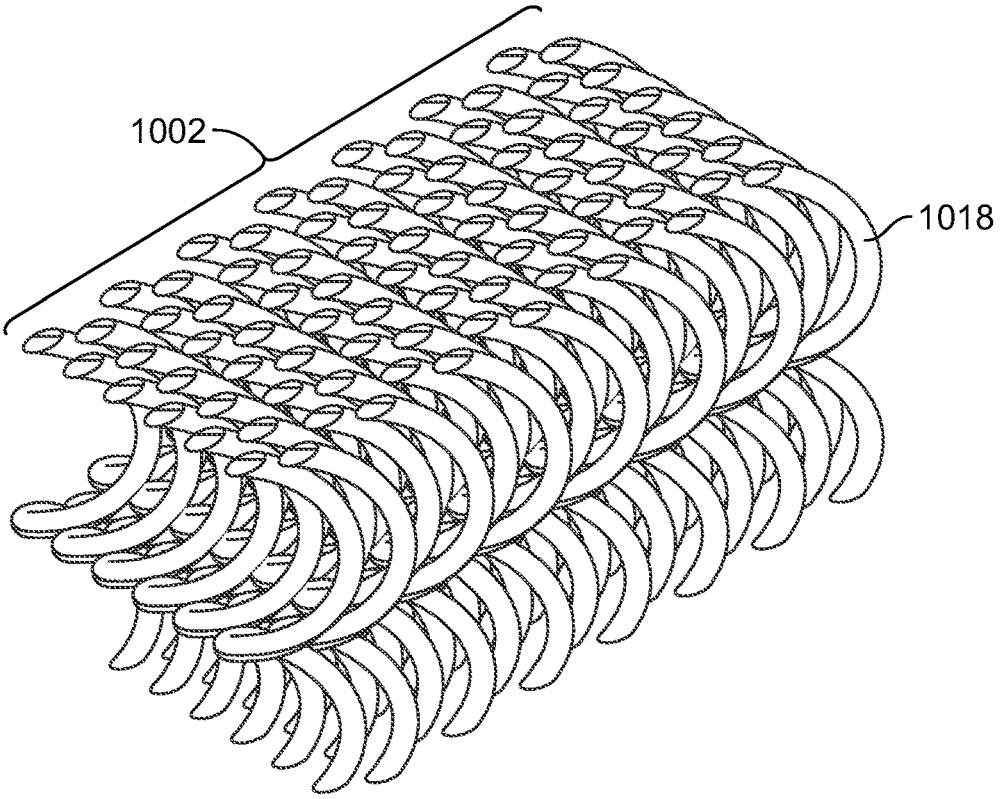
FIG. 11 illustrates a perspective view of an array of grain selector columns of the multi-grain selector device shown in FIG. 10.
Figure 12:
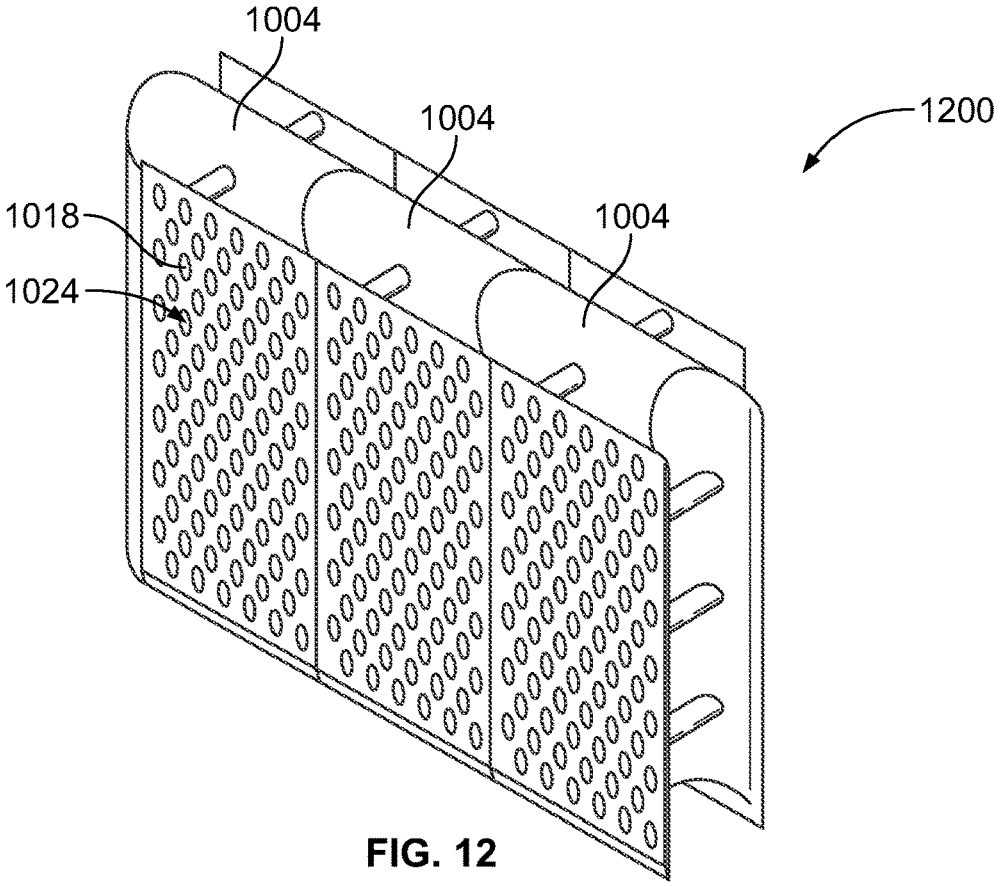
FIG. 12 illustrates a perspective view of a multi-grain selector assembly that is formed from multiple selector devices shown in FIG. 10.

FIG. 10 illustrates a perspective view of another embodiment of a multi-grain selector device 1004. FIG. 11 illustrates a perspective view of an array 1002 of grain selector columns 1124 of the multi-grain selector device 1004 shown in FIG. 10. FIG. 12 illustrates a perspective view of a multi-grain selector assembly 1200 that is formed from multiple selector devices 1004 shown in FIG. 10. The selector devices 1004 shown in FIGS. 10 and 12 can be referred to as helical selector devices due to the helical shapes of the growth columns 1124 in the selector device 1004.

The selector device 1004 can represent the selector device 104 shown in FIG. 1. A single selector device 1004 can be used with the mold 102 to form a multi-grain columnar article or structure, or the selector assembly 1200 can be used with the mold 102 to form a larger multi-grain columnar article or structure. For example, the larger selector assembly 1200 that is formed from multiple selector devices 1004 can be used in place of the selector device 104 that is shown in FIG. 1.

The selector device 1004 is similar to the selector device 404 in that the selector device 1004 includes an outer body 1000 having a cooling side 1006 and an opposite mold side 1008, similar to the sides or surfaces 406, 408. In contrast to the selector device 404, the body 1000 of the selector device 1004 includes a curved end surface 1026 and an opposite curved surface 1028. The curved end surface 1026 can have two concave curved sections 1048, 1050 that intersect at and are separated by a ridge 1052. Each curved end surface 1028 can have two convex curved sections 1054, 1056 that intersect at and are separated by a valley 1058. The concave curved sections 1048, 1050 and the convex curved sections 1054, 1056 may have complementary shapes. For example, the convex curved sections 1054, 1056 may have the same or similar (e.g., within 5%) radii of curvature as the concave curved sections 1048, 1050 such that the convex curved sections 1054, 1056 fit within and mate with the concave curved sections 1048, 1050 (e.g., of another selector device 1004).

The body 1000 of the selector device 1004 also has curved side surfaces 1010, 1012 on opposite sides of the body 1000. Each of the side surfaces 1010, 1012 extends from the end surface 1026 to the opposite end surface 1028 and each of the end surfaces 1026, 1028 extends from the side surface 1010 to the opposite side surface 1012 in the illustrated embodiment. The curved side surface 1012 can have two concave curved sections 1060, 1062 that intersect at and are separated by the ridge 1052. Each curved side surface 1010 can have two convex curved sections 1066, 1068 that intersect at and are separated by the valley 1058. The concave curved sections 1060, 1062 and the convex curved sections 1066, 1068 may have complementary shapes. For example, the convex curved sections 1066, 1068 may have the same or similar (e.g., within 5%) radii of curvature as the concave curved sections 1060, 1062 such that the convex curved sections 1066, 1068 fit within and mate with the concave curved sections 1060, 1062 (e.g., of another selector device 1004). Optionally, one or more of the side and/or end surfaces 1010, 1012, 1026, 1028 can include support columns 1034, similar to the support columns 434 described above.

The selector device 1004 also includes an array 1002 of growth channels 1018 and corresponding growth openings 1024. Similar to the growth channels 218 shown in FIG. 2, a single crystal grain of a metal or metal alloy can grow in each of the growth channels 1018 and out of the selector device 1004 through the corresponding growth opening 1024. One difference between the selector device 1004 and the other selector devices described herein is the shape of the growth channels 218, 1018. The growth channels 218 can have zig-zag or linear shapes, as described above. The growth channels 1018 have helical shapes, as shown in FIG. 11. Each of the growth channels 1018 may helically wrap around a different axis or direction that is parallel to the growth direction <100> in which the grains grow, as described above.

The side surfaces 1010, 1012 of selector devices 1004 can mate with corresponding side surfaces 1012, 1010 of other selector devices 1004 to form the larger assembly 1200, as shown in FIG. 12. Optionally, the end surfaces 1026, 1028 of the selector devices 1004 can mate with corresponding end surfaces 1028, 1026 of other selector devices 1004 to form a larger multi-grain selector assembly. Mating the side surfaces 1010, 1012 of the selector devices 1004 with each other increases the size of the multi-grain selector assembly 1200 along one direction, while mating the end surfaces 1026, 1026 of the selector devices 1004 with each other increases the size of the multi-grain selector assembly along a transverse (e.g., perpendicular) direction.

The geometries of the selector devices and assemblies shown and/or described herein are provided merely as some examples of the inventive subject matter. The dimensions of the devices and assemblies (e.g., the array, size, spacing, angle, and number of the growth columns) can be adjusted based on the processing conditions for forming the multi-grained columnar article. For example, the effectiveness of the selector device and/or assembly could be improved by reducing the spacing of the growth openings to be less than the primary dendrite arm spacing (which can be dependent on cooling conditions). The growth opening of each column can be angled relative to the mold surface to allow for a smooth transition between adjacent grains.

The selector devices described herein can be constructed of a high temperature ceramic, such as alumina, silica, mullite, or another material. The selector devices can be fabricated using direct ceramic additive slurry processes or other additive manufacturing processes. These ceramic slurry processes can have the spatial resolution and surface finish needed for fine scaled versions of the designs (e.g., to have growth openings and/or widths of the growth columns on the order of one half millimeter in width). The selector devices can be interlocked with each other before firing the green ceramic to form the selector assemblies. For larger dimensions, other direct ceramic processes such as binder jets could be used. Alternatively, polymer additive processes could be used to manufacture the selector devices and/or assemblies. For example, a polymer additive process could be used to create a polymer die that, after filling with ceramic slurry and firing, would form the shape of the selector device or assembly. Optionally, the selector devices and/or assemblies can be created by modifying a ceramic process such as the slurry die extrusion process used in the fabrication of ceramic catalytic converter substrates. For example, instead of extruding a straight through-hole structure, the extruded ceramic could be offset at regular intervals to create the angled through-hole structures of the growth columns.

Figure 13:
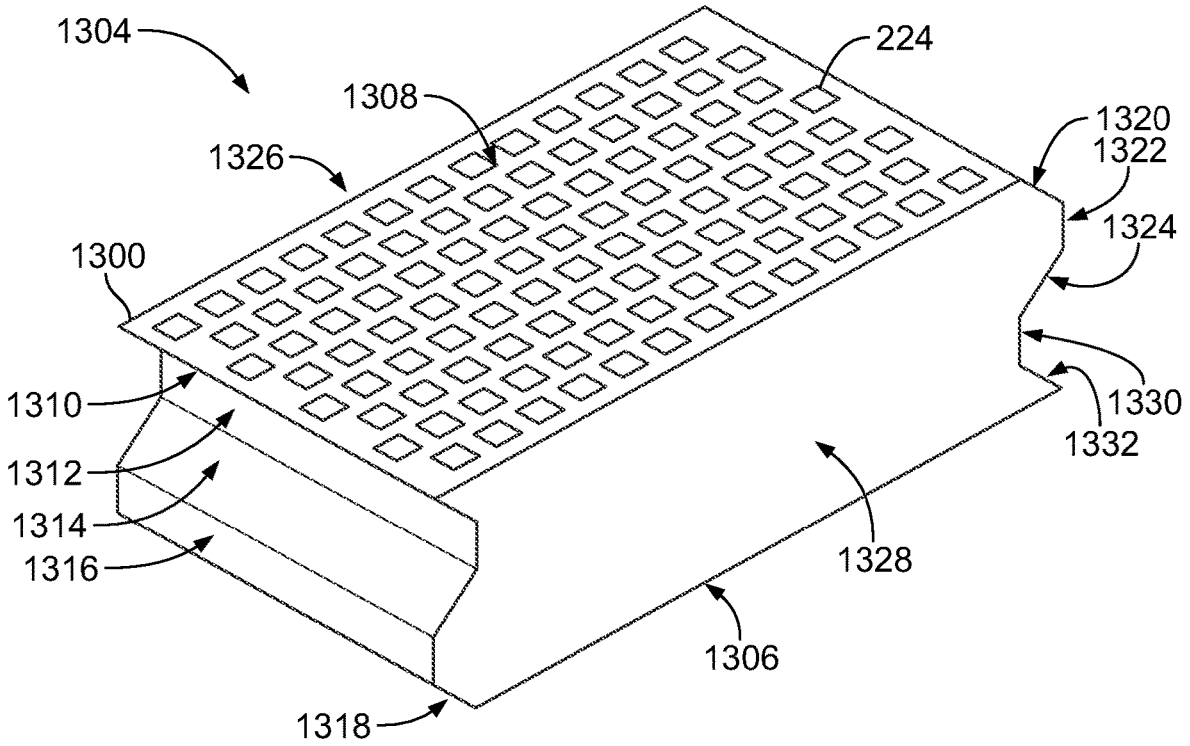
FIG. 13 illustrates a perspective view of another embodiment of a multi-grain selector device.
Figure 14:
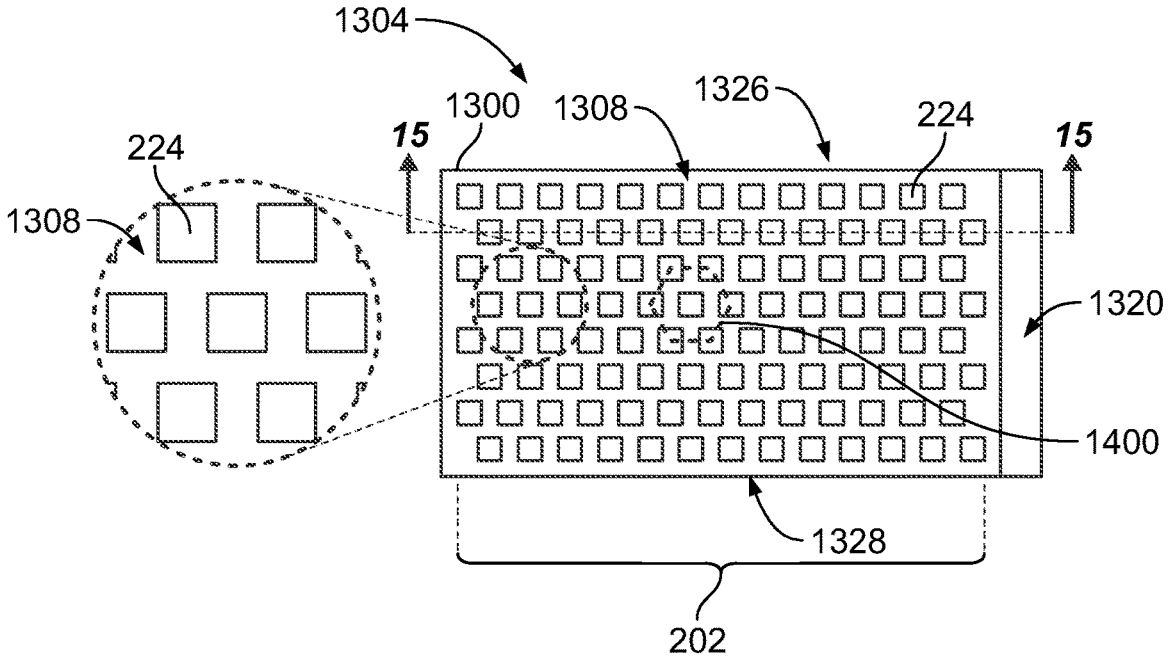
FIG. 14 illustrates a top view of the multi-grain selector device shown in FIG. 13.
Figure 15:
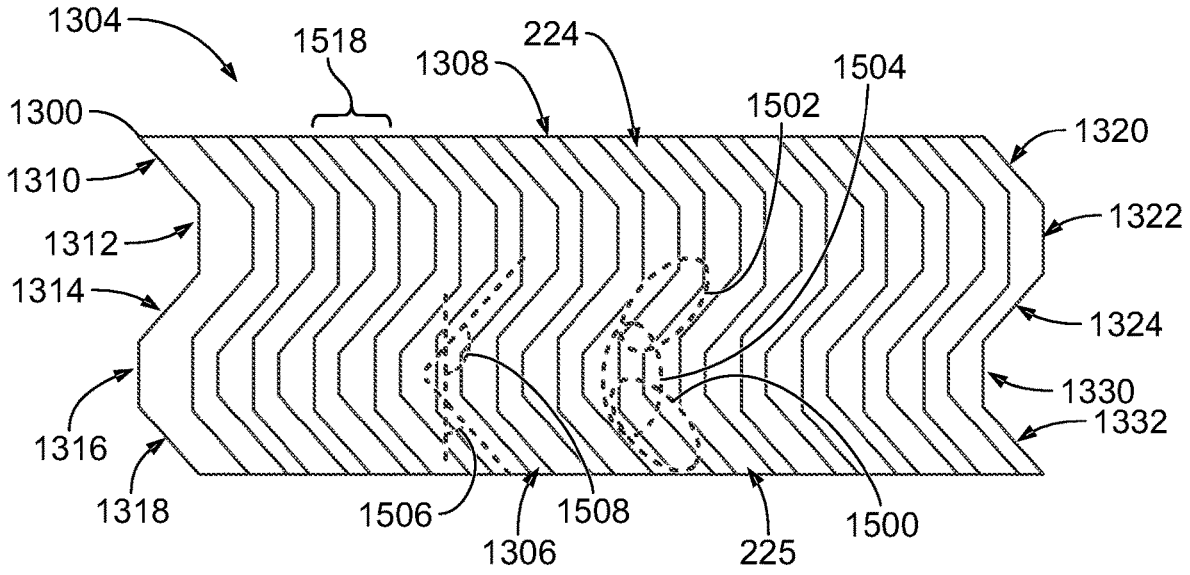
FIG. 15 illustrates a cross-sectional view of the multi-grain selector device shown in FIG. 13.

FIG. 13 illustrates a perspective view of a multi-grain selector device 1304. FIG. 14 illustrates a top view of the selector device 1304 shown in FIG. 13. FIG. 15 illustrates a cross-sectional view of the selector device 1304 along line 15-15 shown in FIG. 14. The selector device 1304 can represent the selector device 104 shown in FIG. 1. A single selector device 1304 can be used with the mold 102 to form a multi-grain columnar article or structure, or a larger selector assembly formed from several selector devices 1304 placed adjacent to each other can be used with the mold 102 to form a larger multi-grain columnar article or structure. For example, such a larger selector assembly that is formed from multiple selector devices 1304 can be used in place of the selector device 104 that is shown in FIG. 1.

The selector device 1304 includes an outer body 1300 that defines exterior surfaces 1306, 1308, 1310, 1312, 1314, 1316, 1318, 1320, 1322, 1324, 1326, 1328, 1330, 1332 of the selector device 1304. The exterior surface 1306 can be the cooling side described above, and the opposite surface 1308 can be the mold or growth side described above. The surfaces 1326, 1328 can be opposite side surfaces of the body 1300 and can be oriented parallel to each other. The remaining surfaces 1310, 1312, 1314, 1316, 1318, 1320, 1322, 1324, 1330, 1332 are located between and interconnect the side surfaces 1326, 1328 with each other and are located between and interconnect the surfaces 1306, 1308 with each other. The surfaces 1310, 1312, 1314, 1316, 1318 are located between and extend between the side surfaces 1326, 1328 and the surfaces 1310, 1312, 1314, 1316, 1318 are located between the cooling and growth surfaces 1306, 1308. The surfaces 1320, 1322, 1324, 1330, 1332 are located between and extend between the side surfaces 1326, 1328 and the surfaces 1310, 1312, 1314, 1316, 1318 are located between the cooling and growth surfaces 1306, 1308. Optionally, a greater or lesser number of surfaces 1310, 1312, 1314, 1316, 1318, 1320, 1324, 1328, 1330, 1332 may be located between the surfaces 1306, 1308 and/or between the surfaces 1326, 1328.

In the illustrated embodiment, the surfaces 1306, 1308 are parallel to each other and the surfaces 1326, 1328 are parallel to each other. The surfaces 1310, 1320 can be parallel to each other, the surfaces 1312, 1316, 1322, 1330 can be parallel to each other, the surfaces 1314, 1324 can be parallel to each other, and/or the surfaces 1318, 1332 can be parallel to each other. Optionally, one or more of these surfaces may not be parallel to the other surface described above.

The body 1300 includes the array 202 of grain selector columns 1518 (shown in FIG. 15) described above. As shown in FIG. 15, each column 1518 has an opening 224 on the growth side 1308 and an opening 225 on the cooling side 1306 such that the column 1518 forms a non-linear conduit through the body 1300. The grains 108, 109 (shown in FIG. 1) formed by the selector device 1304 grow out of the growth openings 224 of the selector columns 1518. As described above, the openings 224 are arranged in a regular, repeating hexagonal pattern defined by the centers of the openings 224 forming several overlapping hexagonal shapes 1400. In contrast to the selector columns 218 described above and shown in FIG. 3, each of the selector columns 1518 includes channels 1500, 1502, 1504 (shown in FIG. 15) that are elongated along three different directions. While the channels 300, 302 of the columns 218 described above form a zig-zag shape due to the channels 300, 302 being oriented along two directions, the columns 1518 form S-shapes due to the channels 1500, 1502, 1504 being elongated in three different directions. For example, the channels 1500 are oriented at an acute angle 1506 to the channels 1504 and the channels 1502 are oriented at an obtuse angle 1508 to the channels 1504 (in a counter-clockwise direction from the elongation direction of the channels 1504. Alternatively, the columns 1518 can have fewer channels 1500, 1502, 1504 and/or can have a different shape (e.g., can be linear or angled in a single direction). As described above in connection with the selector device 404, the surfaces 1310, 1312, 1314, 1316, 1318, 1320, 1322, 1324, 1330, 1332 can mate with corresponding surfaces of another selector device 1304 to form a larger selector assembly.

Such an assembly provides for a larger total array of growth openings 224 than a single selector device 1304 and/or than a group of fewer selector devices 1304 than are present in the assembly. The assembly can be increased in size by adding more selector devices 1304 or can be reduced in size by removing one or more selector devices 1304. The selector devices 1304 can be additively manufactured via three-dimensional printing. But, the time needed to additively manufacture a selector device 1304 and/or the size in which the selector device 1304 can be additively manufactured can be limited. For example, additively manufacturing larger selector devices 404 can take too long and/or the printing system used to additively manufacture selector devices 1304 may be restricted in how large of a selector device 1304 can be printed. Therefore, the size of the array 202 of growth openings 224 may be limited to smaller sizes than are needed to create a columnar grained structure (e.g., a turbine blade or airfoil). The mating surfaces of the selector devices 1304 allow for the selector devices 1304 to be combined into the larger assembly, which can provide a larger array of growth openings 224. The larger array can be used to create larger columnar grained structures than an individual, smaller array of a single selector device 1304.

Figure 16:
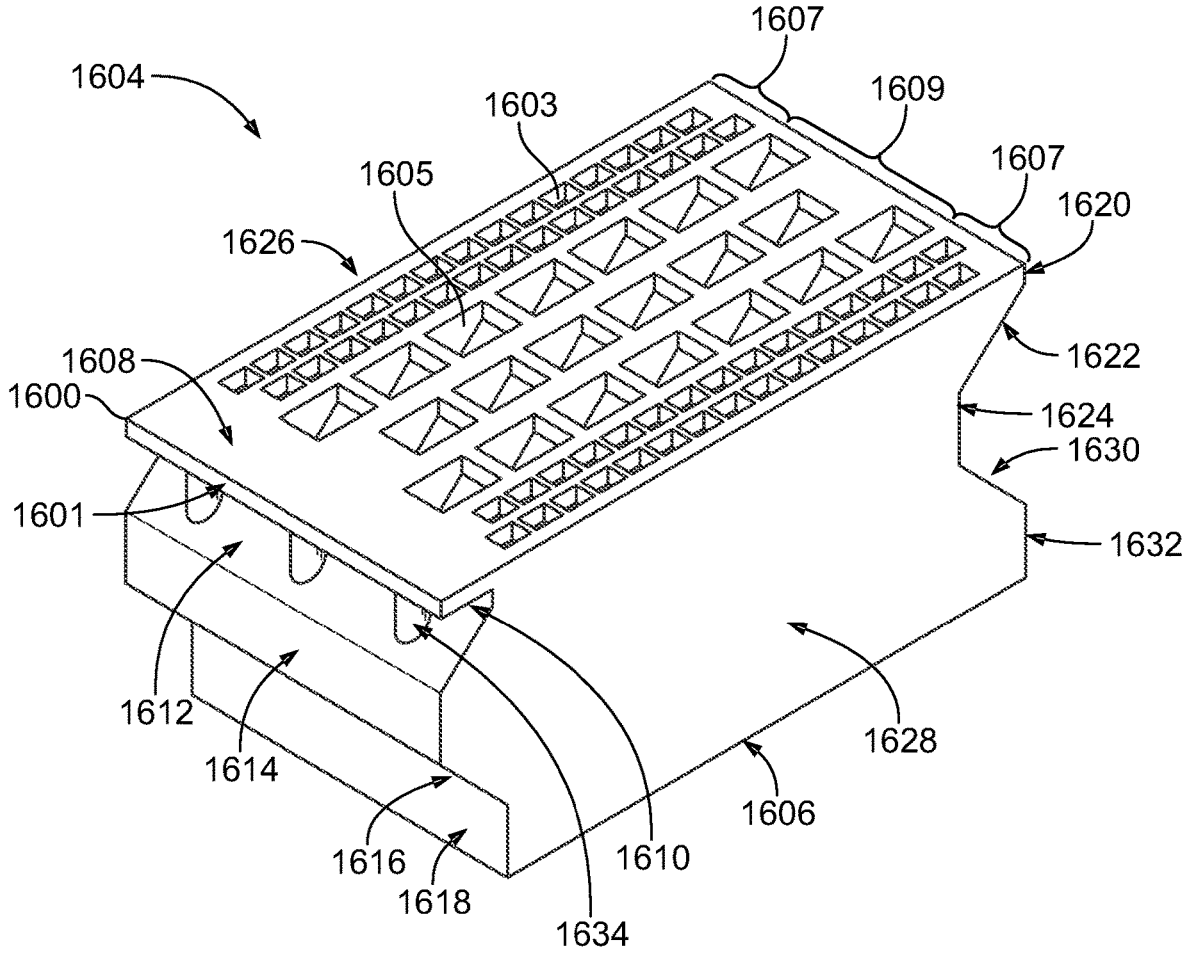
FIG. 16 illustrates a perspective view of another embodiment of a multi-grain selector device.
Figure 17:
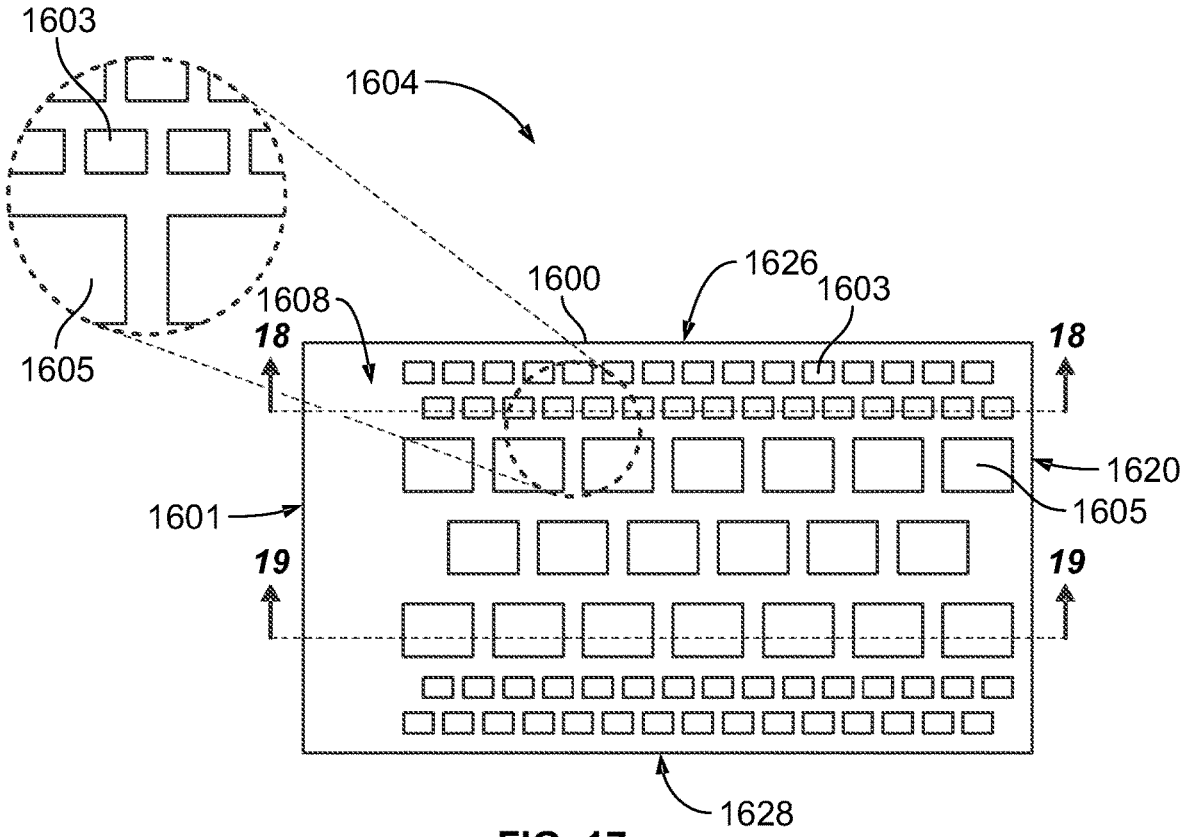
FIG. 17 illustrates a top view of the multi-grain selector device shown in FIG. 16.
Figure 18:
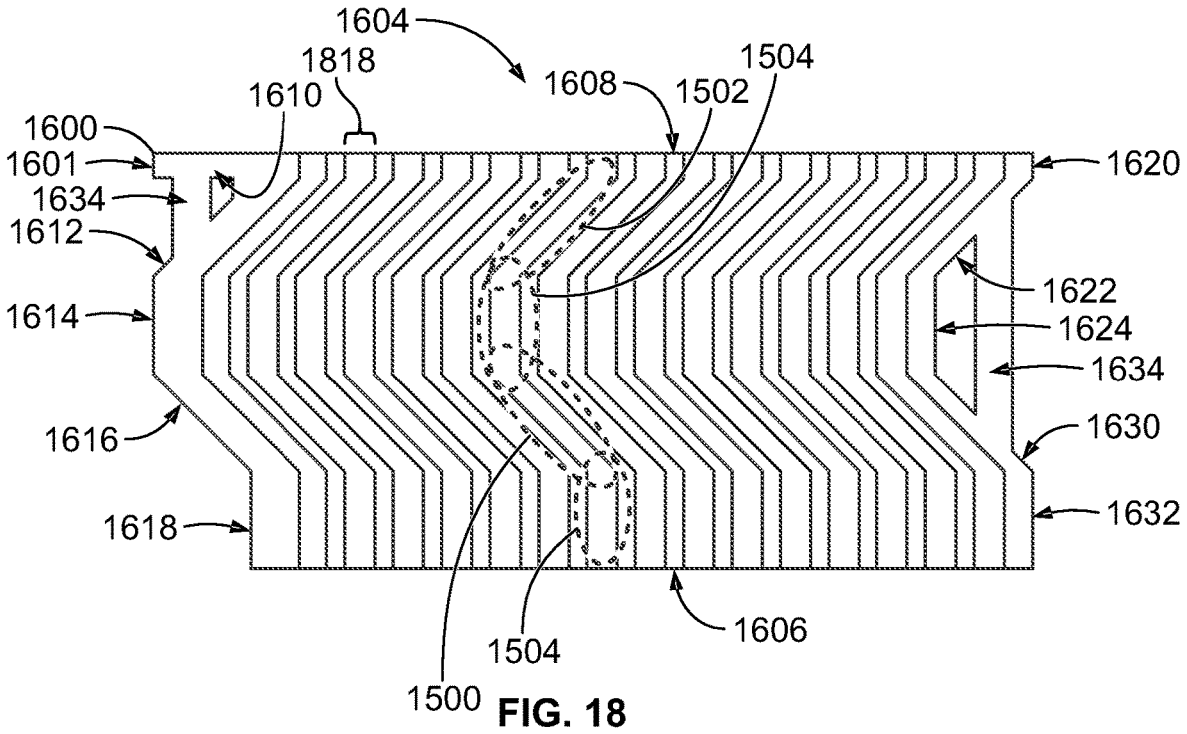
FIG. 18 illustrates a cross-sectional view of the multi-grain selector device shown in FIG. 16.
Figure 19:
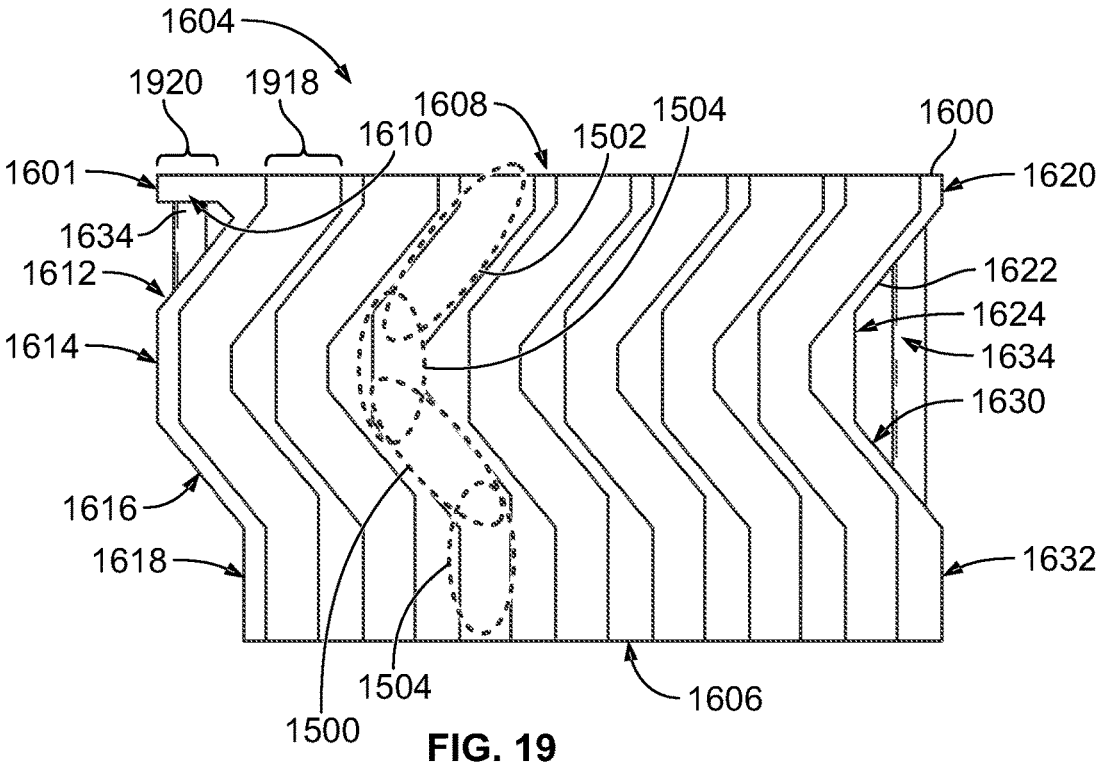
FIG. 19 illustrates an additional cross-sectional view of the multi-grain selector device shown in FIG. 16.

FIG. 16 illustrates a perspective view of a multi-grain selector device 1604. FIG. 17 illustrates a top view of the selector device 1604 shown in FIG. 16. FIG. 18 illustrates a first cross-sectional view of the selector device 1604 along line 18-18 shown in FIG. 17. FIG. 19 illustrates a second cross-sectional view of the selector device 1604 along line 19-19 shown in FIG. 17. The selector device 1604 can represent the selector device 104 shown in FIG. 1. A single selector device 1604 can be used with the mold 102 to form a multi-grain columnar article or structure, or a larger selector assembly formed from several selector devices 1604 placed adjacent to each other can be used with the mold 102 to form a larger multi-grain columnar article or structure. For example, such a larger selector assembly that is formed from multiple selector devices 1604 can be used in place of the selector device 104 that is shown in FIG. 1.

The selector device 1604 includes an outer body 1600 that defines exterior surfaces 1606, 1608, 1610, 1612, 1614, 1616, 1618, 1620, 1622, 1624, 1626, 1628, 1630, 1632 of the selector device 1604. The exterior surface 1606 can be the cooling side described above, and the opposite surface 1608 can be the mold or growth side described above. The surfaces 1626, 1628 can be opposite side surfaces of the body 1600 and can be oriented parallel to each other. The remaining surfaces 1610, 1612, 1614, 1616, 1618, 1620, 1622, 1624, 1630, 1632 are located between and interconnect the side surfaces 1626, 1628 with each other and are located between and interconnect the surfaces 1606, 1608 with each other. The surfaces 1610, 1612, 1614, 1616, 1618 are located between and extend between the side surfaces 1626, 1628 and the surfaces 1610, 1612, 1614, 1616, 1618 are located between the cooling and growth surfaces 1606, 1608. The surfaces 1620, 1622, 1624, 1630, 1632 are located between and extend between the side surfaces 1626, 1628 and the surfaces 1610, 1612, 1614, 1616, 1618 are located between the cooling and growth surfaces 1606, 1608. Optionally, a greater or lesser number of surfaces 1610, 1612, 1614, 1616, 1618, 1620, 1624, 1628, 1630, 1632 may be located between the surfaces 1606, 1608 and/or between the surfaces 1626, 1628.

In the illustrated embodiment, the surfaces 1606, 1608 are parallel to each other and the surfaces 1626, 1628 are parallel to each other. The surfaces 1601, 1614, 1618, 1620, 1624, 1632 can be parallel to each other, the surfaces 1612, 1622 can be parallel to each other, and/or the surfaces 1616, 1630 can be parallel to each other. Optionally, one or more of these surfaces may not be parallel to the other surface described above.

In contrast to other selector devices, the body 1600 of the selector device 1604 includes multiple arrays 1607, 1609 of grain selector columns 1818, 1918 (shown in FIGS. 18 and 19). Each of the columns 1818, 1918 has a growth opening on the growth side 1608 of the body 1600 and an opposite opening on the cooling side 1606 of the body 1600 such that each column 1818, 1918 forms a non-linear conduit through the height of the body 1600. As shown in FIGS. 18 and 19, the columns 1818 are smaller than the columns 1918. The cross-sectional area of each of the columns 1818 is smaller than the cross-sectional area of each of the columns 1918. These cross-sectional areas of the columns 1818, 1918 can be measured in cross-sectional planes that are parallel to the sides 1606, 1608. Additionally, the size of each growth opening 1603 of each of the columns 1818 at each of the sides 1606, 1608 is smaller than the size of each growth opening 1605 of each of the columns 1918 at each of the sides 1606, 1608. The different sized columns 1818, 1918 create the different arrays 1607, 1609 of the growth openings 1603, 1605 of the columns 1818, 1918 at the growth side 1608. The arrays 1607 have smaller growth openings 1603 than the growth openings 1605 of the array 1609 in the embodiment shown in FIG. 17. While there are two arrays 1607 of the smaller growth openings 1603 of the columns 1818 and a single array 1609 of the larger growth openings 1605 of the columns 1918, alternatively, there may be more arrays 1609 of the larger growth openings 1605, more arrays 1607 of the smaller growth openings 1603, a single array 1607 of the smaller growth openings 1702, or another combination of the arrays 1607, 1609.

Having different sized columns 1818, 1918 and growth openings 1603, 1605 in the same selector device 1604 can create different sized columns of grains in the object being cast in the mold 102. The location of the larger or smaller grains can be controlled by the locations and/or arrangements of the arrays 1607, 1609 in the selector device 1604. The location of the different-sized grains can be controlled or set to provide different structural stiffness in different areas or volumes of the object being cast.

The columns 1818, 1918 are formed from a combination of the channels 1500, 1502, 1504. The channels 1504 are elongated in linear directions that extend from the cooling side 1606 to the growth side 1608. The channels 1500, 1502 are oriented at angles with respect to the channel 1504, as described above. As shown in FIG. 18, a combination of the channels 1500, 1502, 1502 forms a flattened U-shape that is connected with another linear channel 1504 in each column 1818. The channels 1504 can be referred to as perpendicular channels as these channels 1504 are elongated in directions that are perpendicular to the sides 1606, 1608. The channels 1502 can be referred to as angled channels as these channels 1502 are elongated in directions that are angled to (i.e., not perpendicular or parallel to) the sides 1606, 1608. While the sizes of the channels 1500, 1502, 1504 forming the columns 1818, 1918 may differ from the sizes of the channels 1500, 1502, 1504 shown in FIG. 15, the channels 1500, 1502, 1504 of the columns 1818, 1918 can be angled relative to each other as shown in FIG. 15.

In one embodiment, a projecting portion 1920 of the body 1600 that extends to the surface 1601 can be connected with the surface 1612 by one or more support columns 1634 during additive manufacturing of the body 1600. The surface 1622 optionally can be connected with the surface 1630 by one or more support columns 1634 during additive manufacturing of the body 1600. The projecting portion 1920 and/or the support columns 1634 can be removed prior to use of the selector device 1604. This can allow for multiple selector devices 1604 to mate with each other to form a larger selector assembly, as described above. For example, the surfaces 1612, 1614, 1616, 1618 can mate with or otherwise engage the corresponding surfaces 1622, 1624, 1630, 1632 to form a larger assembly. Such an assembly provides for a larger total array of growth openings 1603, 1605 than a single selector device 1604 and/or than a group of fewer selector devices 1604 than are present in the assembly.

Figure 20:
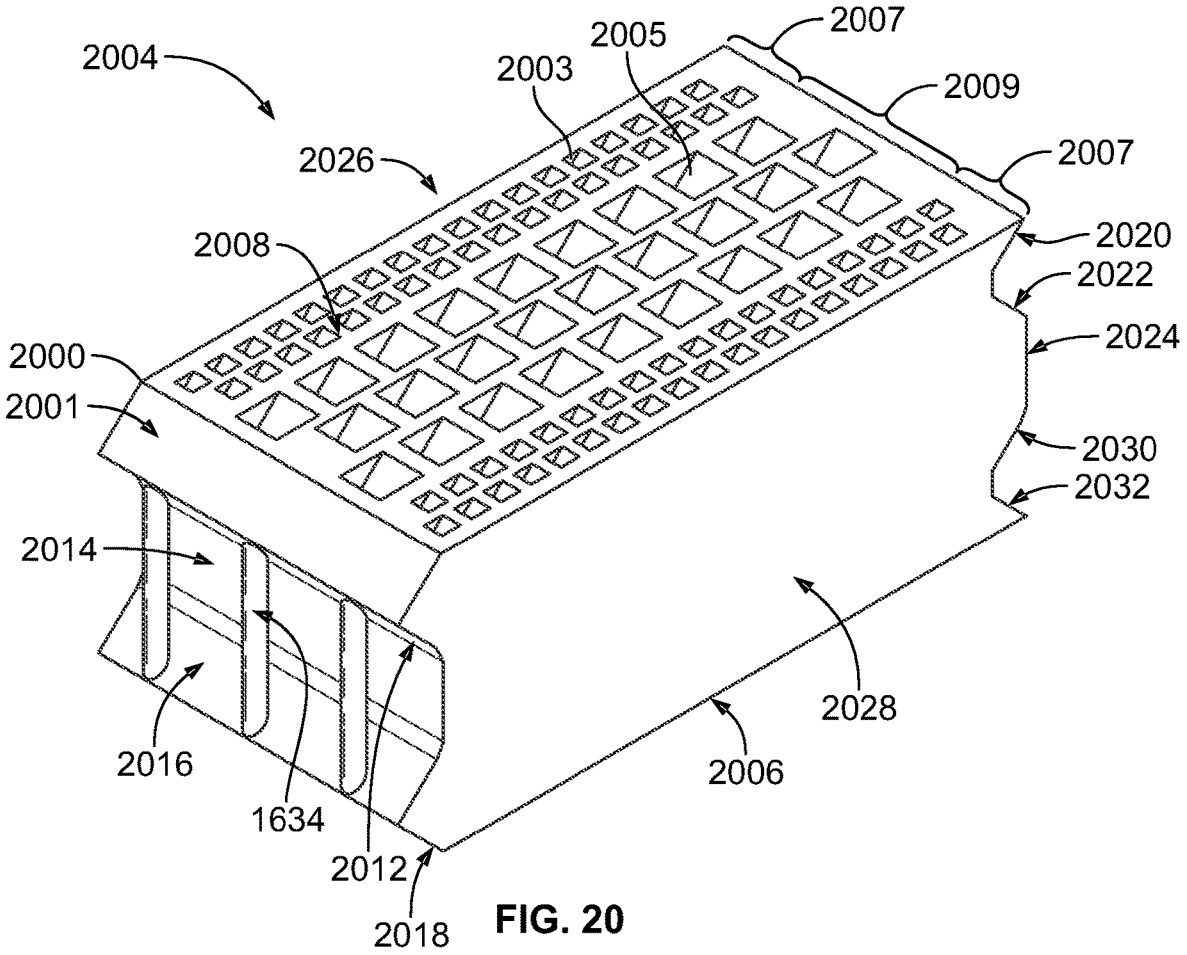
FIG. 20 illustrates a perspective view of another embodiment of a multi-grain selector device.
Figure 21:
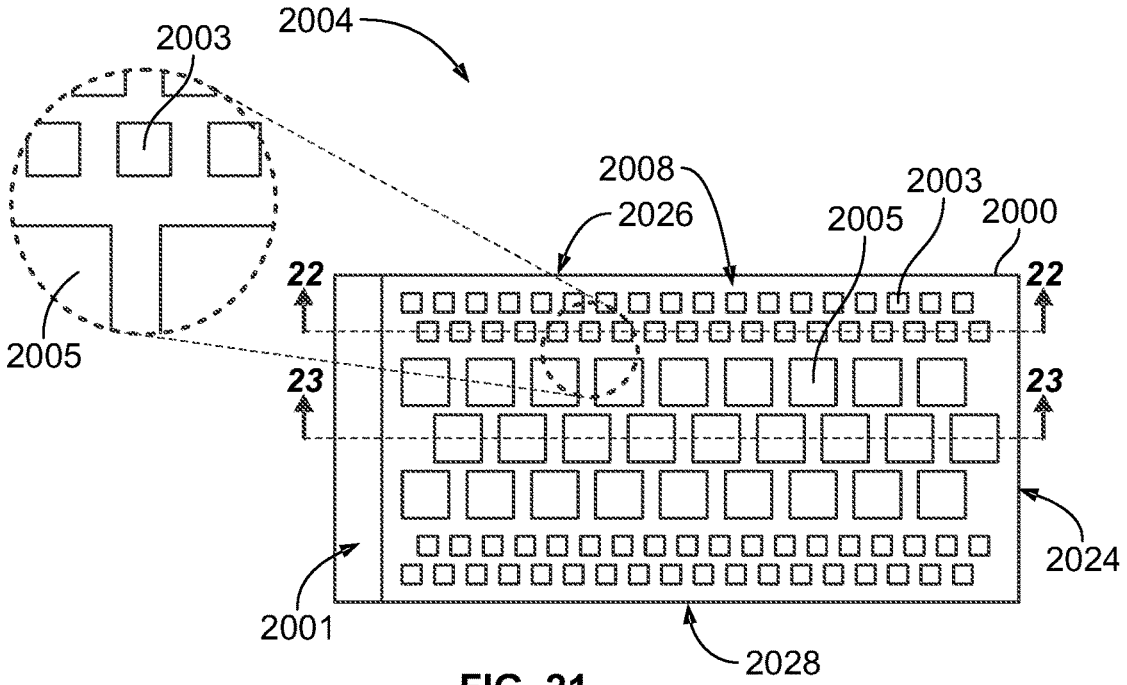
FIG. 21 illustrates a top view of the multi-grain selector device shown in FIG. 20.
Figure 22:
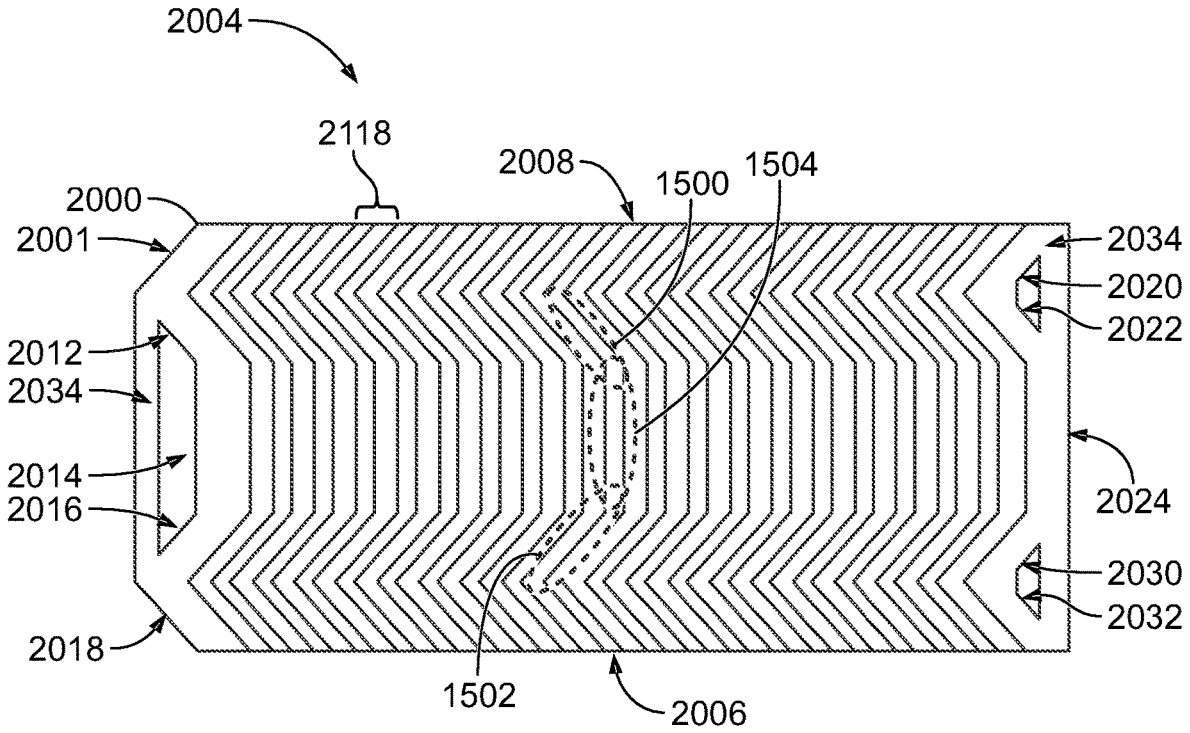
FIG. 22 illustrates a cross-sectional view of the multi-grain selector device shown in FIG. 20.
Figure 23:
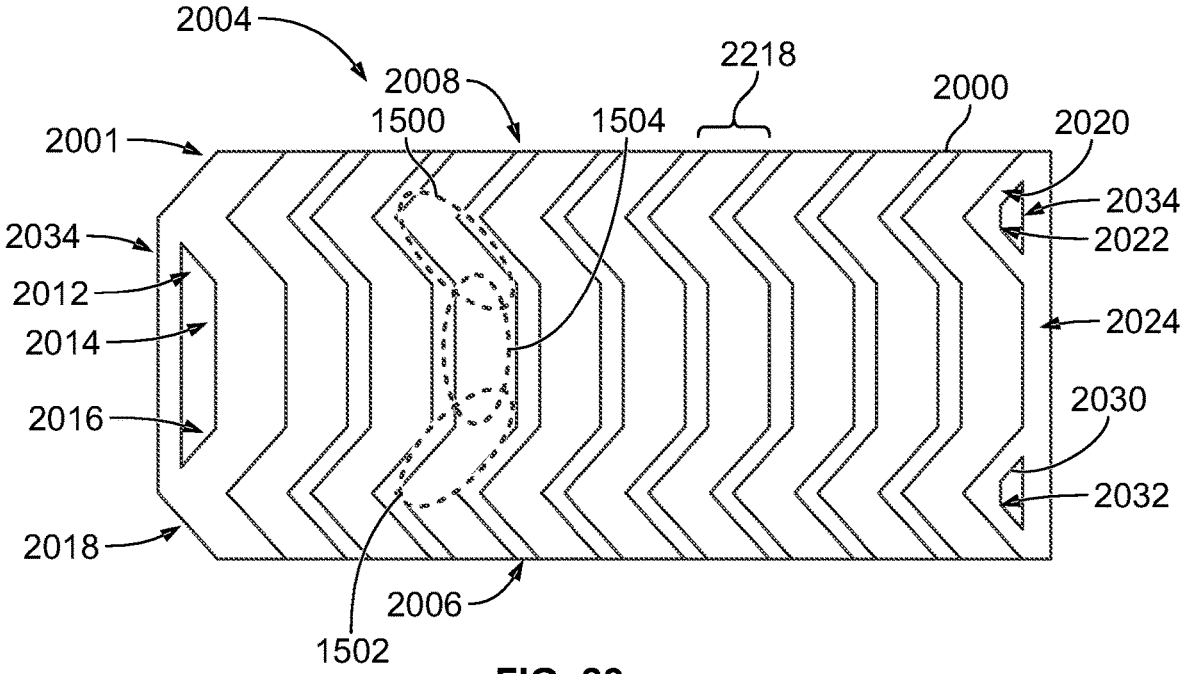
FIG. 23 illustrates an additional cross-sectional view of the multi-grain selector device shown in FIG. 20.

FIG. 20 illustrates a perspective view of a multi-grain selector device 2004. FIG. 21 illustrates a top view of the selector device 2004 shown in FIG. 20. FIG. 22 illustrates a first cross-sectional view of the selector device 2004 along line 22-22 shown in FIG. 21. FIG. 23 illustrates a second cross-sectional view of the selector device 2004 along line 23-23 shown in FIG. 21. The selector device 2004 can represent the selector device 104 shown in FIG. 1. A single selector device 2004 can be used with the mold 102 to form a multi-grain columnar article or structure, or a larger selector assembly formed from several selector devices 2004 placed adjacent to each other can be used with the mold 102, as described above.

The selector device 2004 includes an outer body 2000 that defines exterior surfaces including a cooling side or surface 2006, a growth side or surface 2008, a planar and lateral side or surface 2026, and an opposite planar and lateral side or surface 2028. The body 2000 also defines a first set of surfaces 2001, 2012, 2014, 2016, 2018 that extend from the lateral side 2026 to the lateral side 2028 and that are located between the growth side 2008 and the cooling side 2006. The body 2000 also defines a second opposite set of surfaces 2020, 2022, 2024, 2030, 2032 that extend from the lateral side 2026 to the lateral side 2028 and that are located between the growth side 2008 and the cooling side 2006.

Support columns 1634 can extend from the surface 2012 to the surface 2016, from the surface 2020 to the surface 2022, and from the surface 2030, 2032. These columns 2034 can be removed after additive manufacturing of the body 2000 is complete. With the columns 2034 removed, the surfaces 2001, 2012 form an elbow that can be received into a valley formed by the surfaces 2020, 2022 and the surfaces 2016, 2018 form another elbow can be received into another valley formed by the surfaces 2030, 2032 to form a larger assembly from multiple selector devices 2004, as described herein.

The columns 2118, 2218 are formed from the combination of the channels 1500, 1502, 1504 that are elongated in different directions to form an S-shape, as described above. While the sizes of the channels 1500, 1502, 1504 forming the columns 2118, 2218 may differ from the sizes of the channels 1500, 1502, 1504 shown in other Figures, the channels 1500, 1502, 1504 of the columns 2118, 2218 can be angled relative to each other as shown in FIG. 15.

The body 2000 of the selector device 2004 includes multiple arrays 2007, 2009 of grain selector columns 2118, 2218 (shown in FIGS. 21 and 22). Each of the columns 2118, 2218 has a growth opening 2003 or 2005 on the growth side 2008 of the body 2000 and an opposite opening on the cooling side 2006 of the body 2000 such that each column 2118, 2218 forms a non-linear conduit through the height of the body 2000. As shown in FIGS. 21 and 22, the columns 2118 are smaller than the columns 2218, similar to as described above in connection with the columns 1818, 1918. The different sized columns 2118, 2218 create different arrays 2007, 2009 of the growth openings 2003, 2005 of the columns 2118, 2218 at the growth side 2008. The arrays 2007 have smaller growth openings 2003 than the growth openings 2005 of the array 2009, similar to as described above in connection with the arrays 1607, 1609. The number and/or arrangement of the arrays 2007, 2009 may differ from what is shown in FIGS. 20 through 22.

Figure 24:
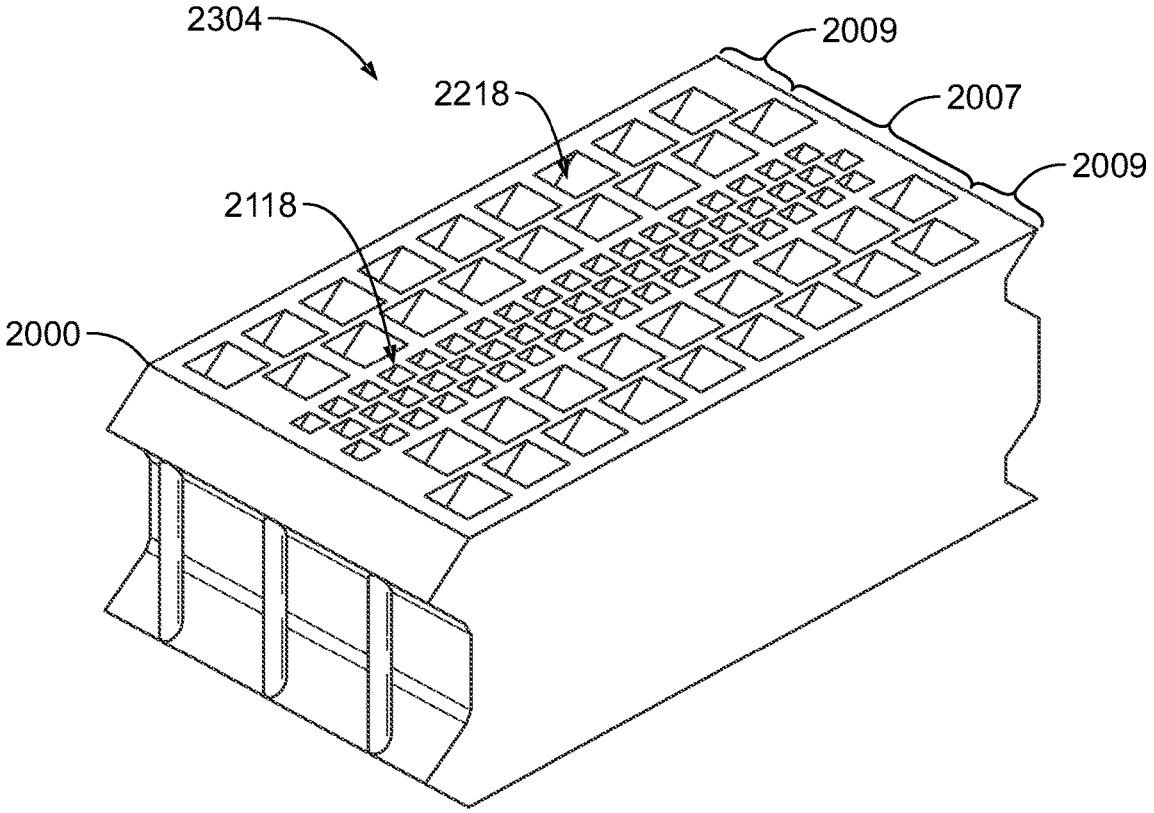
FIG. 24 illustrates a perspective view of another embodiment of a multi-grain selector device.

For example, FIG. 24 illustrates a perspective view of another grain selector device 2304. The selector device 2304 may be identical or similar to the selector device 2004 shown in FIGS. 20 through 23 except for the inclusion of two arrays 2009 of the larger channels 2218 and a single array 2007 of the smaller channels 2118. The selector device 2004 includes the arrays 2007 of smaller channels 2118 on opposite sides of the array 2009 of larger channels 2218. Conversely, the selector device 2304 includes arrays 2009 of the larger channels 2218 on opposite sides of the array 2007 of the smaller channels 2118.

Figure 25:
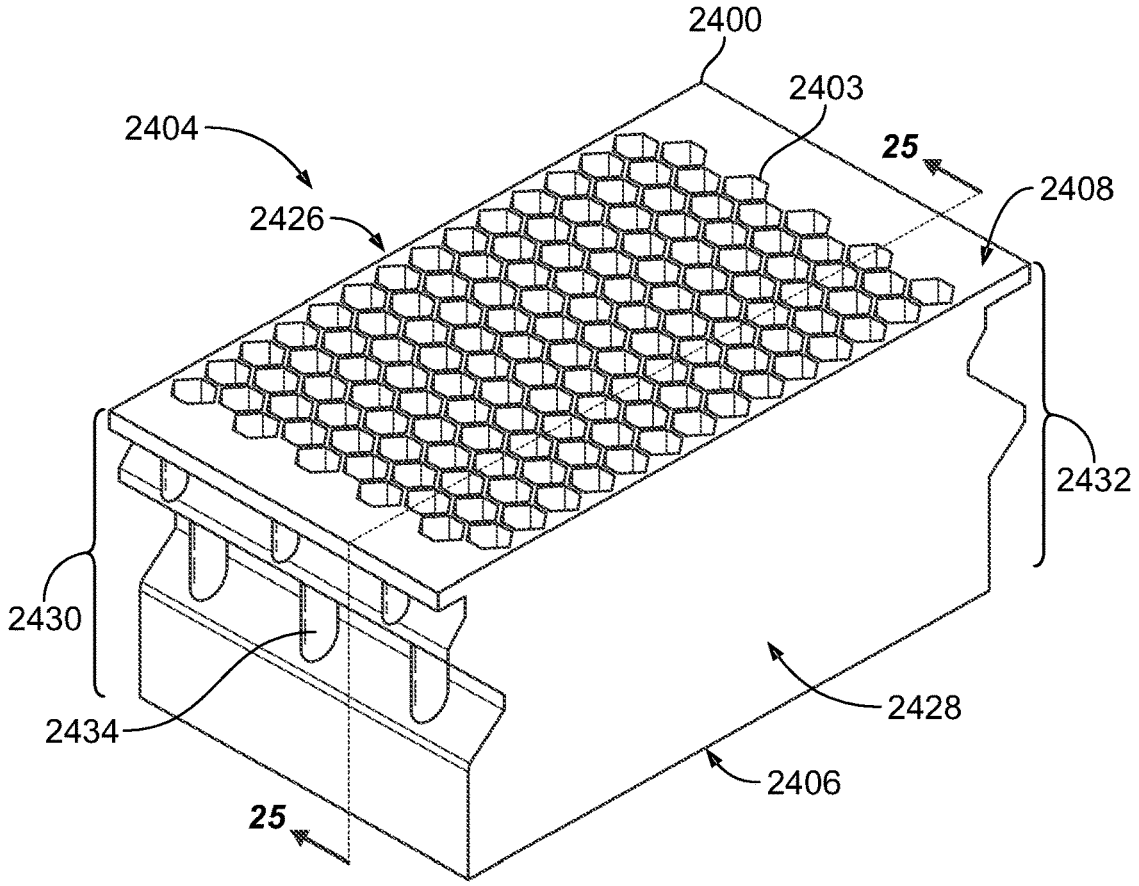
FIG. 25 illustrates a perspective view of another embodiment of a multi-grain selector device.
Figure 26:
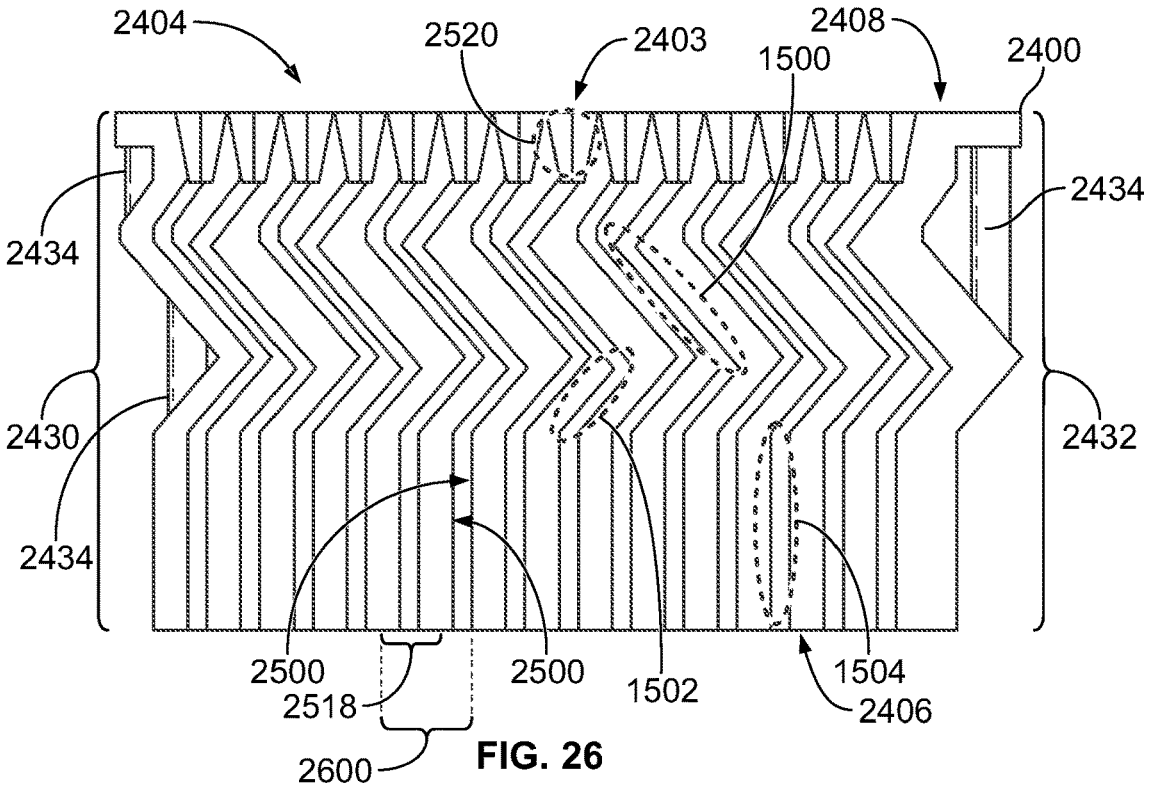
FIG. 26 illustrates a cross-sectional view of the multi-grain selector device shown in FIG. 25.
Figure 27:
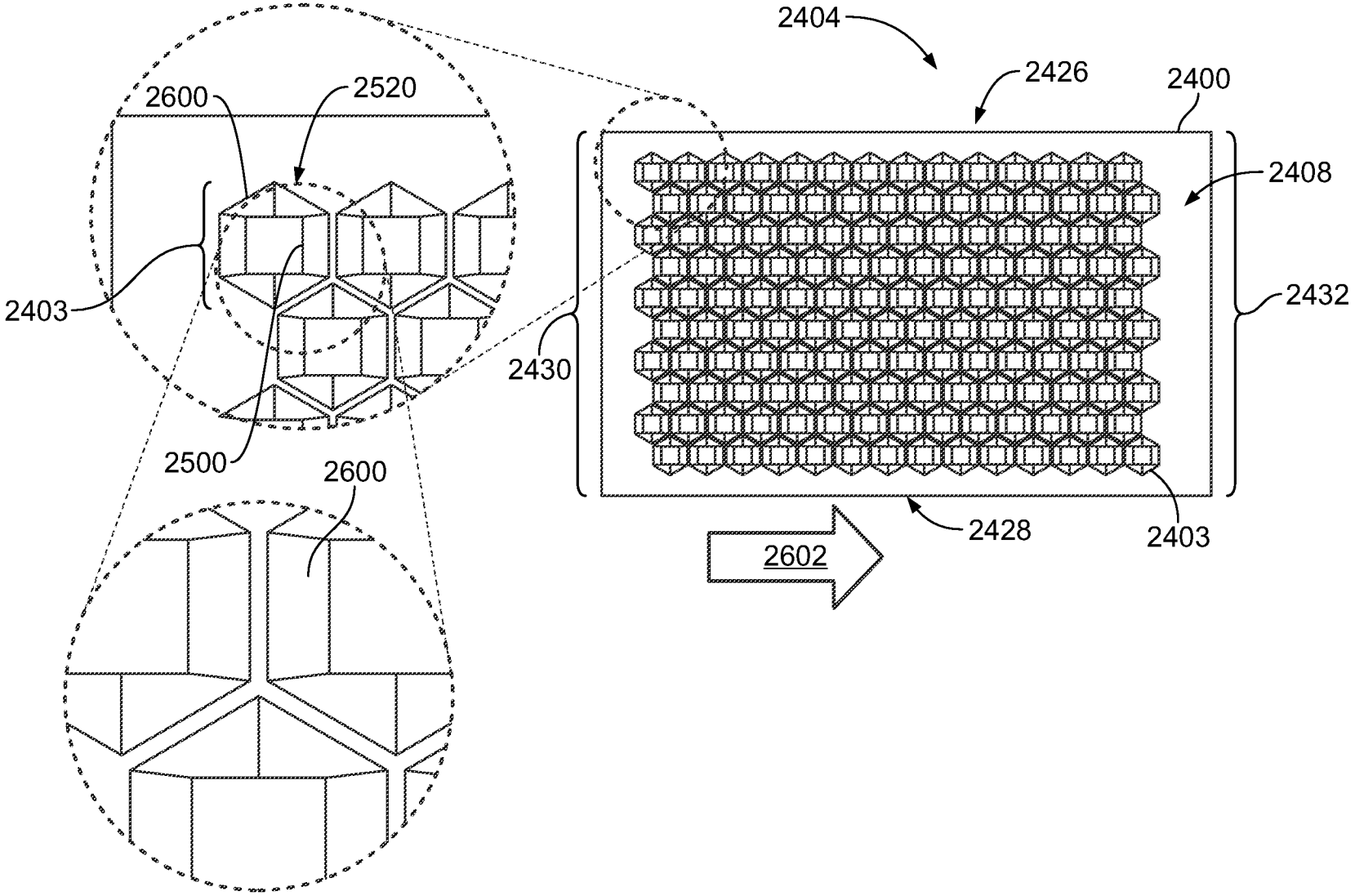
FIG. 27 illustrates a top view of the multi-grain selector device shown in FIG. 25.

FIG. 25 illustrates another grain selector device 2404. FIG. 26 illustrates a cross-sectional view of the selector device 2404 along line 26-26 shown in FIG. 25. FIG. 27 illustrates a top view of the selector device 2404 shown in FIGS. 24 and 25. The selector device 2404 includes a body 2400 having growth and cooling sides 2408, 2406, opposite lateral sides 2426, 2428, and opposite sets 2430, 2432 of surfaces that extend from one lateral side 2426 to the other lateral side 2428 and that are located between the cooling and growth sides 2406, 2408.

The body 2400 also includes an array of growth channels 2403 fluidly coupled with columns 2518. The columns 2518 are formed from the perpendicular channels 1504 and the angled channels 1500, 1502. As shown in FIG. 26, each of the columns 2518 is formed by a perpendicular channel 1504 extending upward from the cooling side 2408 to the angled channel 1502, which extends to the angled channel 1500, which extends to another angled channel 1502, which extends to a port 2520 at the growth side 2406.

The port 2520 is a channel having angled internal sidewalls 2600, as shown in FIG. 27. The channels 1500, 1502, 1504 have internal sidewalls 2500 that oppose each other and that are parallel to each other (for the same channel). These sidewalls 2500 of a channel 1500, 1502, 1504 also are parallel to the directions in which the corresponding channel 1500, 1502, 1504 is elongated. The internal sidewalls 2600 of each port 2520, however, are not parallel to each other inside the same port 2520. Instead, the internal sidewalls 2600 are angled outward such that the area of a growth opening 2403 of each port 2520 is larger than the area of the intersection between the port 2520 and the channel 1502. For example, the opening 2403 of the port 2520 along the growth side 2408 is larger than size of the port 2520 at the location where the port 2520 intersects or meets up with the channel 1520. This provides the port 2520 with a flared shape. In the illustrated embodiment, the growth opening 2403 of the port 2520 has a hexagonal shape in contrast to the square shapes of the growth openings described above.

This flared shape of the ports 2520 can cause the grains growing out of each column 2518 to expand out of the growth openings 2403 and merge with neighboring grains in the object being cast. Additionally, in the illustrated embodiment, neighboring columns 2518 can be closer to each other. This can help the grains growing out of the ports 2520 in each pair 2600 of columns 2518 to merge with each other out of the selector device 2404.

Figure 28:
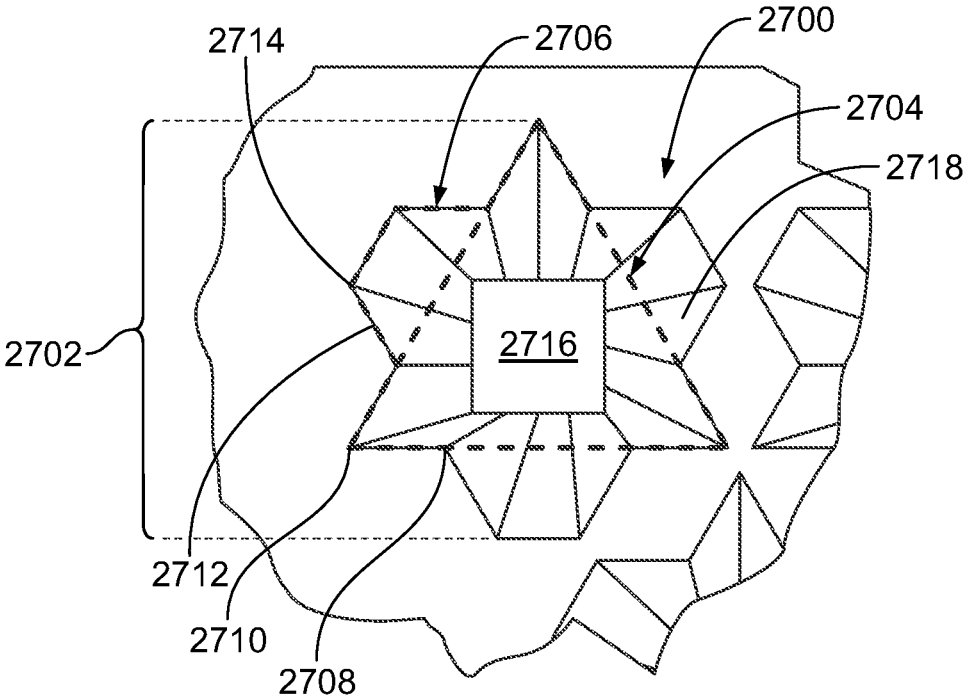
FIG. 28 illustrates one example of a growth opening of a multi-grain selector device.
Figure 29:
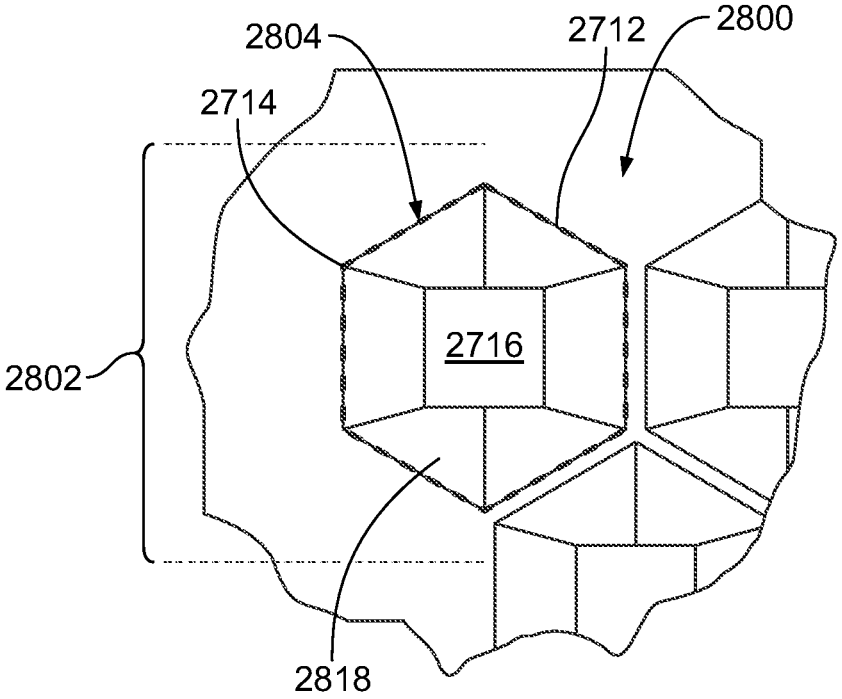
FIG. 29 illustrates another example of a growth opening of a multi-grain selector device.

FIGS. 28 and 30 through 33 illustrate additional examples of differently shaped ports and growth openings that can be used in the selector devices shown and/or described herein. FIG. 29 illustrates the ports and growth openings shown in FIG. 27. FIG. 28 illustrates a double tri-cross growth opening 2700 and corresponding port 2702. The double tri-cross growth opening 2700 forms the shape of a triangle 2704 combined with three half-hexagon shapes 2706 projecting from each linear leg 2708 of the triangle 2704. Each half-hexagon shape 2706 outwardly projects from a different leg 2708 of the triangle 2704 that is located between corners 2710 of the triangle 2704 that are connected by that leg 2708. Each half-hexagon shape 2706 includes three legs 2712 that connect two corners 2714 of the half-hexagon shape 2706. Two of the legs 2712 of each half-hexagon shape 2706 outwardly extend from the same leg 2708 of the triangle 2704 to different corners 2714 of the half-hexagon shape 2706. Those corners 2714 of the half-hexagon shape 2706 are connected by another leg 2712 of the half-hexagon shape 2706.

The port 2702 extends from an internal channel 2716 of a column in the selector device that includes the growth opening 2700, as described above. As shown, the port 2702 can have a flared shape with internal sidewalls 2718 that are outwardly angled from the internal channel 2716 to the boundaries of the growth opening 2700 (e.g., the legs 2708, 2712). The shape of the growth opening 2700 and/or the port 2702 can increase the merging of metal grains growing out of the growth openings 2700 in an array on the growth side of the selector device as the object is cast in a mold.

FIG. 29 illustrates a hexagon growth opening 2800 and corresponding port 2802. The hexagon growth opening 2800 forms the shape of a hexagon 2804 formed of several hexagon legs 2712 that connect hexagon corners 2714. The port 2802 extends from an internal channel 2716 of a column in the selector device that includes the growth opening 2800, as described above. The port 2802 can have a flared shape with internal sidewalls 2818 that are outwardly angled from the internal channel 2716 to the boundaries of the growth opening 2800 (e.g., the legs 2712). The shape of the growth opening 2800 and/or the port 2802 can increase the merging of metal grains growing out of the growth openings 2800 in an array on the growth side of the selector device as the object is cast in a mold.

Figure 30:
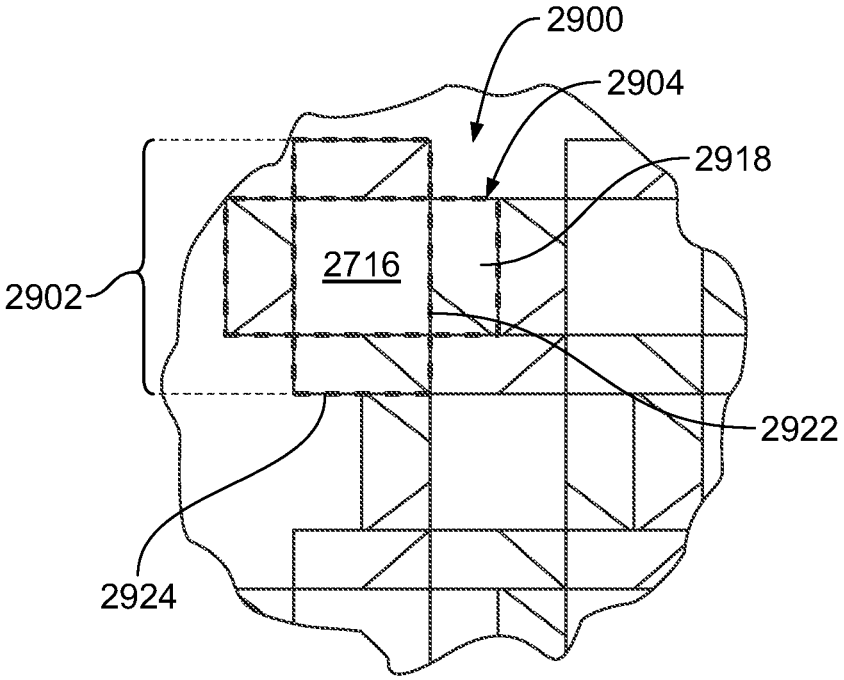
FIG. 30 illustrates another example of a growth opening of a multi-grain selector device.

FIG. 30 illustrates a rectangular cross growth opening 2900 and corresponding port 2902. The rectangular cross growth opening 2900 forms the shape of two elongated rectangles 2904 that intersect or overlie each other. Each rectangle 2904 has opposite longer sides 2922 that are connected by opposite shorter sides 2924. The rectangles 2904 overlie each other such that portions 2920 of each rectangle 2904 protrude beyond the longer sides 2922 of the other rectangle 2904. This forms the shape of a cross or plus sign, as shown in FIG. 30.

The port 2902 extends from an internal channel 2716 of a column in the selector device that includes the growth opening 2900, as described above. The port 2902 can have a flared shape with internal sidewalls 2918 that are outwardly angled from the internal channel 2716 to the boundaries of the growth opening 2900 (e.g., the sides 2922, 2924). The shape of the growth opening 2900 and/or the port 2902 can increase the merging of metal grains growing out of the growth openings 2900 in an array on the growth side of the selector device as the object is cast in a mold. For example, as shown in FIG. 30, the growth openings 2900 can be arranged in the array of a selector device to abut each other such that the internal sidewalls 2918 of one growth opening 2900 intersect with the internal sidewalls 2918 of at least one other growth opening 2900 (or two other growth openings 2900 in the illustrated embodiment).

Figure 31:
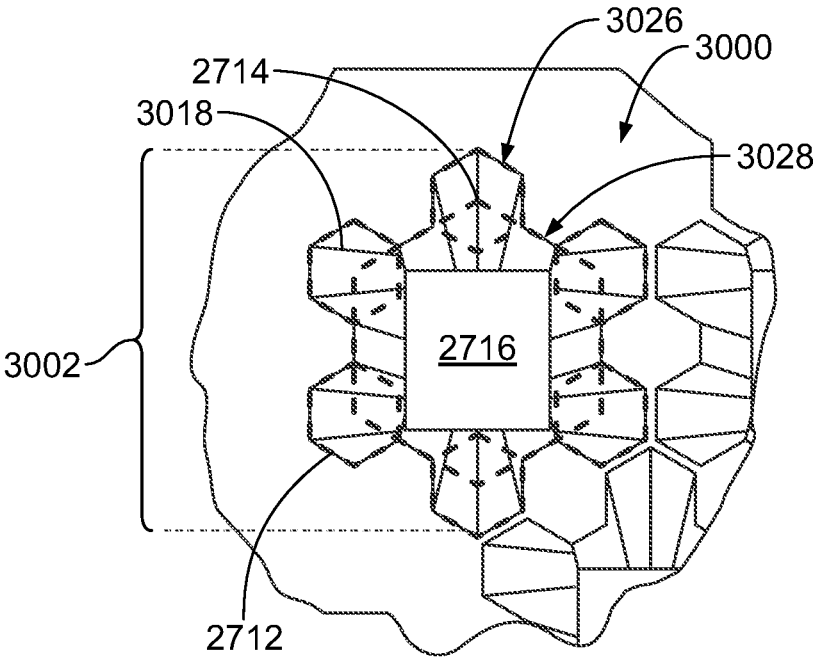
FIG. 31 illustrates another example of a growth opening of a multi-grain selector device.

FIG. 31 illustrates a snowflake growth opening 3000 and corresponding port 3002. The snowflake growth opening 3000 optionally can be referred to as a combined hexagon growth opening 3000 due to the growth opening 3000 being formed from a combination of several (e.g., six in the illustrated embodiment) smaller hexagons 3026 and a larger hexagon 2028. Each smaller hexagon 3026 outwardly projects from a different corner 2714 of the larger hexagon 3028. In the illustrated example, four of the legs 2712 of each smaller hexagon 3026 are located outside the larger hexagon 3028, while two of the legs 2712 of the same smaller hexagon 3026 are located inside the larger hexagon 3028. Each smaller hexagon 3026 is located at a different corner 2714 of the larger hexagon 3028 in FIG. 31.

The port 3002 extends from an internal channel 2716 of a column in the selector device that includes the growth opening 3000, as described above. As shown, the port 3002 can have a flared shape with internal sidewalls 3018 that are outwardly angled from the internal channel 2716 to the boundaries of the growth opening 3000 (e.g., the legs 2712 of the smaller hexagons 3026 and the legs 2712 of the larger hexagons 3028). The shape of the growth opening 3000 and/or the port 3002 can increase the merging of metal grains growing out of the growth openings 3000 in an array on the growth side of the selector device as the object is cast in a mold. For example, the smaller hexagons 3026 can be adjacent to one or more smaller hexagons 3026 of other growth openings 3000 in the array on a selector device, as shown in FIG. 31.

Figure 32:
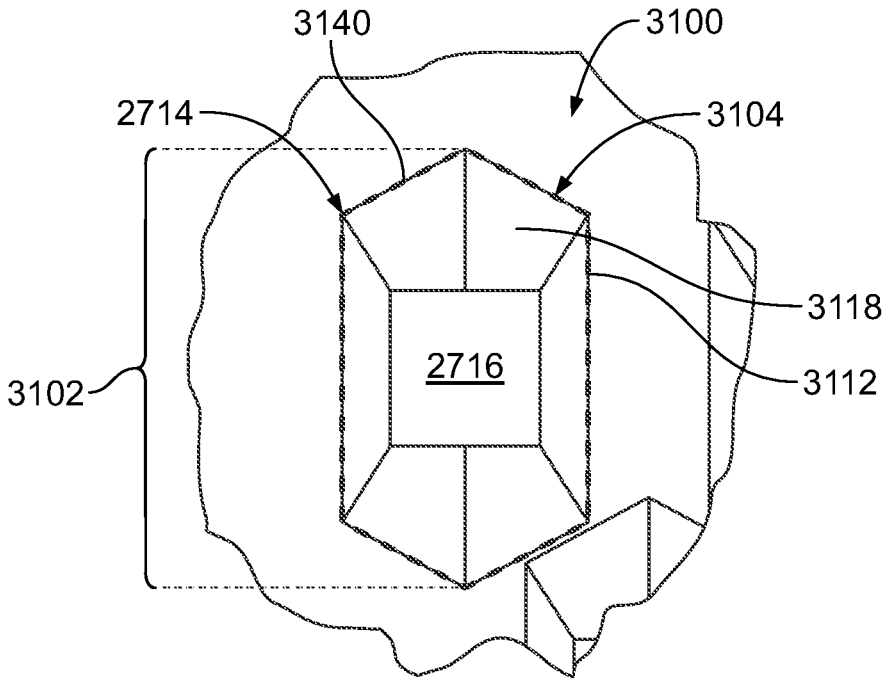
FIG. 32 illustrates another example of a growth opening of a multi-grain selector device.

FIG. 32 illustrates an elongated hexagon growth opening 3100 and corresponding port 3102. The elongated hexagon growth opening 3100 forms the shape of an elongated hexagon 3104 that is longer along two opposing directions than other directions. For example, the hexagon 3104 is formed of two longer hexagon legs 3112 that are connected with four shorter hexagon legs 3130 at hexagon corners 2714. The port 3102 extends from an internal channel 2716 of a column in the selector device that includes the growth opening 3100. The port 3102 can have a flared shape with internal sidewalls 3118 that are outwardly angled from the internal channel 2716 to the boundaries of the growth opening 3100 (e.g., the legs 3112, 3130). The shape of the growth opening 3100 and/or the port 3102 can increase the merging of metal grains growing out of the growth openings 3100 in an array on the growth side of the selector device as the object is cast in a mold.

Figure 33:
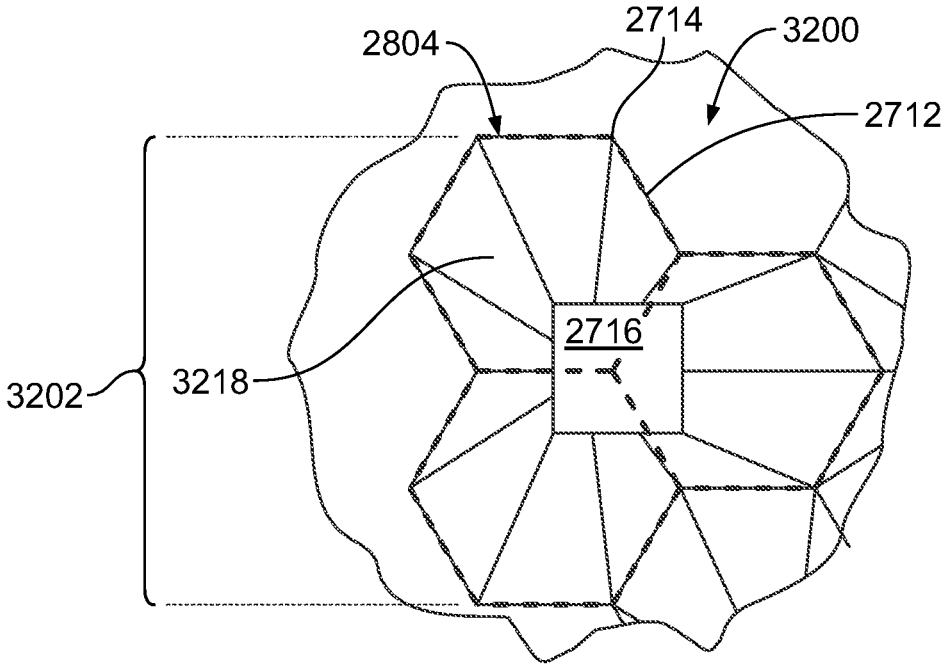
FIG. 33 illustrates another example of a growth opening of a multi-grain selector device.

FIG. 33 illustrates another combined hexagon growth opening 3200 and corresponding port 3202. The combined hexagon growth opening 3200 is formed from three hexagons 2804. Each of the hexagons 2804 shares two legs 2712 with two other hexagons 2804 with each of these legs 2712 shared with only one other hexagon 2804. Each hexagon 2804 also shares two corners 2714 with two other hexagons 2804 with each of these corners 2714 shared with only one other hexagon 2804. Additionally, each hexagon 2804 shares one corner 2714 with both other hexagons 2804, as shown in FIG. 33.

The port 3202 extends from an internal channel 2716 of a column in the selector device that includes the growth opening 3200. The port 3202 can have a flared shape with internal sidewalls 3218 that are outwardly angled from the internal channel 2716 to the boundaries of the growth opening 3200 (e.g., the legs 2712). The shape of the growth opening 3200 and/or the port 3202 can increase the merging of metal grains growing out of the growth openings 3200 in an array on the growth side of the selector device as the object is cast in a mold.

Figure 34:
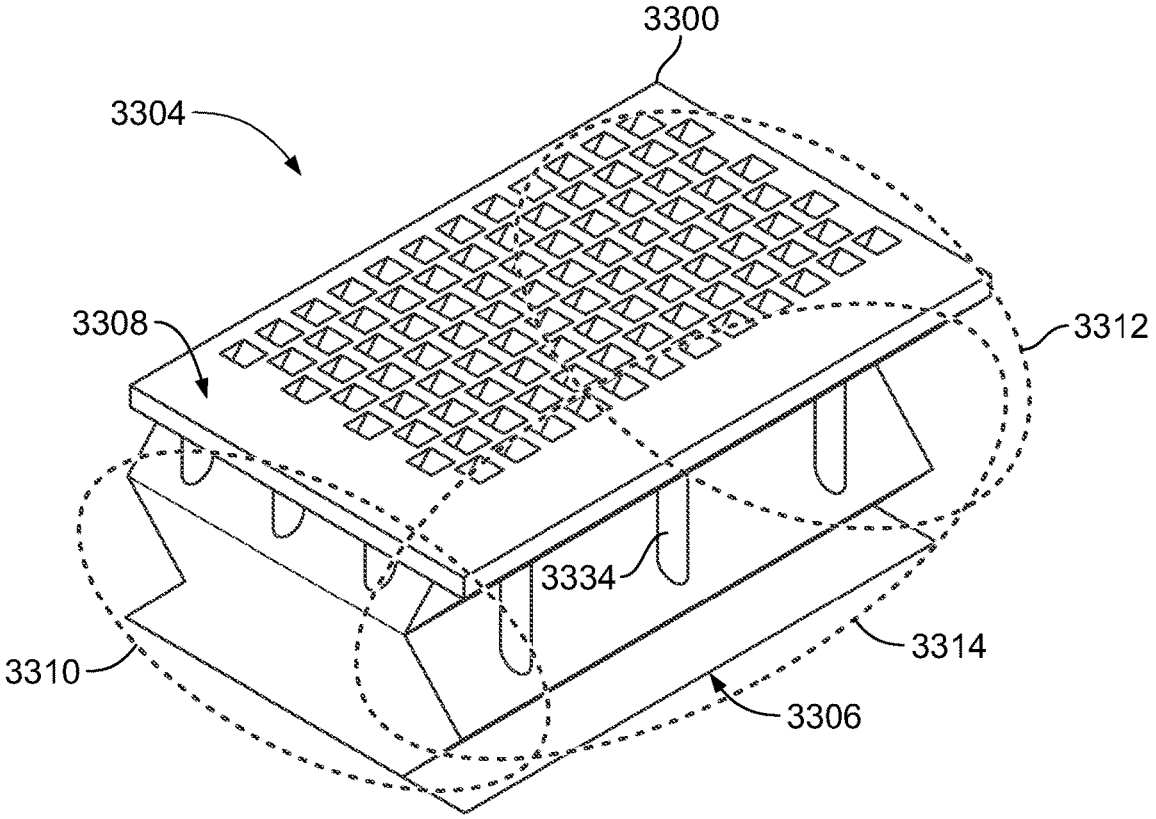
FIG. 34 illustrates a perspective view of another embodiment of a multi-grain selector device.
Figure 35:
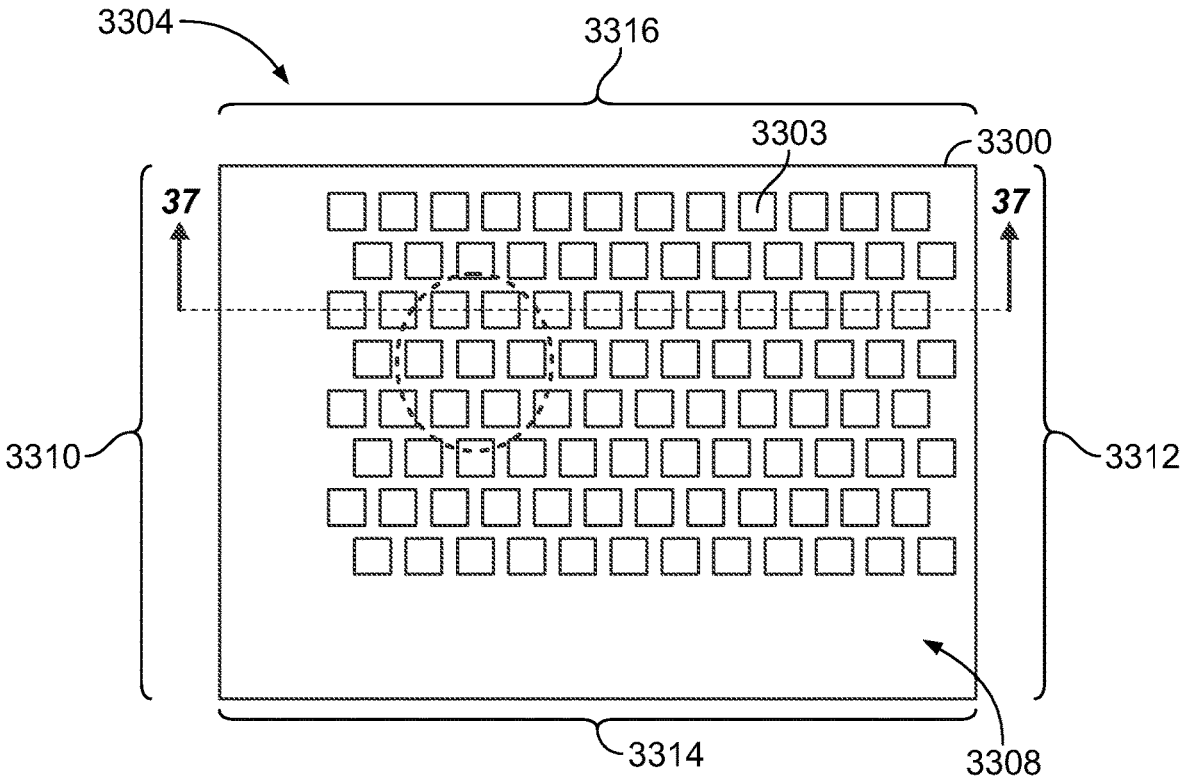
FIG. 35 illustrates a top view of the multi-grain selector device shown in FIG. 34.
Figure 36:
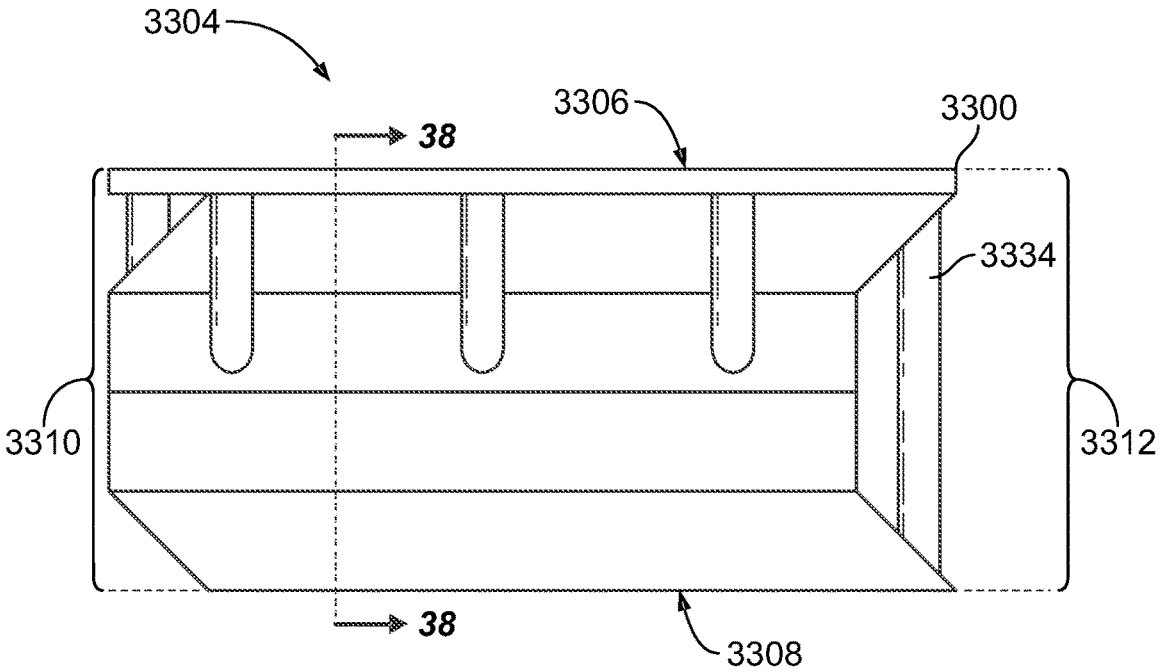
FIG. 36 illustrates a side view of the multi-grain selector device shown in FIG. 34.
Figure 37:
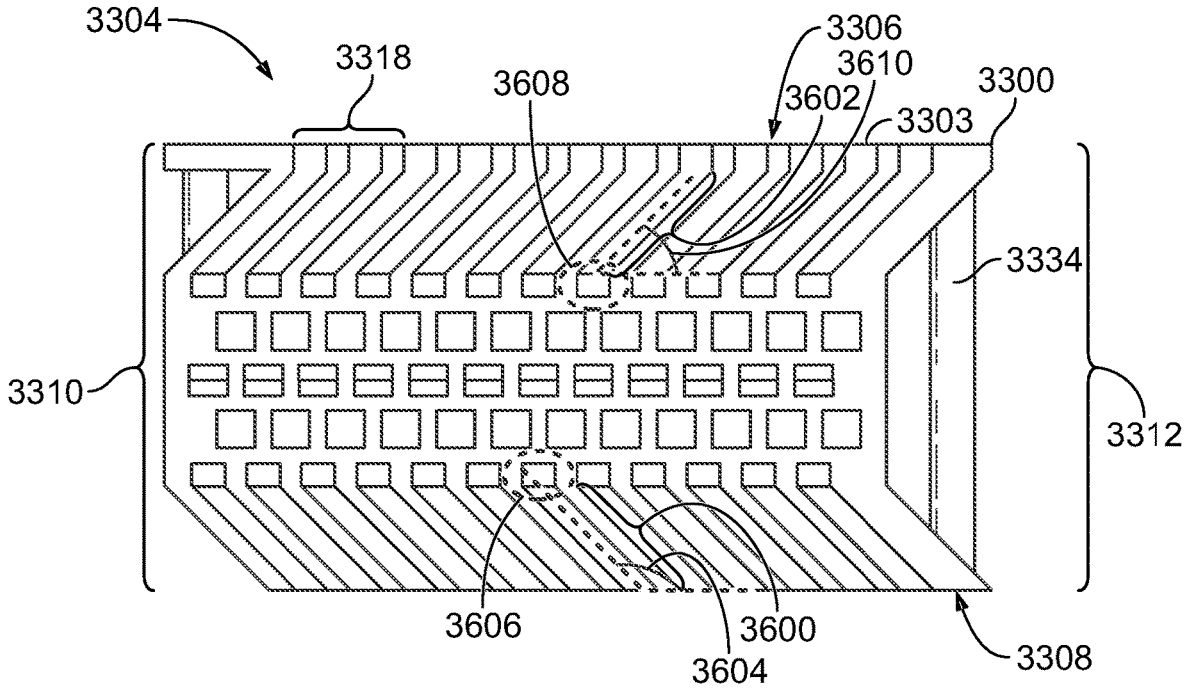
FIG. 37 illustrates a cross-sectional view of the multi-grain selector device shown in FIG. 34.
Figure 38:
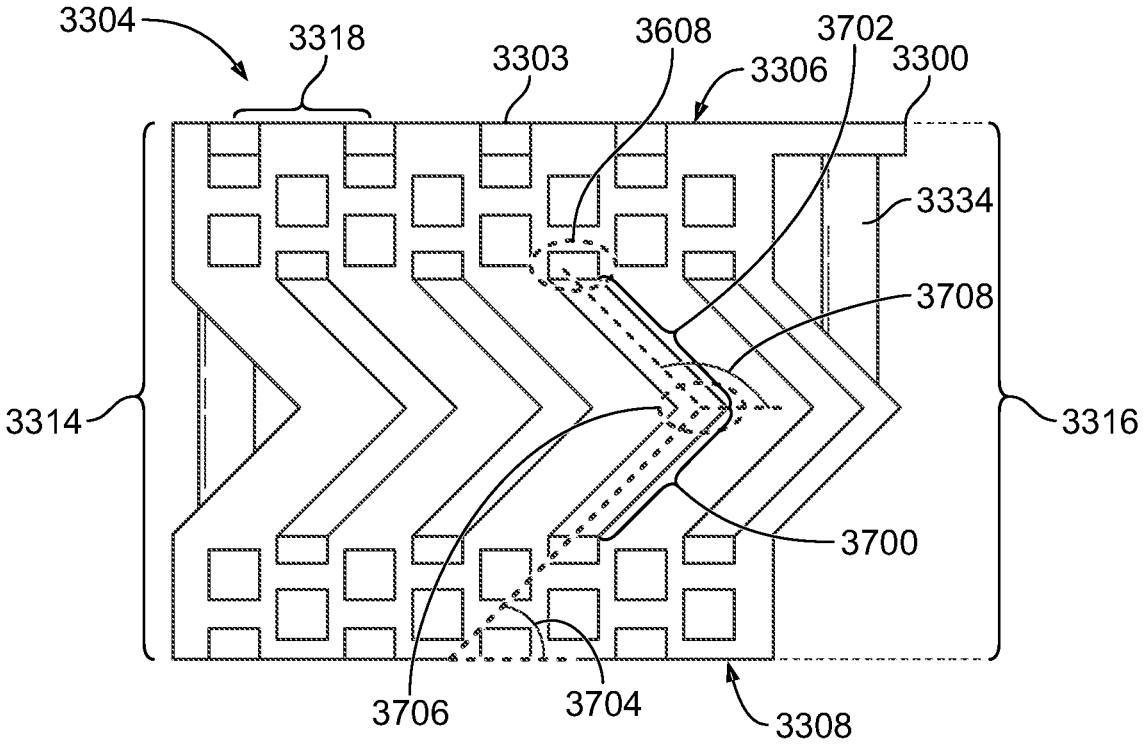
FIG. 38 illustrates another cross-sectional view of the multi-grain selector device shown in FIG. 34.

FIG. 34 illustrates a perspective view of another selector device 3304. FIG. 35 illustrates a top view of the selector device 3304 shown in FIG. 34. FIG. 36 illustrates a side view of the selector device 3304 shown in FIG. 34. FIG. 37 illustrates a cross-sectional view of the selector device 3304 along line 37-37 shown in FIG. 35. FIG. 38 illustrates another cross-sectional view of the selector device 3304 along line 38-38 shown in FIG. 36. The selector device 3304 can represent one or more of the selector devices 104 shown in FIG. 1.

The surfaces in a first set 3310 of surfaces located on one side of the body 3300 (e.g., the left side in the perspectives of FIGS. 35, 36, and 37) can mate with the surfaces in a second set 3312 of surfaces located on an opposite side of the body 3300 (e.g., the right side in the perspectives of FIGS. 35, 36, and 37). The body 3300 also includes a third set 3314 of surfaces located on another side of the body 3300 that extends from the first set 3310 of surfaces to the second set 3312 of surfaces. A fourth set 3316 of surfaces of the body 3300 also extend from the first set 3310 of surfaces to the second set 3312 of surfaces. In the perspective of FIG. 35, the third set 3314 is along the top of the Figure and the fourth set 3316 is along the bottom of the Figure.

Also similar to the other selector devices, the selector device 3304 includes several columns 3318 that extend from openings on a cooling side 3308 of the body 3300 to growth openings 3303 on an opposite growth side 3306 of the body 3300. The columns 3318 form conduits through which grains grow through the selector device 3304 and into the mold 102. Molten metal forms grains within the columns 3318 that grow upward and out of the growth openings 3303 into the mold 102, as described above.

One difference between the selector device 3304 and one or more other selector devices described and/or shown herein is the shape of the columns 3318. Some selector devices described herein include columns that form zig-zag shapes in two dimensions. That is, the zig-zag columns include channels that form conduits that are angled along two different directions in the same plane (see, for example, the columns 218 shown in FIG. 3). In contrast, the columns 3318 in the selector device 3304 are formed from elongated, linear channels 3600, 3602, 3700, 3702 (shown in FIGS. 37 and 38) that are angled along four different directions in different planes. For example, the channels 3600, 3602 are angled in different directions within one plane (e.g., the plane that is defined by and/or parallel to the vertical plane represented by the line 37-37 shown in FIG. 35) and the channels 3700, 3702 are angled in different directions within another plane (e.g., the plane that is defined by and/or parallel to the vertical plane represented by the line 38-38 shown in FIG. 36). These two planes are perpendicular to each other in the illustrated embodiment.

For example, each column 3318 can be oriented along a first obtuse angle 3604 relative to the plane of the cooling side 3306 by the channel 3600, as shown in FIG. 37. The channel 3600 is oriented at the angle 3604 such that the grain growing in the channel 3600 grows in a direction that is angled toward the first set 3310 of exterior surfaces of the body 3300.

The channel 3600 interfaces with and merges into the channel 3700 at a first turn 3606. The channel 3700 is oriented along a first acute angle 3704 relative to the plane of the cooling side 3306, as shown in FIG. 38. The channel 3700 also can be oriented along the first obtuse angle 3604 relative to the plane of the cooling side 3306. The channel 3700 is oriented at the angle 3704 such that the grain growing in the channel 3700 (from the channel 3600) grows in a direction that is angled toward the fourth set 3316 of exterior surfaces of the body 3300.

The channel 3700 interfaces with and merges into the channel 3702 at a second turn 3706. The channel 3702 is oriented along a second obtuse angle 3708 relative to the plane of the cooling side 3306, as shown in FIG. 38. The channel 3702 also can be oriented at the first obtuse angle 3604 from the plane of the cooling side 3306. The channel 3702 is oriented at the angle 3708 such that the grain growing in the channel 3702 (from the channel 3700) grows in a direction that is angled toward the third set 3314 of exterior surfaces of the body 3300.

The channel 3702 interfaces with and merges into the channel 3602 at a third turn 3608. The channel 3602 is oriented along a second acute angle 3610 from the plane of the cooling side 3306, as shown in FIG. 37. The channel 3602 also can be oriented at the second obtuse angle 3708 from the plane of the cooling side 3308. The channel 3602 is oriented at the angle 3610 such that the grain growing in the channel 3602 (from the channel 3702) grows in a direction that is angled toward the second set 3312 of exterior surfaces of the body 3300. The grain can grow in the channel 3602 and exit from the channel 3602 via the growth opening 3303 of the column 3318. This grain grows into the mold 102 to form part of the object being cast.

The columns 3318 each define a zig-zag path that angles back-and-forth along two different (e.g., perpendicular planes). This path can help direct the directions in which the crystal arrangement of the metal ions in the grains are oriented. The path formed by each column 3318 follows a spiral or helical path that changes the direction of rotation between the sides 3606, 3608. For example, in the perspective of the selector device 3304 shown in FIG. 35, the path formed by the column 3318 helically wraps in a clockwise direction around a line extending from the cooling side 3608 to the growth side 3606. This clockwise direction of the column 3318 continues through the channel 3600, the first turn 3606, and the channel 3700. This path formed by the same column 3318 changes direction at the second turn 3706 and begins helically wrapping around the same line in a clockwise direction. For example, the path completes one half rotation around the line from the cooling side 3608 to the second turn 3706 in the clockwise direction and then completes another half rotation around the line from the second turn 3706 to the growth side 3606 in the clockwise direction. The angles 3604, 3610, 3704, 3708 can be varied from what is shown in this embodiment to select a different crystal arrangement and/or direction of growth of the metal crystals in the grains.

Figure 39:
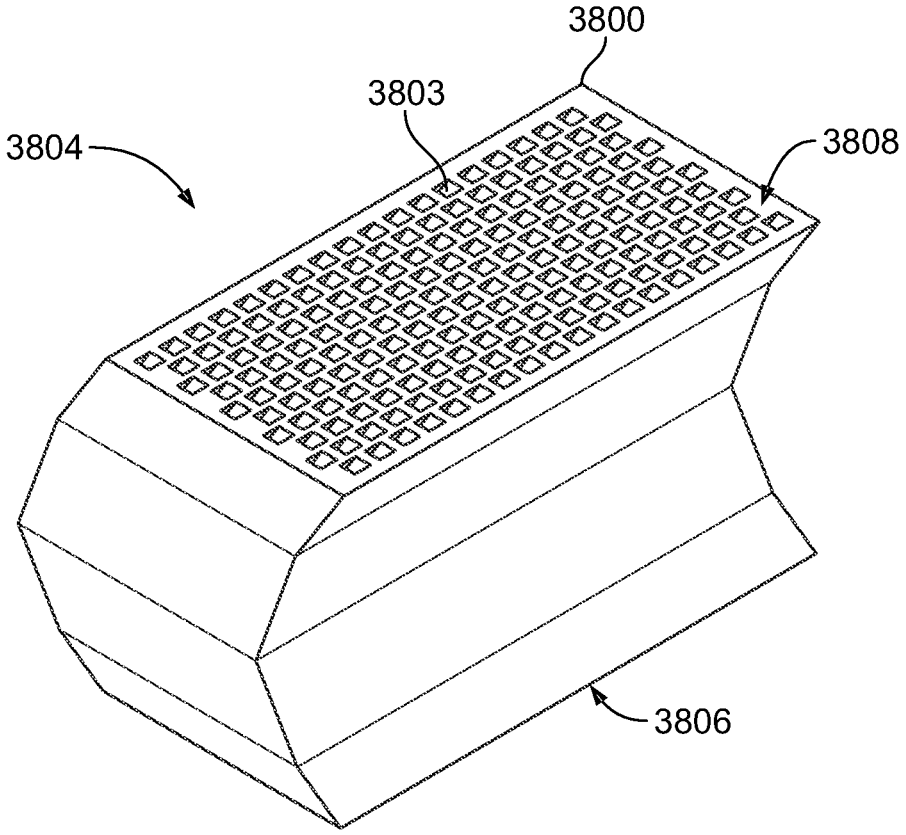
FIG. 39 illustrates a perspective view of another embodiment of a multi-grain selector device.
Figure 40:
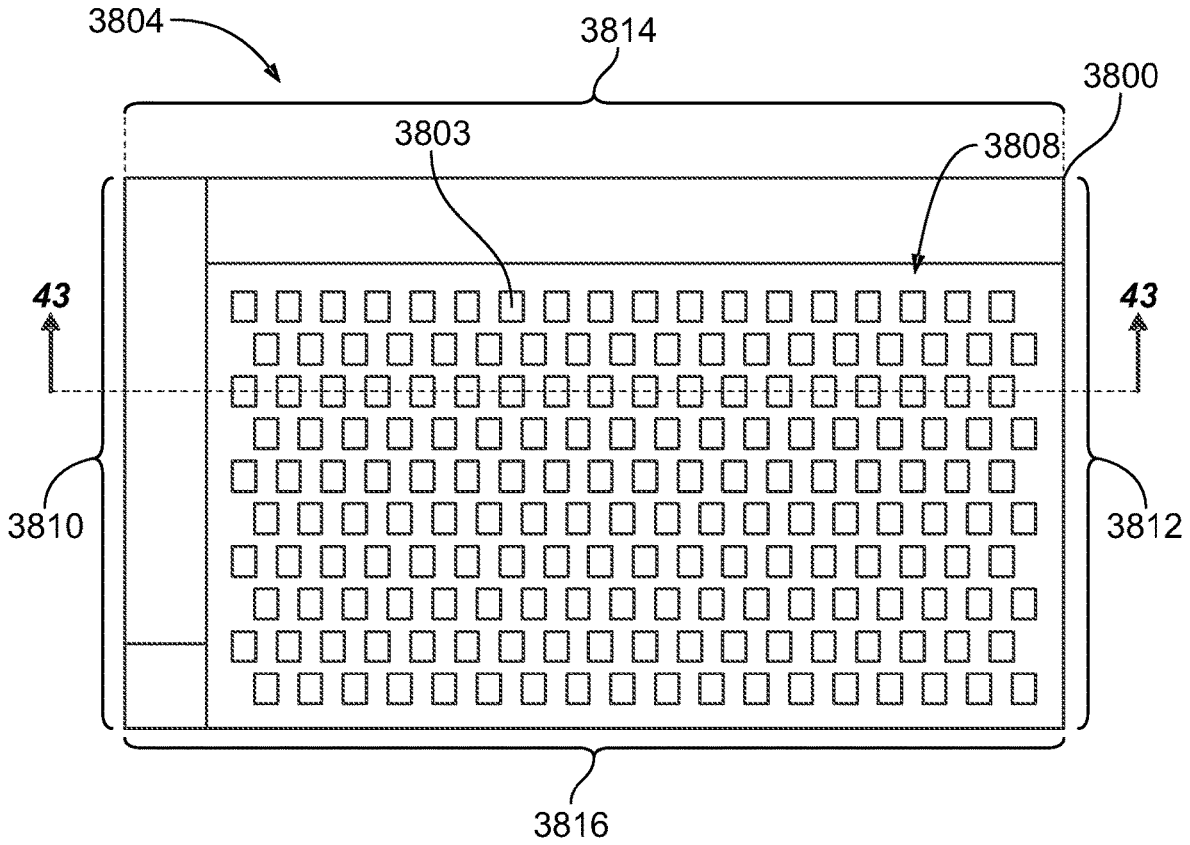
FIG. 40 illustrates a top view of the multi-grain selector device shown in FIG. 39.
Figure 41:
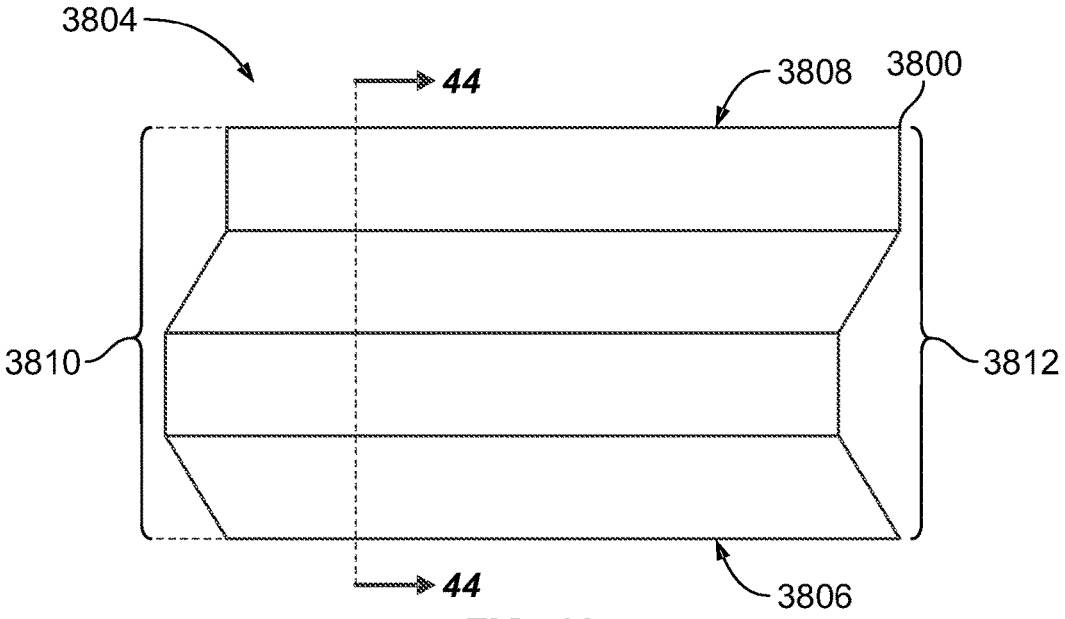
FIG. 41 illustrates a side view of the multi-grain selector device shown in FIG. 39.
Figure 42:
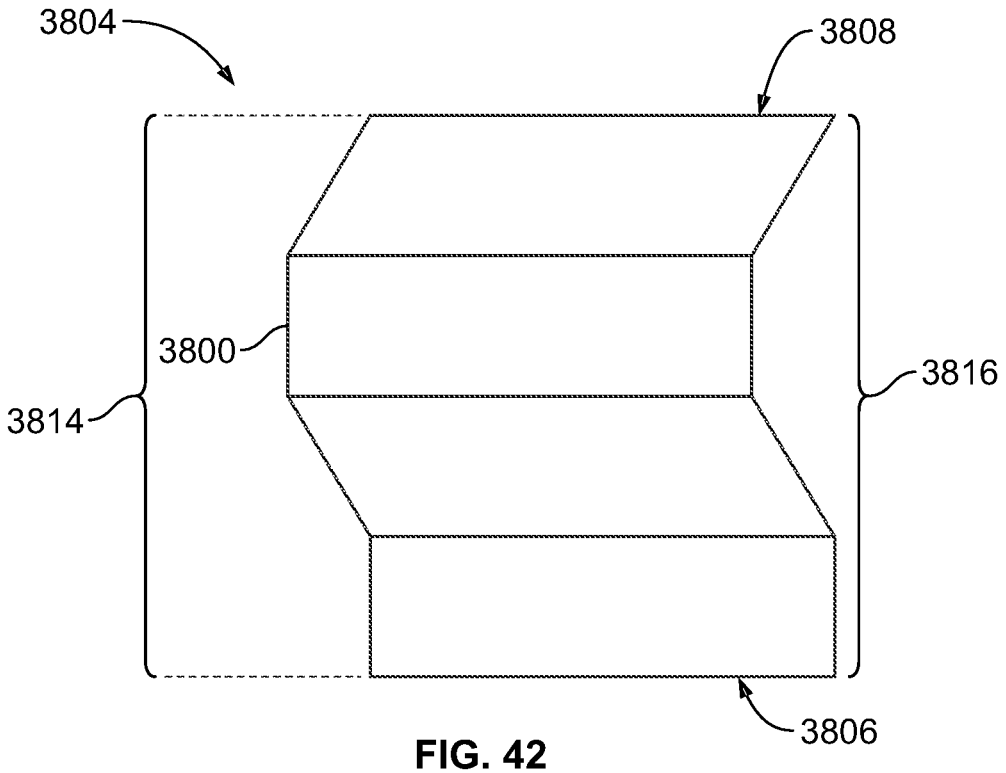
FIG. 42 illustrates another side view of the multi-grain selector device shown in FIG. 39.
Figure 43:
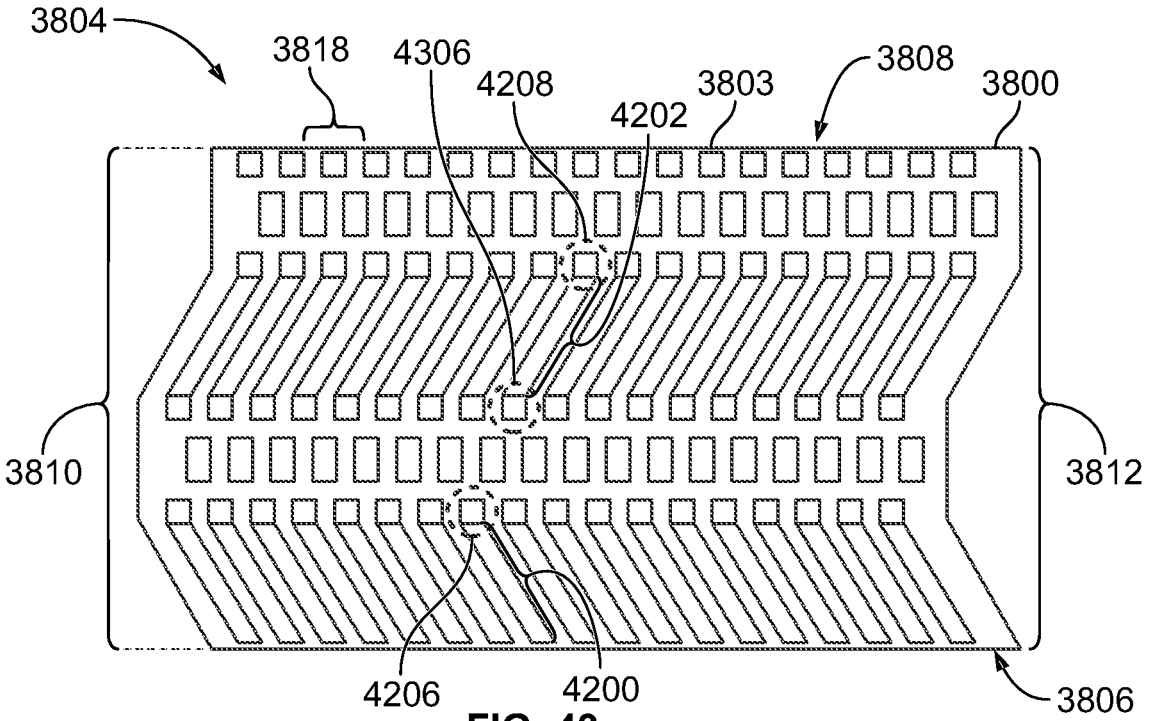
FIG. 43 illustrates a cross-sectional view of the multi-grain selector device shown in FIG. 39.
Figure 44:
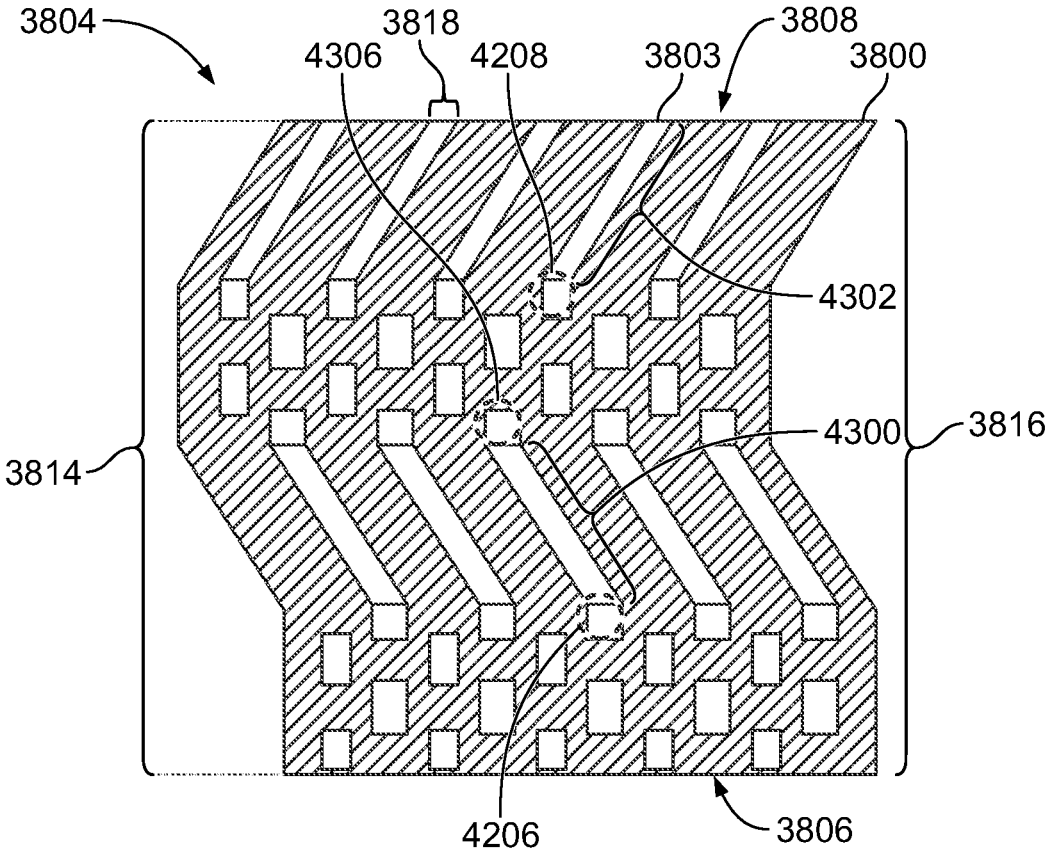
FIG. 44 illustrates another cross-sectional view of the multi-grain selector device shown in FIG. 39.

FIG. 39 illustrates a perspective view of another selector device 3804. FIG. 40 illustrates a top view of the selector device 3804 shown in FIG. 39. FIG. 41 illustrates a side view of the selector device 3804 shown in FIG. 39. FIG. 42 illustrates an end view of the selector device 3804 shown in FIG. 39. FIG. 43 illustrates a cross-sectional view of the selector device 3804 along line 43-43 shown in FIG. 40. FIG. 44 illustrates another cross-sectional view of the selector device 3804 along line 44-44 shown in FIG. 41. The selector device 3804 can represent one or more of the selector devices 104 shown in FIG. 1.

Similar to the other selector devices described herein, the selector device 3804 is formed from a body 3800 having surfaces that can mate with each other to form a larger assembly. For example, the surfaces in a first set 3810 of surfaces located on one side of the body 3800 (e.g., the left side in the perspectives of FIGS. 40, 41, and 43) can mate with the surfaces in a second set 3812 of surfaces located on an opposite side of the body 3800 (e.g., the right side in the perspectives of FIGS. 40, 41, and 43). The surfaces in the first set 3810 are those surfaces shown in FIG. 42. The body 3800 also includes a third set 3814 of surfaces located on another side of the body 3800 that extends from the first set 3810 of surfaces to the second set 3812 of surfaces. A fourth set 3816 of surfaces of the body 3800 also extend from the first set 3810 of surfaces to the second set 3812 of surfaces. In the perspective of FIG. 40, the third set 3814 is along the top of the Figure and the fourth set 3816 is along the bottom of the Figure. In the perspective of FIGS. 42 and 44, the third set 3814 is along the left sides of the Figures and the fourth set 3816 is along the right sides of the Figures.

The selector device 3804 includes several columns 3818 that extend from openings on a cooling side 3806 of the body 3800 to growth openings 3803 on an opposite growth side 3808 of the body 3800, as described above. The columns 3818 form conduits through which grains grow through the selector device 3804 and into the mold 102. Molten metal forms grains within the columns 3818 that grow upward and out of the growth openings 3803 into the mold 102, as described above.

The columns 3818 of the selector device 3804 form helical or spiral paths that wrap one around (e.g., complete one spiral or helical revolution) from the cooling side 3806 to the growth side 3806. The columns 3818 are formed from elongated, linear channels 4200, 4202, 4300, 4302 (shown in FIGS. 43 and 44) that are angled along different directions to form the helical or spiral path of each column 3818.

For example, each column 3818 extends upward from the cooling side 3806 toward the growth side 3806 via the channel 4200. The channel 4200 is oriented at an obtuse angle from the growth side 3806, similar to as described above in connection with the channel 3600 shown in FIG. 37. This can cause the grain growing in the channel 4200 to grow in a direction that is angled toward the first set 3810 of exterior surfaces of the body 3800.

The channel 4200 interfaces with and merges into the channel 4300 at a first turn 4206. The channel 4300 is oriented along another obtuse angle from the cooling side 3806, as shown in FIG. 44. The channel 4300 is oriented at the obtuse angle such that the grain growing in the channel 4300 (from the channel 4200) grows in a direction that is angled toward the third set 3814 of exterior surfaces of the body 3800.

The channel 4300 interfaces with and merges into the channel 4202 at a second turn 4306. The channel 4202 is oriented along an acute angle from the cooling side 3806, as shown in FIG. 43. The channel 4202 is oriented at this acute angle such that the grain growing in the channel 4202 (from the channel 4300) grows in a direction that is angled toward the second set 3812 of exterior surfaces of the body 3800.

The channel 4202 interfaces with and merges into the channel 4302 at a third turn 4208. The channel 4302 is oriented along an obtuse angle from the cooling side 3806, as shown in FIG. 44. The channel 4302 is oriented at the acute angle such that the grain growing in the channel 4302 (from the channel 4202) grows in a direction that is angled toward the fourth set 3816 of exterior surfaces of the body 3800. The grain can grow in the channel 4302 and exit from the channel 4302 via the growth opening 3803 of the column 3818. This grain grows into the mold 102 to form part of the object being cast.

The columns 3818 each define a zig-zag path that angles back-and-forth along two different (e.g., perpendicular planes). This path can help direct the directions in which the crystal arrangement of the metal ions in the grains are oriented. The path formed by each column 3818 follows a spiral or helical path that completes one revolution or spiral around a line extending from the cooling side 3808 to the growth side 3806.

While many of the channels forming the various columns described herein are shown to be linear, alternatively, one or more of the channels can have a non-linear shape, such as a curved shape. The bodies of the separator devices can be formed via additive manufacturing. Many of the shapes of the columns described herein may not be possible via other manufacturing processes and/or forming the shapes of the columns using manufacturing processes other than additive manufacturing may be too costly to be commercially reasonable.

Figure 45:
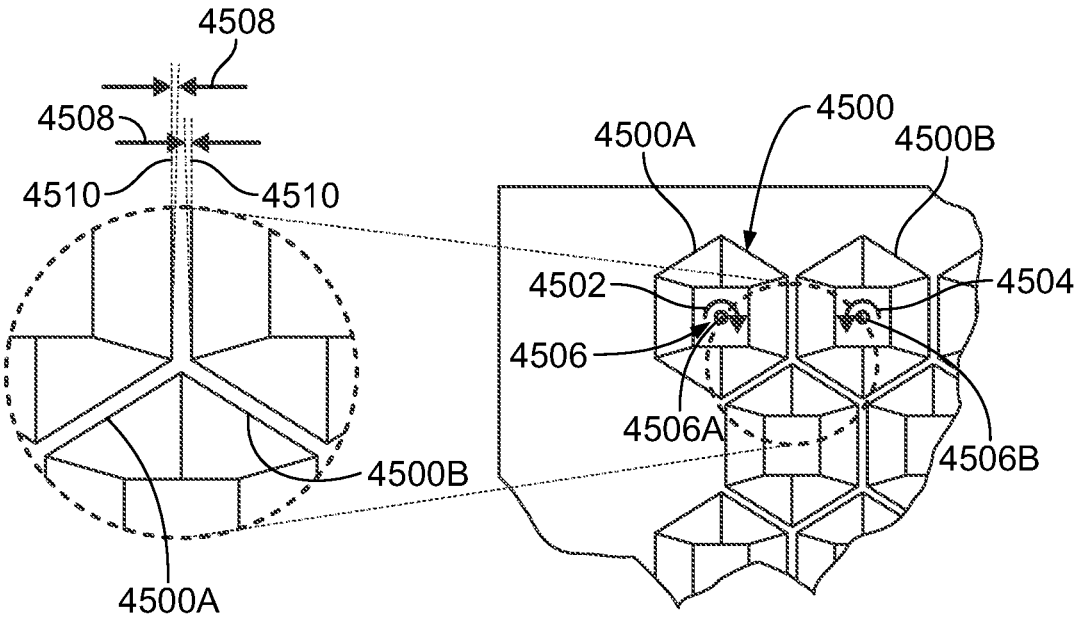
FIG. 45 illustrates another example of growth openings of a multi-grain selector device.

FIG. 45 illustrates another embodiment of growth openings 4500 that may be used in one or more of the grain selector devices described herein. The growth openings in the selector devices shown in FIGS. 4 through 7, 10, and 12 through 44 are all aligned with each other. For example, the same edges in neighboring growth openings in the selector devices shown in FIGS. 4 through 7, 10, and 12 through 44 are parallel to each other or oriented at the same angle relative to the same reference plane. The growth openings 4500 (e.g., openings 4500A, 4500B) shown in FIG. 45 are rotationally offset relative to each other. For example, the growth openings 4500 may have the same shape as the growth openings 2600 shown in FIG. 27. But, neighboring growth openings 4500 may be rotated in different directions 4502, 4504 about or around parallel axes 4506 (e.g., axes 4506A, 4506B). Each of the axes 4506 is a vertical line that is oriented perpendicular to the growth and cooling sides of the corresponding selector device that includes the growth openings 4500. Growth openings of other selector devices (e.g., growth openings having other shapes) also may be rotationally offset in other embodiments.

One of the growth openings 4500A is offset (e.g., rotated relative to the orientation of the growth openings 2600) around the axis 4506A by a designated angle 4508 in a clockwise direction 4502 while the other growth opening 4500B is offset (e.g., rotated relative to the orientation of the growth openings 2600) around the parallel axis 4506B by the same designated angle 4508, but in an opposite counter-clockwise direction 4504. The designated angles 4508 are shown in FIG. 45 relative to parallel planes 4510 that is oriented perpendicular to the opposite sides of the selector device that includes the growth openings 4500, such as the sides 2426, 2428 of the selector device 2404. In the illustrated embodiment, the angle 4508 is four degrees. Alternatively, the growth openings 4500 may be offset by larger or smaller angles 4508. Optionally, different growth openings 4500 may be offset by different angles. By mis-aligning the growth openings 4500 relative to each other, smaller grains growing out of the growth openings 4500 are prevented from merging into each other. This can help to create a pattern of slightly misoriented grains that are stable to subsequent coarsening.

Figure 46:
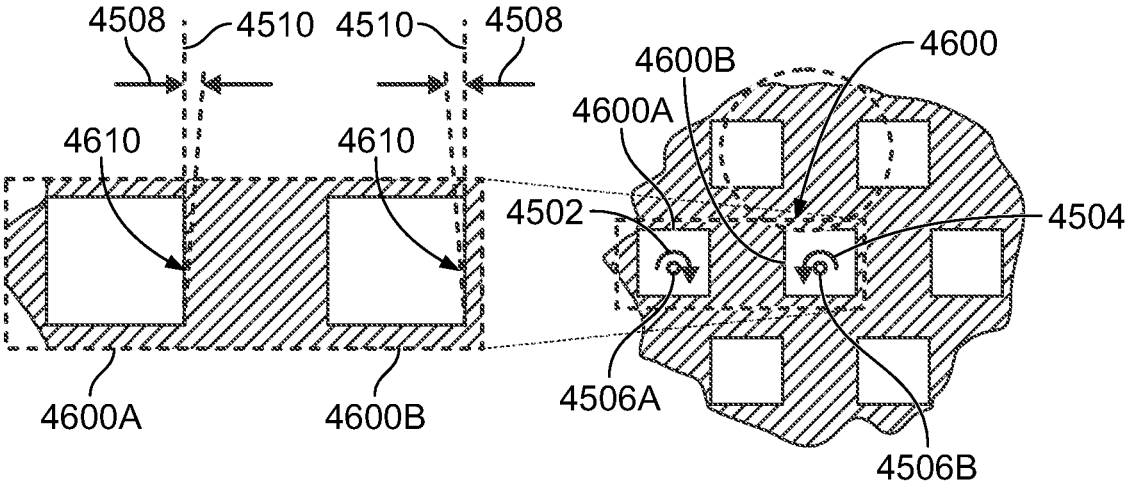
FIG. 46 illustrates another example of channels of a multi-grain selector device.

FIG. 46 illustrates another embodiment of channels 4600 that may be used in one or more of the grain selector devices described herein. The channels 4600 (e.g., channels 4600A, 4600B) can represent one or more of the channels or columns of the grain selector devices described herein, such as the channels 300 and/or 302. Other channels or columns described herein may have internal sides or surfaces that are aligned with each other. For example, the same internal surfaces of all channels in a two-dimensional plane that is parallel to and located between the growth side and the cooling side may be parallel to each other in one or more embodiments shown and/or described herein. Alternatively, the channels 4600 are rotationally offset from each other such that the same internal sides or surfaces 4610 of neighboring channels 4600A, 4600B are not parallel to each other.

For example, the same left internal sides in the channels 300 in FIG. 3 are all parallel to each other in the same two-dimensional plane that is parallel to the surface 206 and/or 208, the same right internal sides in the channels 300 in FIG. 3 are all parallel to each other in the same two-dimensional plane that is parallel to the surface 206 and/or 208, the same left internal sides of the channels 302 in FIG. 3 are all parallel to each other in the same two-dimensional plane that is parallel to the surface 206 and/or 208, and the same right internal sides in the channels 302 are all parallel to each other in the same two-dimensional plane that is parallel to the surface 206 and/or 208.

The channels 4600 (e.g., channels 4600A, 4600B) shown in FIG. 46 are rotationally offset relative to each other in the same two-dimensional plane that is parallel to the growth side and/or cooling side of the selector device that includes the channels 4600. For example, the growth openings 4600 may have the same cross-sectional shape as the channels 300 and/or 302 shown in FIG. 3. But, neighboring growth openings 4600 may be rotated in different directions 4502, 4504 about or around the parallel axes 4506 (e.g., axes 4506A, 4506B). Channels of other selector devices also may be rotationally offset in other embodiments.

One of the growth openings 4600A is rotationally offset around the axis 4506A by the designated angle 4508 in a clockwise direction 4502 while the other channel 4600B is rotationally offset around the parallel axis 4506B by the same designated angle 4508, but in an opposite counter-clockwise direction 4504. In the illustrated embodiment, the angle 4508 is four degrees. Alternatively, the channels 4600 may be offset by larger or smaller angles 4508. Optionally, different channels 4600 may be offset by different angles. The rotational offsets of neighboring growth openings 4500 can assist in ensuring that the grains emerging from growth openings are rotated relative to each other by an angle that is greater than 0 degrees and less than 15 degrees, and in a pattern that is defined by the array of the openings 4500.

Figure 47:
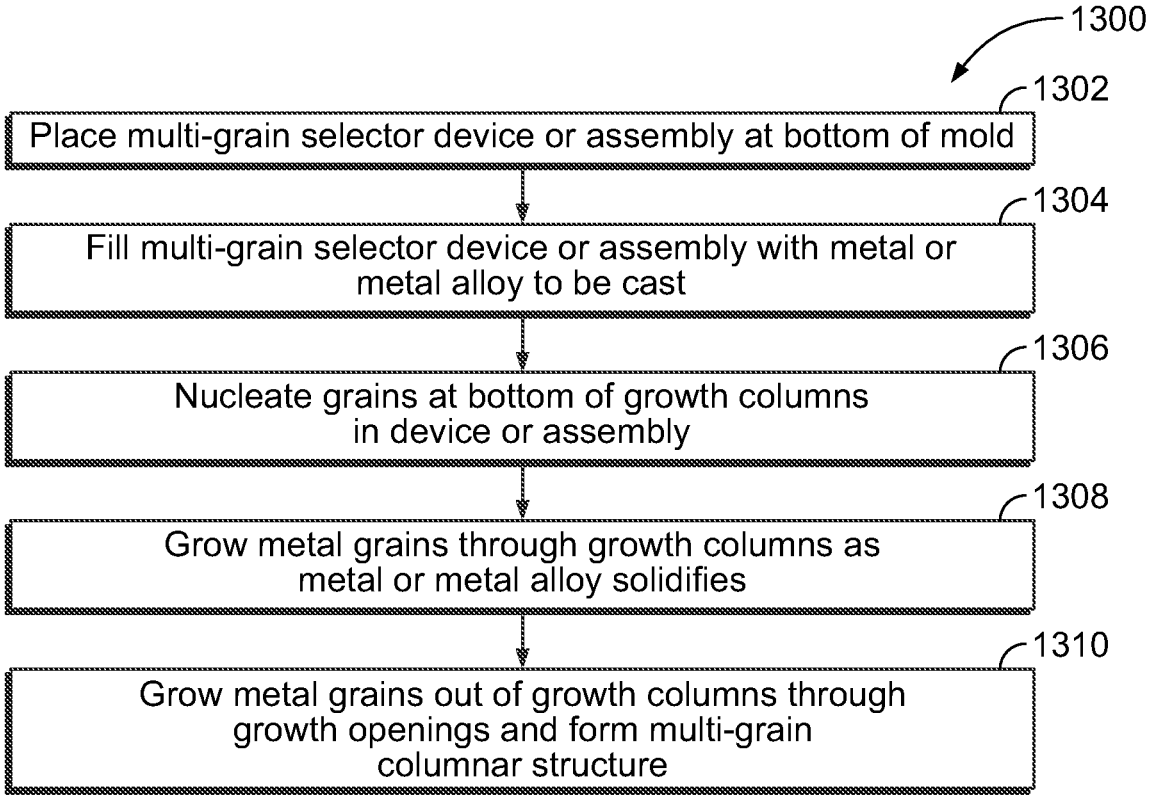
FIG. 47 illustrates a flowchart of one embodiment of a method for growing a multi-grain columnar article using one or more of the multi-grain selector devices and/or assemblies described herein.

FIG. 47 illustrates a flowchart of one embodiment of a method 1300 for growing a multi-grain columnar article using one or more of the multi-grain selector devices and/or assemblies described herein. At 1302, the selector device or assembly is placed at the bottom of a mold to be cast. The selector device or assembly can be placed onto a cooling plate such that the cooling side of the selector device or assembly is adjacent to the cooling plate.

Optionally, an open chamber may be positioned between the selector device or assembly and the cooling plate. For example, to ensure that grains being growth in the device or assembly have primary orientations along a desired direction (e.g., the direction <100>), a chamber could be created below the multigrain selector device or assembly. This chamber can be a grain starter chamber, and can be one to two inches, or 2.5 to five centimeters in height (e.g., between the cooling plate and the selector device or assembly).

At 1304, the selector device or assembly is filled with metal or a metal alloy, such as by filling the growth columns with molten metal or metal alloy. Optionally, to aid in the development of multiple grains at the bottom of the selector device or assembly, the columns in the device or assembly could be seeded with elements such as cobalt.

At 1306, metal grains of random secondary orientation are nucleated at the bottom of the growth columns in the device or assembly. This nucleation can occur due to cooling by the cooling plate near the bottoms of the growth columns. At 1308, the metal grains that are nucleated grow upward through the growth columns. The metal grains can grow within the columns. The narrow size of the columns can help ensure that the single grain emerges from each growth column. The orientation of the columns can preferentially grow the metal grains along preferred directions. For example, with respect to the zig-zag shaped columns, the orientation of the zig-zag columns can cause preferential growth of grains that are oriented with a <010> direction in the plane of the zig-zag columns. The grains emerging from the growth surfaces of the devices or assemblies can have similar orientations and form a multigrain structure in which each grain has a low angle misorientation with neighboring grains.

In one example, the selector device or assembly can be used to create long bars that could then be sliced into multi-grain seeds to be used in seeding other castings. A designed directional solidification (DDS) seed could be affixed to a cooling plate. A wax airfoil pattern (with or without ceramic core) could be attached to the DDS seed in a specified orientation and location. The wax sprue, risers, runners, and pour cup could be assembled, and the wax assembly shelled, dewaxed, and fired. During casting, the molten alloy would impinge and partially melt the DDS seed. As the mold is withdrawn from the hot zone of the furnace, a columnar dendritic structure would grow as the melt solidifies in response to the thermal gradient. Instead of the columnar grains being randomly aligned, however, the grains would align according to the structure of the DDS seed. The small misorientation of the grains in the DDS seed means that the driving force for coarsening of the grain structure should be low. Thus, with the DDS seed, the number and orientation of the grains in the airfoil can be designed into the casting. The location of the DDS grain boundaries can also be defined by the DDS crystal. Such seeds could be used to create a DS structure in another similar alloy. For example, an N500 seed could be used as a template for an N5 component.

One or more embodiments of the inventive subject matter described herein enable DS components to be created with faster withdrawal rates than currently known methods, thereby resulting in finer grain structures, smaller dendritic arm spacings, and thus increased foundry throughput and lower costs. The selector devices and assemblies can be used to create DS turbine blades that allow design engineers to specify the in-plane orientation of each DS grain in the blades. This allows for the stiffness and harmonics of the blade to be defined or controlled without adding additional stiffening struts to the blades. The blades can be designed with more or all weight of the blades being assigned to creating power rather than to preventing undesirable vibration frequencies in the blades. This can extend the useful lives of the blades, as the design engineer can alter the microstructure to move the vibration frequencies of the blade away from the operating frequency of the turbine.

The structures and assemblies can limit grain boundary orientations in the formed articles to less than ten to twelve degrees, which may also improve the transverse creep properties of the articles relative to directionally solidified structures in which there are higher angle boundaries.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A multi-grain selector device, the selector device comprising:

an outer body defining exterior surfaces of the selector device, the outer body comprising a cooling side configured to face a cooling plate of a casting furnace and an opposite mold side configured to face into a mold, the outer body of the selector device configured to be coupled with the mold, wherein the outer body includes an array of multiple grain selector columns, each grain selector column of the multiple grain selector columns is formed from two or more linear transversely oriented, elongated channels that are fluidly coupled with each other in an end-to-end arrangement oriented along a growth direction that extends from the cooling side of the outer body toward the mold side of the outer body, each of the grain selector columns extending to growth openings on the mold side of the outer body, wherein each of the grain selector columns is configured to form a single grain column out of the corresponding growth opening that is part of a columnar grained article to be formed in the mold that grows along the growth direction, wherein the growth openings of each of the grain selector columns in the array are arranged in a regular, repeating pattern along the mold side, wherein the growth openings include one array of larger growth openings and another array of smaller growth openings.

2. The multi-grain selector device of claim 1, wherein each neighboring pair of the elongated channels includes first and second channels connected with each other and oriented relative to each other at an angle of less than fifteen degrees from each other.

3. The multi-grain selector device of claim 1, wherein the growth openings of the selector columns in the array are arranged in a regularly repeating hexagonal pattern.

4. The multi-grain selector device of claim 1, wherein the elongated channels in each of the grain selector columns define a zig zag path extending from the cooling side of the body to the mold side of the body.

5. The multi-grain selector device of claim 1, wherein the outer body includes one or more interlocking features extending into a thickness of the outer body between the cooling side and the mold side, the one or more interlocking features shaped to mate with one or more corresponding interlocking features of another outer body of another multi-grain selector device to combine the outer body and the other outer body into a larger multi-grain selector device.

6. The multi-grain selector device of claim 1, wherein the outer body includes a straight edge on each side of the array of the selector columns that is shaped to mate with a corresponding straight edge of another outer body of another multi-grain selector device.

7. The multi-grain selector device of claim 1, wherein the outer body includes a non-linear edge on at least one side of the array of the selector columns.

8. The multi-grain selector device of claim 1, wherein the outer body includes a jagged edge formed from multiple intersections of multiple linear borders of at least some of the selector columns in the body.

9. The multi-grain selector device of claim 1, wherein the columnar grained article is a turbine blade.

10. The multi-grain selector device of claim 1, wherein the columnar grained article is a multi-grain bar assembly formed of single grain casting seeds.

11. The multi-grain selector device of claim 1, wherein the selector columns include ports that extend to the growth openings, the ports having internal sidewalls that are flared out to the growth openings.

12. The multi-grain selector device of claim 1, wherein at least part of the growth openings has a shape of one or more of a rectangle, a triangle, or a hexagon.

* * * * *